US008322283B2

(12) United States Patent
Barthelme et al.

(10) Patent No.: US 8,322,283 B2
(45) Date of Patent: Dec. 4, 2012

(54) METHOD FOR PROVIDING PRINTING FORMES AT INSTALLATION POSITIONS ON ONE OF A PLURALITY OF FORME CYLINDERS DISPOSED IN A PRINTING PRESS

(75) Inventors: Joachim Barthelme, Würzburg (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 13/138,104

(22) PCT Filed: Oct. 22, 2009

(86) PCT No.: PCT/EP2009/063877

§ 371 (c)(1),
(2), (4) Date: Jul. 7, 2011

(87) PCT Pub. No.: WO2010/081569

PCT Pub. Date: Jul. 22, 2010

(65) Prior Publication Data

US 2011/0265675 A1 Nov. 3, 2011

(30) Foreign Application Priority Data

| | | |
|---|---|---|
| Jan. 14, 2009 | (DE) | 102009000217 |
| Jan. 20, 2009 | (DE) | 102009000332 |
| Mar. 16, 2009 | (DE) | 102009001578 |
| Oct. 6, 2009 | (DE) | 102009045402 |

(51) Int. Cl.
*B41F 27/12* (2006.01)

(52) U.S. Cl. ..... 101/477; 101/415.1

(58) Field of Classification Search ..... 101/415.1, 101/477
See application file for complete search history.

(56) References Cited

U.S. PATENT DOCUMENTS

| | | | | |
|---|---|---|---|---|
| 4,727,807 | A | 3/1988 | Suzuki et al. | |
| 4,803,634 | A | 2/1989 | Ohno et al. | |
| 5,074,212 | A | 12/1991 | Kobler et al. | |
| 5,440,985 | A * | 8/1995 | Shimmura et al. | 101/477 |
| 7,331,287 | B2 | 2/2008 | Schneider et al. | |

(Continued)

FOREIGN PATENT DOCUMENTS

| | | |
|---|---|---|
| DE | 36 30 876 C2 | 3/1987 |

(Continued)

*Primary Examiner* — Ren Yan
(74) *Attorney, Agent, or Firm* — Mattingly & Malur, P.C.

(57) ABSTRACT

Printing forms are prepared in assembly positions on one of several printing cylinders in a printing press. Several such printing forms are made available at a distance from the printing press, at the end of at least one sheet extruder with a sheet exposure device. A particular printing form for the printing cylinder is distributed among mobile collector containers that are standing ready on the sheet extruder. Different mobile collection containers, with printing forms for the same printing cylinders are supplied to that printing cylinder. At a particular time, and on an operating side of the printing press, several such mobile collection containers are provided and are positioned adjacent each other in the axial direction of the print cylinder. Print forms for the assembly positions, which are arranged adjacent to each other on the print cylinder, in the axial direction of the print cylinder, and which have been provided to the printing press in the various mobile collection contains, are taken from the mobile collection containers and are provided on the assembly positions of the printing cylinder.

40 Claims, 46 Drawing Sheets

U.S. PATENT DOCUMENTS

| | | | | |
|---|---|---|---|---|
| 2005/0172844 | A1 | 8/2005 | Schneider et al. | |
| 2007/0272105 | A1 | 11/2007 | Burgess et al. | |
| 2008/0028966 | A1 * | 2/2008 | Schneider et al. | 101/477 |
| 2008/0163776 | A1 | 7/2008 | Gsell et al. | |
| 2008/0271629 | A1 | 11/2008 | Fischer et al. | |

FOREIGN PATENT DOCUMENTS

| | | | |
|---|---|---|---|
| DE | 40 03 445 | A1 | 8/1991 |
| DE | 44 42 265 | A1 | 5/1996 |
| DE | 102 20 424 | A1 | 6/2003 |
| DE | 103 14 341 | B3 | 8/2004 |
| DE | 10 2005 042 756 | A1 | 3/2007 |
| DE | 10 2006 032 204 | B3 | 10/2007 |
| DE | 20 2007 011 576 | U1 | 12/2007 |
| DE | 10 2006 032 203 | A1 | 1/2008 |
| DE | 10 2006 061 452 | A1 | 6/2008 |
| DE | 20 2008 012 225 | U1 | 1/2009 |
| EP | 1 002 646 | A1 | 5/2000 |
| EP | 1 435 292 | A1 | 7/2004 |
| EP | 1 878 570 | A2 | 1/2008 |
| GB | 2 413 530 | A | 11/2005 |
| WO | 2004085153 | A2 | 10/2004 |

* cited by examiner

METHOD FOR PROVIDING PRINTING FORMES AT INSTALLATION POSITIONS ON ONE OF A PLURALITY OF FORME CYLINDERS DISPOSED IN A PRINTING PRESS

CROSS-REFERENCE TO RELATED APPLICATIONS

This application is the U.S. national phase, under 35 U.S.C. 371, of PCT/EP2009/063877, filed Oct. 22, 2009; published as WO2010/081569 A1 on Jul. 22, 2010; and claiming priority to DE 10 2009 000 217.0, filed Jan. 14, 2009, to DE 10 2009 000 332.0, filed Jan. 20, 2009, to DE 10 2009 001 578.1, filed Mar. 16, 2009, and to DE 10 2009 045 402.0, filed Oct. 6, 2009; the disclosures of which are expressly incorporated herein by reference.

FIELD OF THE INVENTION

The invention relates to a method for providing printing formes at installation positions on one of a plurality of forme cylinders disposed in a printing press. A plurality of these printing formes are provided spatially separated from the printing press and at the end of at least one plate line. Each such plate line includes at least one plate exposure device.

BACKGROUND OF THE INVENTION

DE 20 2007 011 576 U1 describes a device for providing a plurality of different print-ready printing formes, required for printing one or more printed products, particularly printing plates for printing presses, which have a production line that comprises at least one device for exposing, engraving and/or coating a printing forme blank, optionally at least one device for stamping and/or bending the printing formes, and a device for providing the finished printing formes for installation in the printing press, wherein the device has at least one temporary storage area for printing formes, in which fully or partially finished printing formes can be automatically placed in or removed from storage.

From DE 20 2008 012 225 U1, a printing plate storage assembly for an automatic printing plate changing device for a printing unit of a rotary printing press is known, wherein the printing plate storage assembly comprises a printing plate storage device with a first storage part for receiving at least one printing plate to be supplied to the printing unit and a second storage part for receiving at least one printing plate to be removed from the printing unit, wherein the first storage part and the second storage part are embodied as separate elements, each having connecting means, which are positioned such that the printing plate storage assembly can be converted to a transport configuration in which the first and second storage parts are connected to one another, in close proximity to one another, and to an accessible configuration, in which the first and second storage parts are moved away from one another and are separate or separated from one another.

DE 10 2006 032 203 B3 describes a supply device for supplying printing plates to a plate cylinder of a printing couple of a printing press, wherein the supply device has at least one printing plate magazine for at least one printing plate to be mounted on the plate cylinder, which printing plate magazine can be positioned on an assigned plate cylinder in a delivery position, in which the at least one printing plate held in the printing plate magazine can be removed and supplied to the plate cylinder, wherein in the printing plate magazine, at least two printing plates to be installed on the plate cylinder can be arranged in at least two positions or planes situated one on top of the other, and at least two printing plates to be installed can be arranged side by side, viewed in the direction parallel to the axis of the plate cylinder, wherein the printing plate magazine can be removed from the printing couple, in particular, can be carried away by an operator.

From DE 10 2006 032 204 B3, a method for providing at least one printing forme to its installation position on a forme cylinder of a rotary printing press is known, wherein the printing forme imaged with a print motif is transported by a transport device from an imaging station located separately from the rotary printing press to its installation position on the forme cylinder, wherein the printing forme is transported from the imaging station up to its respective installation position on the forme cylinder in a transport module connected to the transport device, wherein the printing forme is installed at its respective installation position on the forme cylinder from the transport module.

From DE 10 2006 061 452 A1, a printing plate cartridge for a printing press is known, which has a plurality of compartments for holding printing plates to be uninstalled during a printing plate change and for holding printing plates to be installed during a printing plate change, wherein the printing plate cartridge is positioned in such a way that it can be swiveled and moved linearly relative to a printing unit of the printing press, and therefore a plurality of printing couples of the printing unit can be serviced in sequence by the printing plate cartridge during a printing plate change.

From DE 10 2005 042 756 A1, a printing couple of a rotary printing press is known, comprising a forme cylinder, a storage device with a first support for a first printing forme and another, second support for a second printing forme, and a conveyor device for conveying the printing formes to the forme cylinder, wherein the supports extend close enough up to the forme cylinder that the first printing forme resting on the first support and the second printing forme resting on the second support can be conveyed in an infeed direction up to the forme cylinder.

From DE 102 20 424 A1, a method for automatically transferring printing plates at a printing plate transfer station is known, wherein a plurality of printing plates are brought to the printing plate transfer station in a scattered sequence, wherein at the printing plate transfer station a receiving unit is provided, which receives the printing plates individually in sequence and transfers them individually in sequence to a magazine unit, delivering the printing plates in said magazine unit, wherein after the magazine unit has been loaded, the printing plates are fixed in place at defined distances from one another, wherein the magazine unit moves from the printing plate transfer station to a printing plate delivery station, in which the magazine unit transfers all of the printing plates, in the arrangement of printing plates present in the magazine, to a printing plate carrier, which moves the printing plates to a predefinable destination.

From DE 44 42 265 A1, a transport system is known, which comprises a first transport means for transporting printing formes from at least one printing forme processing station to printing couples having forme cylinders in a printing press, wherein the first transport means extends in the region of the printing couples, outside of the area of access to the outer surface of the forme cylinders, and a second transport means, which receives the printing formes from the first transport means at a transfer station, and transports the formes to the forme cylinders, wherein the printing couples are accessible to operating personnel, wherein the second transport means runs outside of the area of movement of the operating personnel and has an unloading station in the area of the printing couples, for unloading the printing plates.

From DE 40 03 445 A1, an automatic plate supply and cylinder loading system for a rotary printing press is known, which comprises a handling device for unloading a printing plate from a container and installing the printing plate on a plate cylinder of the printing couple, and for removing a printing plate from a plate cylinder and placing the printing plate in the container, wherein the handling device is guided along a path which extends substantially parallel to the rotational axis of the plate cylinder to be loaded, wherein a cart for transporting a plurality of printing plates up to a printing couple or away from one of said printing couples is provided, and wherein the cart is guided along a path which extends substantially perpendicular to the path of the handling device.

From DE 36 30 876 C2, a control system for controlling the production process of a newspaper printing and shipping system is known, with a plurality of partial controls for respectively controlling the devices provided for newspaper printing and shipping, in which production processing and shipping data are provided by a production process computer unit connected to the partial controls, wherein the production process computer unit interacts with an address label printing/labeling device, among other devices, wherein the production process computer unit is connected to the partial controls, which are linked via a closed loop multiwire data network, and wherein one of the partial controls controls the address label printing/labeling device online via a computer, which generates the address printing data and control data for counters/stackers, and which is connected to the closed loop multiwire data network.

From GB 24 13 530 A, a device for supplying printing formes to a forme cylinder of a printing press is known, wherein in the printing press, a plurality of forme cylinders are arranged vertically, one above the other, wherein a plurality of printing formes are arranged in a shared transport module, wherein the transport module can be moved vertically, wherein the printing plates can be supplied individually and in the correct position from the transport module to the respective forme cylinder.

From EP 1 878 570 A2, a printing unit of a rotary printing press having at least two forme cylinders is known, wherein said forme cylinders are arranged at different levels on the same operating side of the printing unit, and can each be loaded with at least one printing forme, wherein one printing forme magazine is assigned to each of the at least two forme cylinders, wherein in each printing forme magazine, at least one printing forme that can be moved between said printing forme magazine and the assigned forme cylinder can be stored, wherein on the relevant operating side of the printing unit a controlled handling device is provided, with which the printing forme magazines arranged at different levels on the same operating side of the printing unit can be loaded simultaneously with the at least one printing forme each.

From EP 1 435 292 A1, a method for supplying printing formes to a cylinder is known, wherein a loading plan for the printing formes to be supplied to the respective cylinder is stored in a memory, wherein coding on the respective printing formes is compared with the loading plan, and wherein the printing formes are supplied to the cylinder according to the loading plan.

From EP 1 002 646 A1, a device for indicating the installation position of a printing plate in a rotary press is known, wherein a printing forme, identified by its page number, is assigned to an installation position on the rotary press by a linkage with an imposition pattern, and the installation position determined automatically for this printing plate is displayed. Therefore, the installation position cannot be determined from the coding applied to the printing plate.

From WO 2004/085153 A2, a device for storing a packing to be changed on a cylinder of a printing press is known, wherein a plurality of packings are to be arranged on the cylinder, wherein the packing to be changed is stored in a holding device, wherein the holding device has at least one code reader, wherein the code reader detects a feature applied to the packing for the identification thereof, wherein a control unit compares the detected feature with a loading plan for the pending printing process, and checks all the packings stored in the holding device to determine whether the packings are stored in the holding device in the correct sequence for the pending printing process, wherein the control unit generates a message warning of an incorrect installation at least in the event of an inconsistency in the comparison, before the packing is installed on the cylinder.

From DE 103 14 341 B3, a method for operating a system at least for supplying at least one printing forme, stored in a printing forme magazine, to a cylinder is known, wherein a code reader scans a code on the printing forme, wherein errors such as a double loading or an incorrect loading of a print position on the cylinder can be determined from a message sent by the system preferably to a central control console of the printing press.

From U.S. Pat. No. 4,727,807 A, a device for automatically changing printing formes on a cylinder of a printing press is known, wherein a plurality of printing formes are to be arranged on the cylinder, wherein printing formes suspended from a transport system and to be supplied to a printing couple are removed at the printing couple to which they are assigned, and are temporarily stored in a container once a code reader has read a code applied to each printing forme and has confirmed its assignment to the printing couple.

SUMMARY OF THE INVENTION

The problem addressed by the invention is that of devising a method for providing printing formes at installation positions on one of a plurality of forme cylinders disposed in a printing press, which will enable a fully automated supplying of printing formes to the printing press.

The problem is solved according to the invention by the distribution of printing formes, which are assigned to a specific one of the forme cylinders, to a plurality of mobile collecting containers that are provided at the plate line. Different ones of the mobile collecting containers, together with the printing formes arranged in them and assigned to the same forme cylinder, are conveyed to that assigned forme cylinder. At a specific time, a plurality of the mobile collecting containers are provided, side-by-side in the axial direction of the relevant cylinder, and on one operating side of the printing press. Printing formes that are assigned to installation positions arranged side-by-side on the relevant forme cylinder, and in its axial direction, and which were conveyed to the printing cylinder in different mobile collecting containers, are removed from these mobile collecting containers and are provided at the respective installation positions on the relevant forme cylinder.

The advantages to be achieved by the invention consist especially in that the method enables a fully automated supplying of printing formes to the printing press. The transport system used for providing the printing formes at installation positions on one of a plurality of forme cylinders disposed in a printing press is suitable for both single-width printing formes and multiple-width printing formes, for example, configured in panoramic format. The method according to the invention results in a very short set-up time for the printing press. Additional advantages will be detailed in connection with the description in what follows.

For instance, it is advantageous that even printing formes which have been provided with at least one print image at different times can be assembled into sets as required for a planned production run, and more particularly, can be provided in an uninterrupted sequence together to the printing press. This saves an operator, setting up the printing press for a pending production run, time he would otherwise require for sorting printing formes, which in practice, for example, in newspaper printing, are frequently produced in random order, and for combining these to form a complete integral set of printing formes required at a specific one of several possible locations of use, for example, on a specific forme cylinder or on a specific printing forme magazine of the printing press. Thus, a shorter set up time is achieved, thereby improving the efficiency of the printing press. Nevertheless, the full flexibility in the production sequence of the printing formes is retained, which is particularly important for newspaper printing.

In preparation for processing a print order, it is ordinarily necessary to produce a plurality of printing formes for use in a printing press. More particularly, in a print operation for producing a newspaper as the printed product in an offset printing press, a plurality of printing formes are required within a short period of time for use on one of the forme cylinders of the offset printing press. Frequently, to produce the printing formes to be used, plate-type blanks are exposed in a plate exposure device, which is separate from the offset printing press, to create at least one print image, using a corresponding master that is provided to the plate exposure device preferably electronically, in the form of a file, for example, by a computer of a prepress stage, wherein the print image applied to the respective blank is photochemically developed, for example, in a developing unit to form it permanently. The printing formes, each provided with at least one print image, are then preferably bent at two opposite ends in a bending unit to form suspension legs, wherein the respective printing forme can be fastened to the outer surface of the relevant forme cylinder by its suspension legs, which can be inserted into at least one groove formed on the relevant forme cylinder. To assist in aligning the printing forme in the correct position on the outer surface of the relevant forme cylinder, the relevant printing forme can also be equipped with at least one register punch or with one notch or clip, particularly prior to the bending of at least one of its suspension legs. After it has been exposed, developed, bent, and optionally punched and/or clipped, the respective printing forme is ready for use in a production run in the offset printing press.

An offset printing press used for newspaper printing has, for example, a plurality of printing couples arranged in sequence in the direction of transport of the print substrate, for example, a material web, particularly a paper web, to be printed with the respective print image of the printing formes, each printing couple having at least one forme cylinder and one transfer cylinder cooperating with said forme cylinder. These multiple printing couples are used, for example, for executing a multicolor printing process, for example, a four-color printing process. In the case of double-sided printing of the print substrate, which is preferably carried out simultaneously, the number of printing couples required in the printing press is doubled. Each forme cylinder of the printing couples can be loaded, at least in its respective axial direction, with a plurality of printing formes, for example four or six, wherein each of these printing formes is assigned to precisely one axial installation position on the outer surface of said forme cylinder. In its respective circumferential direction, each of these forme cylinders can also be loaded at specific axial positions with a plurality of printing formes, for example two or three, and therefore, said forme cylinder has a plurality of installation positions, one in front of the other in the circumferential direction, each for one of the printing formes. The outer surface of the forme cylinder thus has a total, for example, of eight, twelve, or more installation positions, each for one printing forme. Therefore, in an offset printing press having eight printing couples, for example, each of which has, for example, precisely one forme cylinder, with, for example, twelve installation positions, each for one printing forme, a total of 96 printing formes are to be arranged when all installation positions are in use. However, the number of printing formes required for executing a specific print order is increased in most cases because, specifically in newspaper printing, rather than using a single printing unit having, for example, eight printing couples, a plurality of such printing units, combined to form a complex printing system, are used, with each printing unit having, for example, eight printing couples. The essentially sequential production of such a large number of printing formes ready for use for the intended production run requires a considerable amount of time before the relevant printing formes are ready to be arranged on the outer surface of the relevant forme cylinder. For economic reasons, however, simply increasing the number of plate exposure devices, etc., which can be used in parallel, i.e., simultaneously, for example, is not a feasible solution.

To facilitate the assignment of the printing formes produced in the plate exposure device, etc., to their respective arrangement on the outer surface of one of the forme cylinders of the offset printing press to be set up for a specific production run, each of the printing formes relevant to a specific production run, for example, is preferably provided in the plate exposure device with a code, wherein this code is preferably formed in a non-printed region of the relevant printing forme. For example, the respective code is located on one of the suspension legs to be formed on the relevant printing forme. The code can be embodied, for example, in the form of a machine readable, particularly two-dimensional data matrix code (2D code), or alternatively or additionally in a form of plain text that can be read by humans. In particular, the information contained in the code provides information about in which printing couple of the offset printing press, on which forme cylinder, and at which installation position the relevant printing forme is to be arranged for the purpose of executing the pending print order. Moreover, the information contained in the code can contain indications about the printed product itself or about a page number relating to the relevant printed product, along with additional information such as, for example, the production date of the relevant printing forme. The code is applied, for example, in the plate exposure device, in the same process step in which the print image is applied to the relevant printing forme.

The production of the printing formes relating to a specific production run is preferably controlled on the basis of data provided, for example, by a control unit of a production planning system, wherein the control unit of the production planning system is connected to the plate exposure device, for example, via an electronic cable-connected or wireless communications system, and is preferably also connected at least to a control console belonging to the offset printing press, for the purpose of data exchange. The data provided by the control unit of the production planning system, also called production data, identify the printed product to be produced in terms of at least one, preferably several, of its characteristics, such as, for example, its number of pages, and also provide information about the number of copies of said printed product that are to be produced in a specific production run. The production data assigned to a specific production run can also contain information about the print substrate that will be used, for example, the type of paper and/or its base weight, and about the printing press that will be used, for example, information about the diameter of the forme cylinders and/or the transfer cylinders, about the loading configuration of printing formes on the forme cylinder involved in executing the pending print order, i.e., which printing forme is to be disposed at which installation position on the relevant forme cylinder, about a production speed to be run on the printing press, about the planned start of production, and/or about the mode of production of a folder situated downstream of the printing process, for example, whether said folder will be used in collect production or straight run production. Based upon the production data supplied to the plate exposure device, the printing formes required for a specific production run are produced at the proper time, and are supplied to the relevant forme cylinder on the basis of their respective codes.

The printing formes required for a specific production run are supplied to the printing press, for example, in a mobile collecting container, in which the printing formes required on a specific forme cylinder are preferably stored as a set, i.e., as a complete, integral unit of printing formes to be transported together to the relevant forme cylinder. In practice, a plurality of at least similar mobile collecting containers are available at the production line where ready-to-use printing formes are produced. Alternatively, the printing formes grouped into sets can also be transported manually to their respective locations of use in the printing press. The printing formes, which are preferably transported in one of the collecting containers to the relevant forme cylinder, are supplied to the relevant forme cylinder manually by an operator, or are preferably supplied to their respective installation positions on the relevant forme cylinder and positioned there automatically by means of a controllable conveyor device.

Because flexibility in creating the master for producing the printing forme would be unduly restricted if the printing formes required for a specific forme cylinder had necessarily to be produced in an uninterrupted sequence in order to be supplied logically to their respective locations of use in the printing press, and ultimately also to their respective installation positions on the relevant forme cylinder, it is advantageous to expand the device required for producing ready-to-use printing formes, which device comprises, for example, at least one plate exposure device, at least one developing unit, and at least one bending unit, and is referred to, for example, as a plate line, by adding to it at least one storage device, in which printing formes, each provided with at least one print image, can be temporarily stored until an entire integral set of printing formes has been produced for transport together to a specific forme cylinder. A check for completeness of the printing formes belonging to a specific set is carried out, for example, on the basis of the data provided by the control unit of the production planning system.

The storage device is situated downstream of the plate exposure device in the production line for producing the printing formes, and, for example, upstream of the bending unit, because flat printing formes that have not yet been bent can be stored in less space, and because the risk of mutual damage, for example, scratching of a print image by a suspension leg, for example, is avoided. Alternatively, however, the storage device can also be situated downstream of the bending unit in the production line, particularly if the goal is to achieve a rapid removal from storage, and if a savings of space achieved by storing unbent, flat printing formes has a lower priority in the embodiment of the storage device than the speed with which printing formes stored in the storage device can be unloaded from said device. This is because the bending process implemented by the bending unit requires significantly more time than processes, particularly transport processes, combined with the unloading of printing formes stored in the storage device.

Moreover, the storage device is preferably embodied in such a way that printing formes can be stored in it and unloaded from it simultaneously, i.e., at least one of the printing formes can be placed in storage in the storage device, while at the same time another of the printing formes is unloaded from said device. The storage device has at least as many storage spaces as the number of printing formes belonging to a single set of printing formes. The number of printing formes belonging to a single set need not be identical to the maximum number of installation positions on the forme cylinder involved in the pending production run. Rather, the relevant set of printing formes comprises the same number of printing formes as are to be changed and/or installed, in the same operating step, on the forme cylinder involved in the pending production run. The storage device is preferably equipped with enough storage spaces to accommodate a plurality of sets of printing formes, for example, all the sets of printing formes that can be used in the relevant printing press. In one preferred embodiment, for example, the storage device is equipped with several hundred, for example, four hundred or more, storage spaces for printing formes. Each of the storage spaces of the storage device can be addressed individually, and the loading of each individual storage space with one printing forme is registered by at least one sensor per space. Thus the storage device preferably has an electronic control unit, which monitors or controls the loading and unloading processes, along with the assignment of printing formes to the storage spaces of the storage device, and stores information about the loading of the individual storage spaces. Printing formes belonging to different sets and stored in the storage device are preferably unloaded in uninterrupted sequence as an integral set of printing formes, regardless of whether said printing formes have been presorted in the storage device into integral sets of printing formes, or have been simply stored in storage spaces in the storage device in a chaotic, i.e., random arrangement. If the printing formes stored in the storage device are not unloaded in sets, then a sorting station which sorts the printing formes according to their required sets, for example, immediately after the printing formes have been unloaded from the storage device, is provided. The sorting station, embodied as a revolving carousel, for example, or the storage device, groups the printing formes, which are supplied to it automatically, for example, into integral sets on the basis of the coding which is preferably applied to each of said printing formes, which sets are in turn to be supplied in the same operating step to the relevant forme cylinder, particularly via a mobile collecting container. Alternatively, the sorting station, which sorts printing formes into ready-to-use sets, is disposed downstream of the bending unit in the production line, wherein said sorting station either delivers the printing formes that have been grouped into ready-to-use sets, for example, to one of several mobile collecting containers that stand waiting at the sorting station, or uses this plurality of mobile collecting containers standing waiting at the sorting station to sort printing formes into ready-to-use sets. In a further advantageous embodiment, the storage device and the sorting station are each embodied as integrated into the mobile collecting container.

To assist, for example, with the correct loading of the installation positions on the relevant forme cylinder to be used in a pending production run, a display device can be provided, for example, which at least displays, for example, visually, particularly graphically, preferably using at least one symbol, in an overall display showing the multiple installation positions simultaneously, at which of said multiple installation positions on the relevant forme cylinder or at which of a plurality of storage positions in a printing forme magazine which conveys printing formes to the relevant forme cylinder, one of the printing formes that has been produced or at least will be produced, for example, is to be arranged.

More particularly, the display of the display device can also be used to display different conditions and/or properties relating to at least one of the printing formes that has been produced or at least will be produced, for example, a) to which installation position on the relevant forme cylinder or to which storage position in the printing forme magazine an already produced, i.e., ready-to-use, printing forme is assigned, b) to which installation position on the relevant forme cylinder or to which storage position in the printing forme magazine a printing forme that is currently in its production process, i.e., in the feed line, is assigned, c) at which installation position on the relevant forme cylinder or at which storage position in the printing forme magazine a printing forme is to be installed for the planned new production run, d) which installation position on the relevant forme cylinder or which storage position in the printing forme magazine will not be loaded with a printing forme during the pending production run, because in the pending production run, for example, a print substrate having a print substrate width that does not utilize the full printing width of the relevant forme cylinder will be used, or e) at which installation position on the relevant forme cylinder or at which storage position in the printing forme magazine a non-printing printing forme, i.e., a so-called dummy plate, will be disposed. The display device can take the information necessary for its respective display, for example, from the data provided by the control unit of the production planning system, preferably comparing said data with the data collected during production of the printing formes prepared for the pending production run. The display device is positioned, for example, in the region of the location at which the mobile collecting container receives the printing formes relating to a specific forme cylinder, prior to the transport of these formes to the relevant forme cylinder. The display device can also be used to display the current status of the printing formes to be produced for a specific production run, i.e., to display whether a specific printing forme is currently located, for example, in the plate exposure device, the developing unit, the bending unit, or the storage device, and therefore the display of the display device particularly indicates to an operator of the printing press whether or not a set of printing formes required for a specific forme cylinder is complete. The display device can also display for which printing unit, preferably comprising multiple forme cylinders, in a complex printing system, i.e., a system comprising multiple printing units, at least one set of printing formes is already complete, and/or which of the multiple sets of printing formes to be arranged in a specific one of the printing units has already been produced and is ready for use.

To further assist, for example, in the correct loading of the installation positions to be used in a pending production run on the relevant forme cylinder having a plurality of installation positions, each for one printing forme, an information field can be provided, for example, on at least one, but preferably on multiple, more particularly on each of the printing formes to be arranged on this relevant forme cylinder, which information field contains information about the loading of the relevant forme cylinder in at least one installation position adjacent to its own planned installation position. For instance, the information field, which is applied, for example, by the plate exposure device, preferably in a non-printing area, particularly on the suspension leg of the relevant printing forme, can indicate a) at which installation position on the relevant forme cylinder or at which storage position in the printing forme magazine the printing forme containing said information field is to be arranged, b) at which other installation position on the relevant forme cylinder or at which other storage position in the printing forme magazine for storing said printing forme an additional printing forme currently to be produced is to be arranged, c) at which installation position on the relevant forme cylinder or at which storage position in the printing forme magazine for storing said printing forme no new printing forme is currently to be installed, i.e., for the pending production run, and instead, the printing forme already present will be left in place, d) which installation position on the relevant forme cylinder or which storage position in the printing forme magazine for storing this printing forme will not be loaded with a printing forme for the pending production run, because in the pending production run, for example, a print substrate having a print substrate width that does not utilize the full printing width of the relevant forme cylinder will be used, or e) at which installation position on the relevant forme cylinder or at which storage position in the printing forme magazine for storing said printing forme a non-printing printing forme, i.e., a so-called dummy plate, will be arranged. The information about the loading of the relevant forme cylinder or the relevant storage positions of the printing forme magazine can preferably be provided graphically in the information field, for example, using at least one symbol. The information provided in the respective information field is taken, for example, from the data provided by the control unit of the production planning system. Alternatively or additionally, the information provided in the respective information field can result from a comparison of said data with the data collected during the production of the printing formes provided for the pending production run.

BRIEF DESCRIPTION OF THE DRAWINGS

Embodiment examples of the invention are illustrated in the set of drawings, and will be specified in greater detail in what follows.

The drawings show.

DESCRIPTION OF THE PREFERRED EMBODIMENTS

Figure 44:
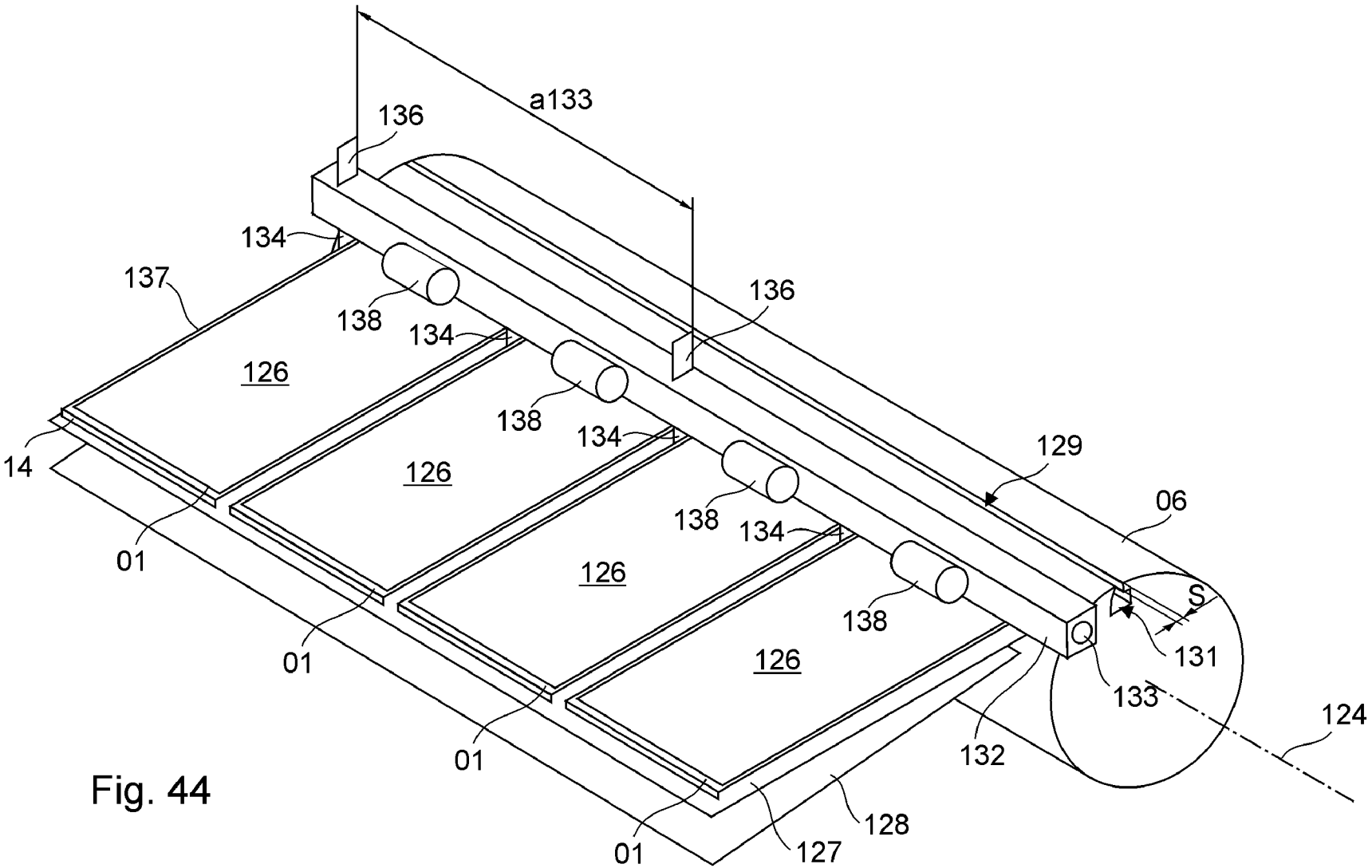
FIG. 44 a register device interacting with a forme cylinder.

A printing forme 01 (FIG. 1), which is embodied as plate shaped, made of a metallic material, for example, has an essentially rectangular surface having a length L and a width B, wherein the length L can measure between 400 mm and 1300 mm, for example, and the width B can measure between 280 mm and 1500 mm, for example. Preferred measurements of the length L lie between 360 mm and 600 mm, for example, and preferred measurements of the width B lie between 250 mm and 430 mm, for example. The surface has a contact side, the contact surface 02, with which the printing forme 01 rests positioned on an outer surface of a printing couple cylinder 06, more particularly, forme cylinder 06. The reverse side of the contact surface 02 is a working surface of the printing forme 01, wherein said working surface is equipped with at least one print image 126, or at least can be equipped with one print image 126 (FIG. 44). The printing forme 01 is preferably equipped at each of two opposite ends 03; 04 with a bent suspension leg 13; 14, wherein the bending lines 11; 12 at which the suspension legs 13; 14 are bent, respectively, form the boundaries of the contact surface 02, wherein each of the suspension legs 13; 14 extends preferably entirely or at least partially across the width B of the printing forme 01. The contact surface 02 of the printing forme 01 is flexible at least along its length L, and when the printing forme 01 is arranged on the outer surface 07 of the forme cylinder 06, its curvature can be adjusted thereto. When the printing forme 01 is arranged on the outer surface, the length L of the contact surface 02 thus extends in the direction of the circumference of the forme cylinder 06, whereas the width B of the contact surface 02 extends in the axial direction of the forme cylinder 06. The printing forme 01 can be suitable either for a printing process that uses a dampening agent, for example, a wet offset printing process, or for a waterless printing process, for example, a dry offset printing process.

One end 03 of the printing forme 01, oriented in a direction of production of the forme cylinder 06, is called its leading end 03, whereas the opposite end 04 is the trailing end 04 of the printing forme 01. At least the ends 03; 04 of the printing forme 01 on which the suspension legs 13; 14 are formed are made of a rigid, for example, metallic material, for example, an aluminum alloy. If the printing forme 01 will be used in a dry offset printing process, the printing forme 01 can also be made of a plastic or even of a rigid paper. The material thickness D in the region of the working surface of the printing forme 01, but at least the material thickness D of the suspension legs 13; 14, is usually a few tenths of a millimeter, for example, between 0.2 mm and 0.4 mm, preferably 0.3 mm. Thus the printing forme 01 is made entirely, or at least at its ends 03; 04, of a rigid material, and therefore the ends 03; 04 can be permanently reshaped against a material-specific resistance by bending them. Therefore, once at least the working surface has been imaged with at least one print image 126, for example, in an exposure device, one bent suspension leg 13; 14 can preferably be produced at least at one end 03; 04, respectively, of the printing forme 01, but preferably at both of its ends 03; 04, along the respective bending line 11; 12, for example, in a bending unit, wherein the suspension legs 13; 14 produced in this manner can be inserted into a narrow, especially slit-shaped opening 129 in a groove 131 in the forme cylinder 06 (FIG. 44), and secured there by means of a securing device, for example, a clamping device.

For example, referred to the length L of the uncurved, flat contact surface 02 of the uninstalled printing forme 01, one suspension leg 13 is bent along the bending line 11 at the end 03, about an opening angle $\alpha$, and/or one suspension leg 14 is bent along the bending line 12 at the opposite end 04, about an opening angle $\beta$ (FIG. 1), wherein the opening angles $\alpha$; $\beta$ generally lie between 30° and 140°. If the opening angle $\alpha$ is assigned to the leading end 03 of the printing forme 01, it is preferably embodied as acute, and particularly measures 45°. The opening angle $\beta$ at the trailing end 04 of the printing forme 01 is frequently preferably embodied as larger than 80° or as obtuse, especially measuring 85° or 135°. The bent suspension leg 13 at the leading end 03 has a length l13, which ranges from 4 mm to 30 mm, for example, particularly from 4 mm to 15 mm. The bent suspension leg 14 at the trailing end 04 has a length l14, which measures 4 mm to 30 mm, for example, particularly between 8 mm and 12 mm, wherein the shorter length is preferable for ensuring the easiest possible removal of the suspension legs 13; 14 from the opening 129 in the groove 131.

A plurality of such printing formes 01 are used, for example, in a multicolor offset printing press which operates using a wet offset printing process or a dry offset printing process. In one preferred variant, at least one printing unit 44 in the printing press, which preferably comprises a plurality of printing units 44, is equipped with printing forme magazines 09, as is illustrated by way of example in FIG. 2, wherein precisely one printing forme magazine 09 is assigned to each forme cylinder 06. Each printing forme magazine 09 has a plurality of storage positions, for example, at least as many as the number of installation positions provided on the assigned forme cylinder 06. For example, a plurality of storage positions are arranged side by side in the printing forme magazine 09, in the axial direction of the assigned forme cylinder 06. In the printing forme magazine 09, a plurality of storage positions can also be arranged vertically, one above the other, for example, assigned to a specific axial installation position on the forme cylinder 06. The printing forme magazine 09 is also called a plate changer.

Each printing forme magazine 09, for example, in conjunction with a conveyor device 80 (FIG. 24), which is linearly displaceable, for example, conveys at least one printing forme 01 stored in the relevant printing forme magazine 09 to one of the forme cylinders 06 of said printing unit 44. The printing unit 44 illustrated in FIG. 2 has a plurality of printing couples disposed in at least one frame 16 on a base 17, which printing couples are preferably arranged one above the other, in a bridge construction, or in a compact eight-couple construction, i.e., in a configuration having a low structural height, with eight print positions. Each printing couple also has at least one inking unit 08, in addition to its forme cylinder 06, and an additional printing couple cylinder 07, more particularly, a transfer cylinder 07 which interacts with said forme cylinder 06.

Figure 2:
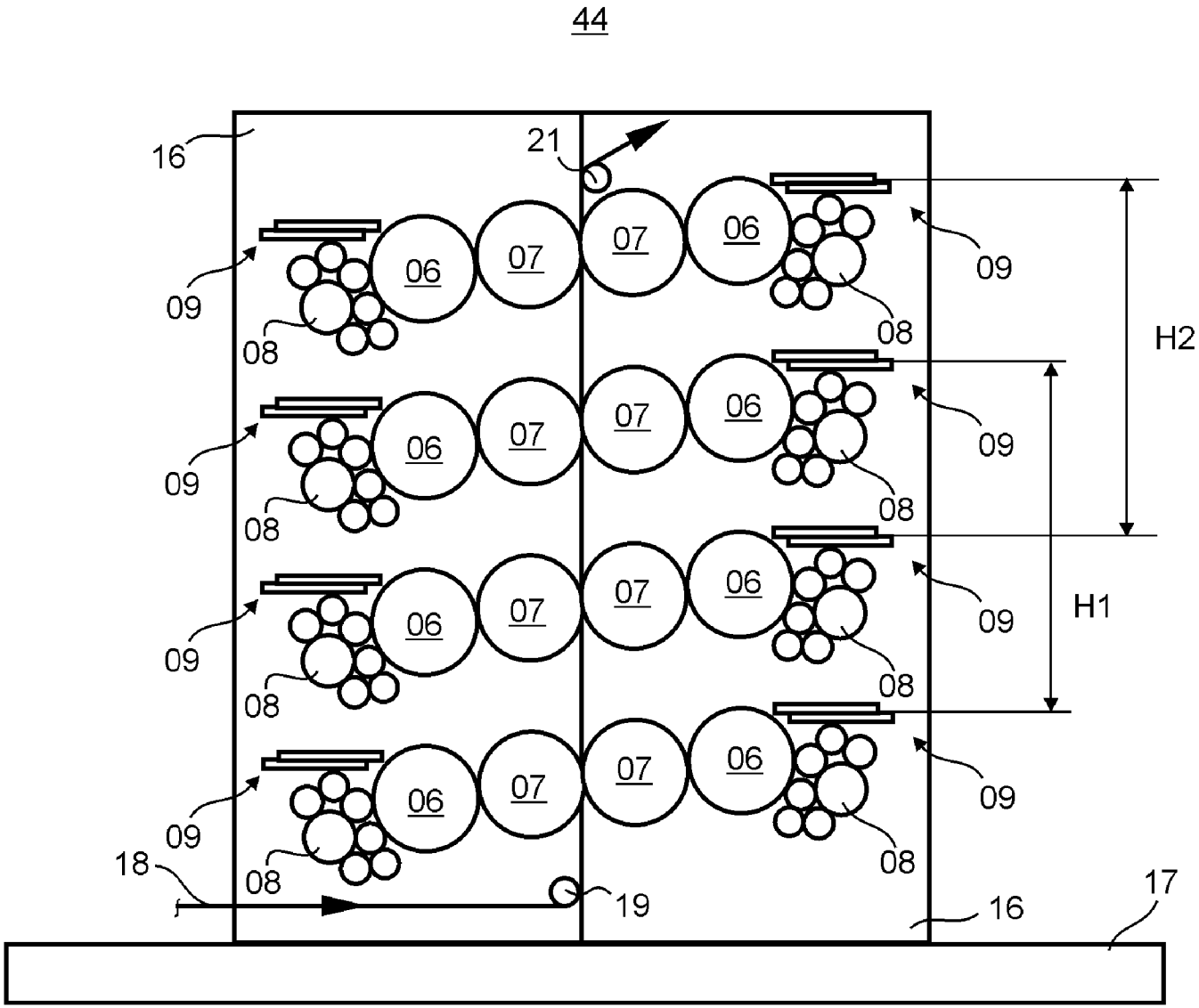
FIG. 2 a printing unit of a printing press having printing forme magazines.
Figure 7:
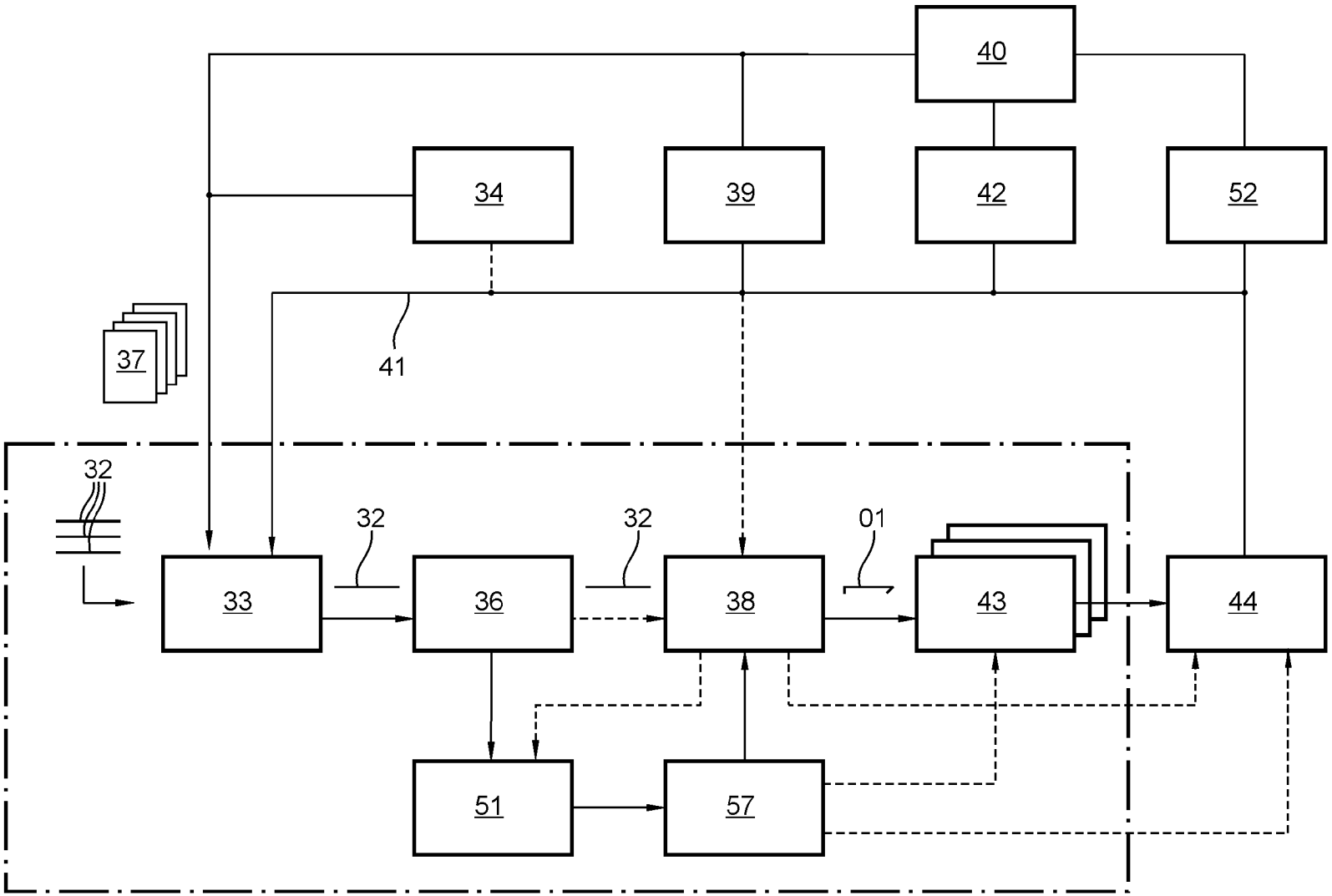
FIG. 7 a block diagram illustrating process steps for producing printing formes.

A print substrate 18, preferably a material web 18, more particularly, a paper web 18, is supplied continuously to the printing press during the production run therein, and in the example depicted in FIG. 2 is guided vertically between the printing couples. FIG. 2 shows four printing couples arranged in sequence in the direction of transport of the paper web 18, by way of example, which printing couples to the right and the left of the paper web 18 each comprise one of the transfer cylinders 07, each with one forme cylinder 06, wherein the transfer cylinders 07, which are opposite one another at the paper web 18 in a printing couple, roll against one another. The paper web 18 is fed to the first printing couple, for example, via a first paper guide roller 19 arranged upstream of the first printing couple, and is drawn away from the fourth printing couple by means of a second paper guide roller 21 arranged downstream of the fourth printing couple. At least one inking unit 08 is assigned to each forme cylinder 06. A printing forme magazine 09 is assigned to each forme cylinder 06, each magazine preferably having two chutes, wherein each printing forme magazine 09, but at least its respective at least one storage position for at least one printing forme 01 to be stored therein, is preferably aligned in its operating position substantially horizontally or with only a slight inclination of less than 20°, particularly less than 15°, from the forme cylinder 06. In the operating position of each printing forme magazine 09, at least one printing forme 01 can be exchanged between the chutes of said magazine and the forme cylinder 06, wherein either a printing forme 01 that is no longer required for executing a print order is removed from the relevant forme cylinder 06 and inserted into the respective chute, or a new printing forme 01 for executing the print order is removed from the relevant chute and installed on the forme cylinder 06. It is advantageous for the implementation, particularly the completion, of a printing forme change to be monitored by sensors. Likewise, the printing forme magazines 09 in conjunction with the forme cylinders 06 can be controlled in such a way that a printing forme change can be selectively initiated, preferably from a control console 42 assigned to the printing press (FIG. 7). Because the printing forme magazines 09 can be prepared for a printing forme change and therefore for a subsequent new production run during an ongoing production run in the printing press, the setup time that requires the printing couples to be offline can be decreased to an extremely short period of less than two minutes, for example, preferably less than ninety seconds, for a complete change of all printing formes 01 of the printing couples disposed in said printing unit 44. Depending upon the embodiment of the printing couples, ninety-six printing formes 01, for example, can be used simultaneously in the described printing unit 44. A rapid printing forme change of this type, even with a larger number of printing formes 01, increases the efficiency of the printing press due to its extremely short offline time.

For identification of the respective printing formes 01, said formes are equipped with a code, wherein the code can preferably be embodied as a barcode, for example, in addition to an embodiment that can be read by humans. A barcode is a machine-readable printed code comprised of bars and gaps of various widths. The code can be applied via a printing process, for example, an offset printing process, a flexographic printing process, an intaglio printing process, a laser printing process, a thermosetting printing process, or an inkjet printing process, preferably on a non-printed region of the printing forme 01, for example, on one of the suspension legs 13; 14. However, it is particularly advantageous to apply the code to the printing forme 01 in conjunction with the exposure thereof, because then no additional operational step is necessary. In this case, the code is produced and located on a suspension leg 13; 14 of the printing forme 01, for example, before said suspension leg 13; 14 is formed in a bending process carried out in a bending unit 38 (FIG. 7).

There are different types of barcodes. Although barcodes always contain a flat arrangement of symbols, they are differentiated as one-dimensional (1-D codes), two-dimensional (2-D codes), and three-dimensional (3-D codes) barcodes, wherein in the latter codes, color forms the third dimension. Barcodes are most often standardized in terms of their graphic representation and their informational content, for example, in ISO/IEC 15415 (2-D codes), ISO/IEC 15416 (1-D codes), ISO/IEC 15418 (data structures) or ISO/IEC 15420. Known 1-D codes include, for example, the alphanumeric code 39 according to ISO/IEC 16388, code 128 according to ISO/IEC 15417, and the purely numeric code interleaved ⅖ according to ISO/IEC 16390. A 2-D code, which also encodes information perpendicular to its main direction, is a matrix code, for example, a data matrix code, which is defined according to ISO/IEC 16022. Matrix codes can be read omnidirectionally using a camera system, for example, a CCD camera. A Reed Solomon error correction doubles the data, wherein approximately 25% of the code can be destroyed without impairing decoding. Additional matrix codes include QR codes and Aztec codes, for example.

Figure 3:
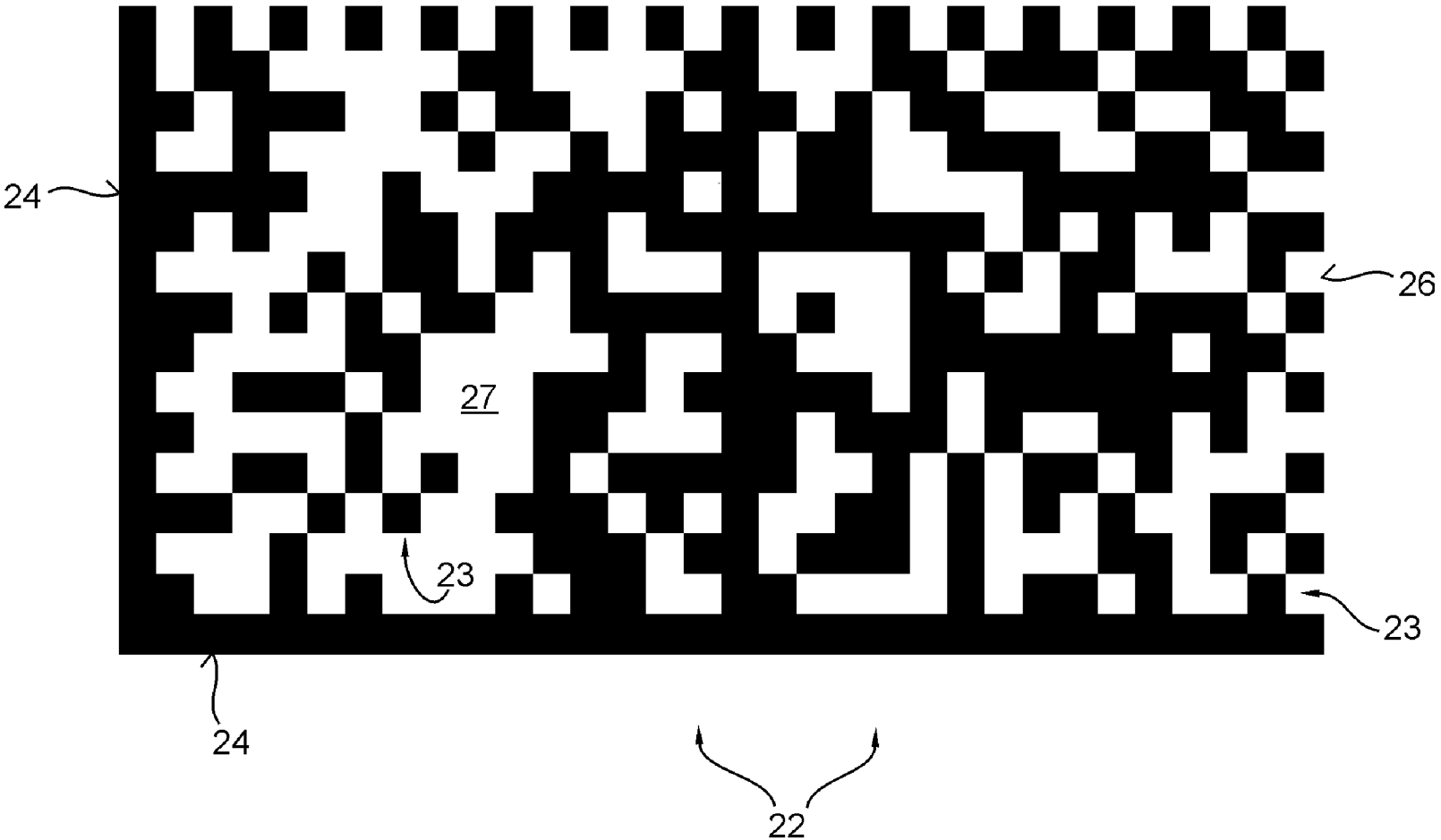
FIG. 3 a data matrix code.

Various versions of the data matrix code exist, for example, the ECC 200 data matrix code version, in which the letters ECC stand for the English expression "Error Checking and Correction Algorithm" and the number following these letters indicates a specific development stage of the data matrix code. The data matrix code consists of a rectangular area, the size of which is variable. This area contains square structural elements, each of which has a binary value; these elements are embodied, for example, as black or white. One example of a data matrix code is depicted in FIG. 3, in which two square data matrix code areas 22, each containing square structural elements 23, are arranged side by side, for example. For some applications, additional data matrix code areas 22 can be joined with one another to form the code, wherein the data matrix code areas 22 can be arranged both side by side and below and/or above one another, for example, in an arrangement comprising multiple rows and columns.

In the case of a 1-D code, different bar thicknesses must be clearly identified within a symbol plane. In contrast, in the data matrix code it is important only to determine the value of each square structural element 23 shown in the symbol plane, for example, whether it is embodied as black or white. A data matrix code also requires significantly less space than a 1-D code, while containing the same amount of information. For scanning a 2-D code, a camera system is always required, which records the information two-dimensionally and evaluates the recorded image, for example, by means of pattern recognition, for example, by comparing the detected code pattern or marking pattern with a stored target pattern. The camera system then converts the recorded structural elements 23 of the 2-D code to electronic, preferably digital, usable information. Because a camera system is used, 2-D codes must be illuminated on their surface by an illuminating device having at least one light source. The light reflected from the 2-D code is then imaged on an imaging plane of an image sensor, for example, a CCD sensor or CMOS sensor, wherein the image sensor is a component of a line camera or surface camera, for example. In general, data matrix codes have few requirements in terms of color contrast and print quality. The light emitted by the light source of the illuminating device and the spectral sensitivity of the image sensor are matched to the optical properties of the printing forme 01 that bears the 2-D code, particularly to the reflective behavior and diffusive behavior thereof. For scanning a 2-D code applied to a printing forme 01 by exposing said forme, a laser diode or a light-emitting diode that emits white, yellow, or green light has proven advantageous as the light source for the illuminating device. The light source can be arranged integrated, for example, into a code reader 28 (FIG. 5) having an image sensor. The code reader 28 is advantageously embodied as comprising an adjustable parameter automatic exposure device. The image sensor and the light source of the illuminating device are arranged with their respective operating directions at an angle of inclination of at least 5° referred to a vertical line projecting from the symbol plane on the respective code area 22, preferably at an angle of inclination ranging from 10° to 60°. To protect against ink mist and other contaminants, which occur primarily in a printing couple, the code reader 28 should be mounted at a minimum distance a28 of 10 mm, for example, from the code area 22, wherein its image sensor and light source are protected against soiling, for example, by a mineral glass or acrylic glass pane.

The data matrix code comprises the following four main components: A fixed boundary line 24 serves for pattern recognition and is used for calculating the rotational position of the data matrix code, so that any reading angle is possible. A boundary line 26 opposite the fixed boundary line 24, which forms an open boundary, is used for identifying the number of rows and columns, i.e., the so-called matrix density. In the case of ECC 200, the element in the upper right corner is always white. The boundary lines 24; 26 delimit and encompass a memory area 27, wherein the memory area 27 contains the actual binary information in encoded form. Therefore, the amount of possible information is also defined by the size and/or number of individual structural elements 23. An empty zone referred to as a quiet zone surrounds the data matrix code. It does not contain any information, and is not used for positional orientation. The quiet zone is one field or row in width, and is required for delimiting this code from other optical image elements.

The memory area 27 of the code contains information, for example, which can be used to distinguish printing formes 01 from one another for the purpose of their identification, and/or can be used to track the use of an individual, specific printing forme 01. Therefore, printing formes 01 that bear different print images 126 and/or that belong to different color segments have codes that are different from one another. The code can contain an index generated by a counter, for example, to allow the continuous counting of printing formes 01 used in sequence or to be used in sequence, and to allow identification of the respective sequence of said printing formes 01, particularly printing formes that are of the same type and/or are used in sequence at the same installation position of a specific forme cylinder 06. The code can contain information about the respective installation position of the printing forme 01 in the printing press.

One alternative to the embodiment of the code as a barcode consists in using a transponder system, particularly radio tags, which are referred to according to their English abbreviation as RFID. Radio tags transmit their information in a contactless manner by means of an electromagnetic field. Another alternative embodiment of the code can consist of punched markings, for example, punched holes.

Figure 4:
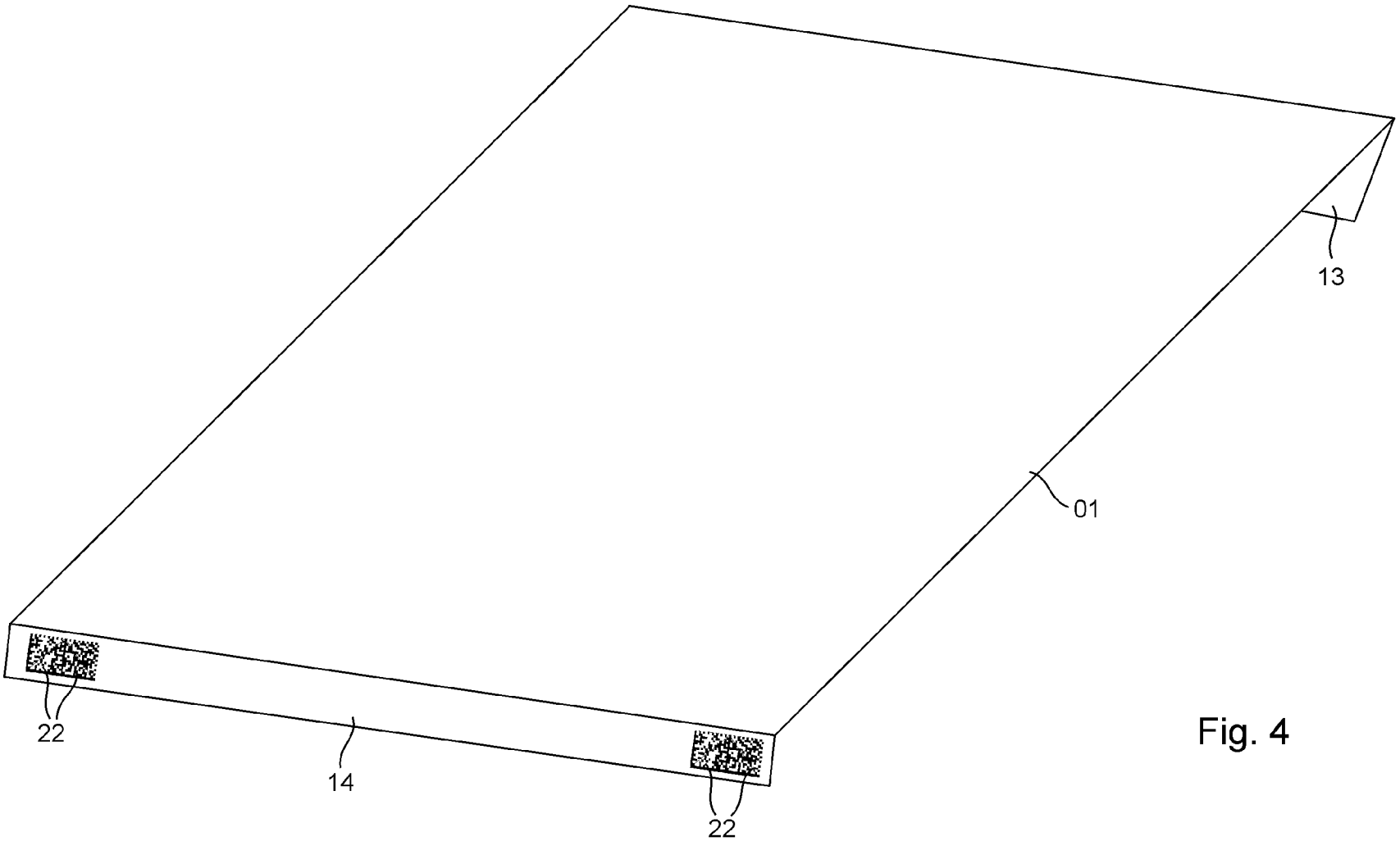
FIG. 4 a code applied to a printing forme.

FIG. 4 shows a printing forme 01, on the trailing suspension leg 14 of which two codes are applied, spaced from one another across the width B of the printing forme 01 (FIG. 1), specifically, for example, two data matrix code areas 22 arranged in a row across the width B of the printing forme 01, each in the side region of the suspension leg 14. Alternatively or in addition to this arrangement of codes on the trailing suspension leg 14 of a printing forme 01, a code can also be applied to the center region of the suspension leg 14 of a printing forme 01, particularly a printing forme 01 in panoramic format. Each data matrix code area 22 can contain only a certain amount of information. Depending upon the amount of information to be contained in the code, two or more data matrix code areas 22 are required, and are preferably applied to the trailing suspension leg 14 of the printing forme 01.

Figure 5:
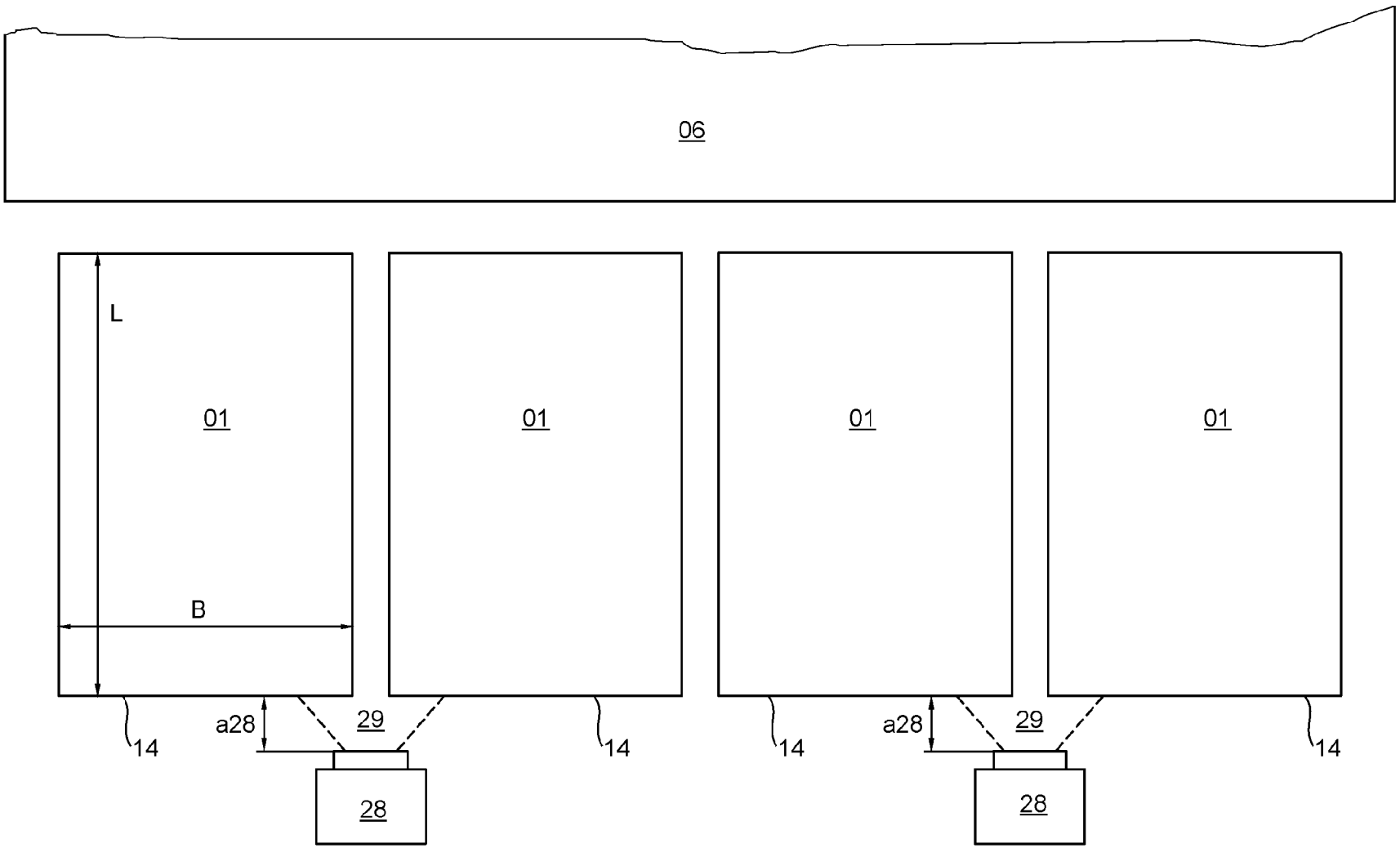
FIG. 5 a plan view of a plurality of printing formes arranged side by side, with code readers assigned to them in pairs.
Figure 6:
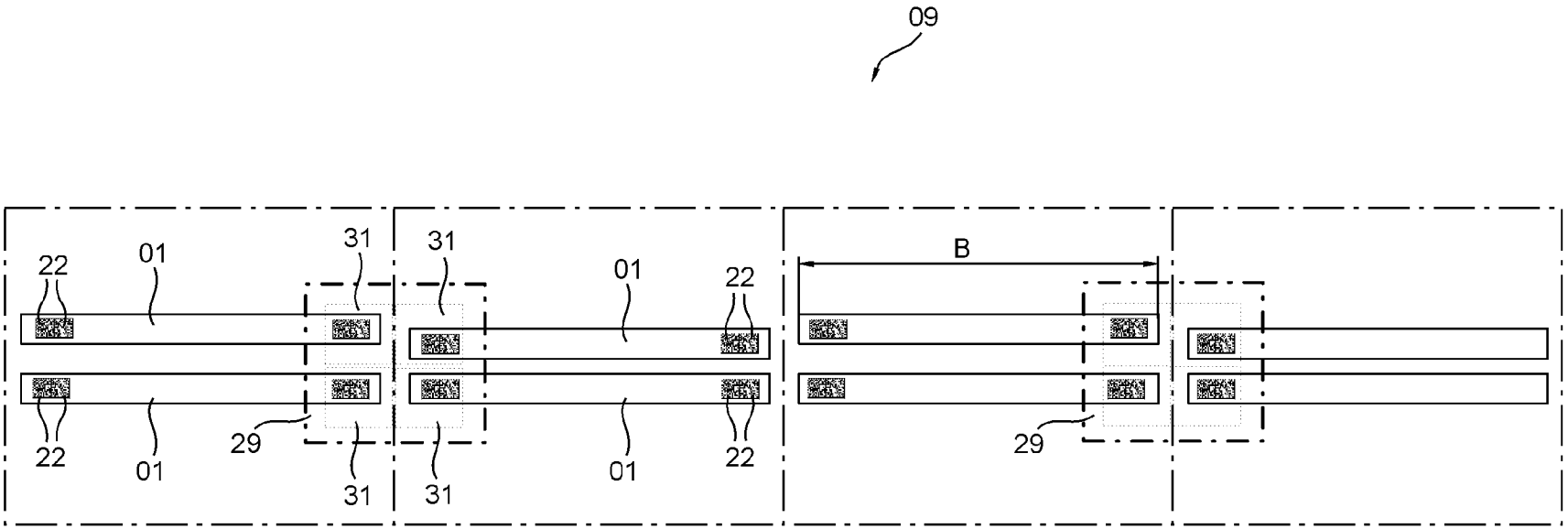
FIG. 6 an arrangement of printing formes, each with at least one code applied to its respectively trailing suspension leg.

By using only a single code reader 28 for a plurality of stored printing formes 01, wherein said reader scans, particularly simultaneously, the respective codes of printing formes 01 stored in different storage positions, a considerable cost savings can be realized. FIGS. 5 and 6 provide an example of this, with an arrangement of four printing formes 01, for example, arranged, or at least arrangeable, side by side on the outer surface of the forme cylinder 06, each printing forme having a length L and a width B (FIG. 1), wherein a shared code reader 28 is assigned to every two adjacent printing formes 01. Each code reader 28 is embodied as or integrated into a camera system, for example, wherein each of said camera systems has a CCD sensor as its image sensor, for example, wherein at least one printing forme 01, but preferably at least two printing formes 01, are arranged in the scanning region 29 of each CCD sensor, and therefore the code reader 28 is able to simultaneously scan at least one, but preferably all codes located in its scanning region 29, in that the image sensor simultaneously images the code or codes scanned in the scanning region 29 of the code reader 28 at the same time in the same image plane.

In the example shown in FIG. 5, each CCD sensor is directed toward the trailing suspension legs 14 of the printing formes 01 arranged in its respective scanning region 29. The scanning region 29 of each CCD sensor can be widened by an optical device, for example, by a wide-angle lens, and can have a preferably obtuse opening angle, particularly across the width B of the printing formes 01, allowing it to capture a plurality of codes, particularly the respective codes of a plurality of different printing formes 01, in the same scanning region 29, and thereby scan them simultaneously. The CCD sensor of each respective camera system is arranged at a distance a28 from the trailing suspension leg 14 of the printing formes 01 located in the respective scanning region 29, wherein said distance a28 measures at least 10 mm, for example. The scanning region 29 of each image sensor in FIG. 6 is represented by a rectangular field, for example, encompassed by a dotted-dashed line, wherein said field always lies in the same plane as the data matrix code areas 22 applied to the trailing suspension leg 14 of the printing formes 01, and is also aligned parallel to the respective boundary lines 24; 26 of the data matrix code areas 22, for example.

FIG. 6 shows an arrangement of printing formes 01 stored, for example, in one of the printing forme magazines 09 of the printing unit 44 shown in FIG. 2, wherein at least one code is applied to the trailing suspension leg 14 of each of said printing formes 01. In each case, the code is embodied, for example, in the form of two data matrix code areas 22 arranged in a row lengthwise across the width B of the respective printing forme 01, each area being arranged, for example, in the respective side region of the respective printing forme 01 (FIG. 4). FIG. 6 shows four chutes of a printing forme magazine 09 (FIG. 2) arranged side by side, by way of example, assigned to a forme cylinder 06 to be loaded with printing formes 01, in its axial direction, wherein two printing formes 01 are stored in each of the respective chutes, for example, specifically one printing forme 01 in each of two storage positions arranged one above the other. Code readers 28, each embodied as a camera system, are preferably arranged at the end surfaces of each of the chutes, opposite the forme cylinder 06, wherein the respective scanning region 29 of each image sensor belonging to one of the camera systems scans the respective codes of four printing formes 01, arranged adjacent to one another, together and at the same time, specifically the codes of two printing formes 01 arranged side by side, adjacent to one another, in the axial direction of the forme cylinder 06, in two different chutes, and the codes of two printing formes 01 arranged one above the other in the same chute. The respective scanning region 29 of each image sensor belonging to one of the camera systems can have, for example, an angular, particularly a rectangular, preferably a square cross-sectional area, or, for example, even a round, preferably elliptical or circular, cross-sectional area, wherein all codes scanned in the scanning region 29 of the code reader 28 are imaged on the image plane of the image sensor thereof. The cross-sectional area of the scanning region 29 of the code reader 28 and the image plane of the image sensor are preferably arranged parallel to one another. In one variant, it can be provided that the image plane of the image sensor is divided into multiple viewing zones 31, which can preferably be selectively activated by the respective camera system, wherein each code of one of the printing formes 01, scanned in the scanning region 29, is assigned to precisely one of the viewing zones 31 belonging to said scanning region 29, i.e., each of these viewing zones 31 scans precisely one of the codes scanned by the scanning region 29, and therefore also images precisely one of the codes scanned by the scanning region 29 on the image plane of the image sensor. In the configuration of FIG. 6, each of the printing formes 01 is preferably assigned to precisely one of the print positions on the forme cylinder 06, and therefore the forme cylinder 06 in this example can be loaded with a total of eight printing formes 01, specifically four in its axial direction and two in its circumferential direction. This configuration can easily be expanded to include two additional chutes arranged side by side for a 6/2 forme cylinder 06.

Figure 1:
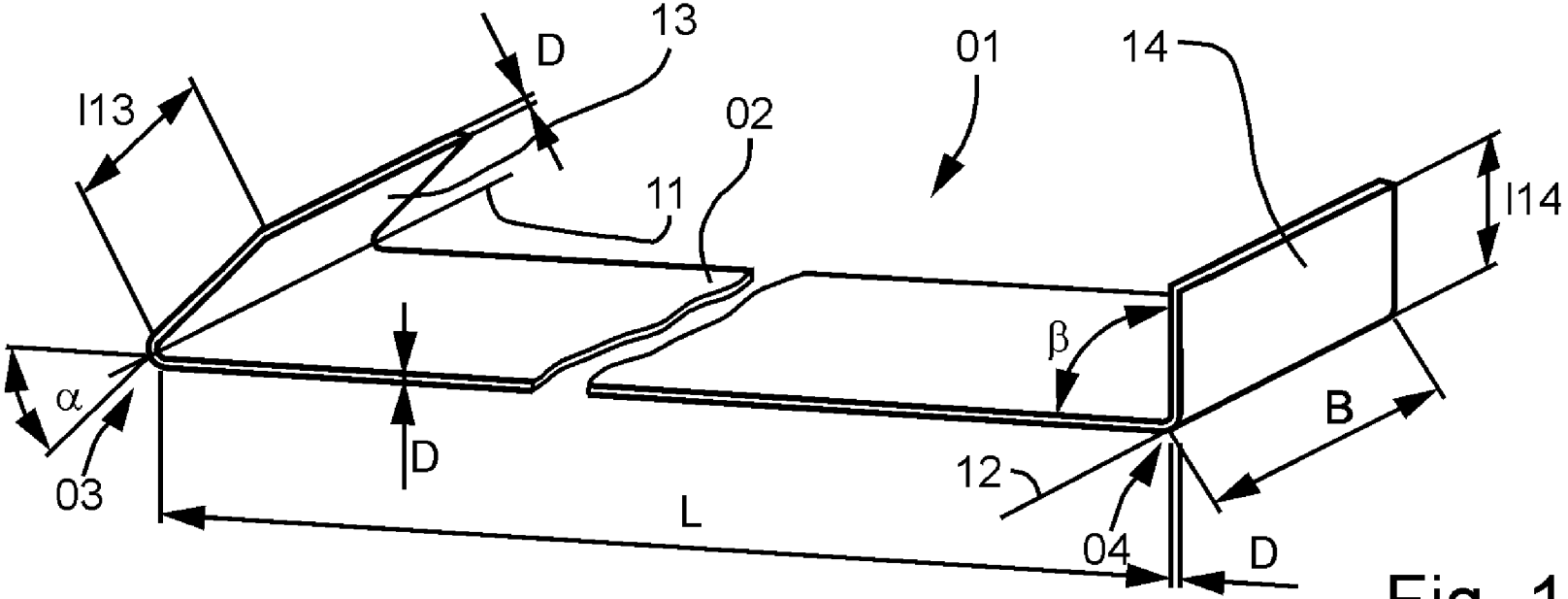
FIG. 1 a perspective illustration of a printing forme.

As is indicated in a block diagram shown in FIG. 7, to produce the printing formes 01 to be used in a pending production run, flat, plate-type blanks 32 are individually exposed in a plate exposure device 33, which is spatially separate from the printing press, thereby forming at least one print image 126 using a corresponding master 37, which is provided to the plate exposure device 33, for example, by a computer 34 of a prepress stage, preferably electronically in the form of a file containing, for example, RIP data, wherein the print image 126 applied to the respective blank 32 according to the respective master 37 is developed photochemically, for example, forming it permanently, in a developing unit 36 situated downstream of the plate exposure device 33, for example. In a subsequent process step for producing printing formes 01 that are ready for use in the printing press, the relevant printing formes 01, each provided with at least one print image 126, are bent, preferably at two opposite ends 03; 04, in a bending unit 38, to form suspension legs 13; 14 (FIG. 1). To assist with the alignment of the relevant printing forme 01 in the correct position on the outer surface of the relevant forme cylinder 06, said forme can also be equipped with at least one register punch or with a notch or clip, particularly prior to the bending of at least one of its suspension legs 13; 14. Once the respective printing forme 01 has been exposed, developed, bent and optionally punched and/or clipped, it is ready for use in a production run on the printing press.

The production of the printing formes 01 relating to a specific production run is preferably controlled on the basis of data which are provided, for example, by a control unit 40 of a production planning system and/or by a control unit 39 of a plate logistics management system, wherein said control units 39; 40 are connected or at least connectable, for example, via an electronic, cable-connected or wireless communications system 41, for example, via an Ethernet-based data network, to the plate exposure device 33 and preferably at least also to a control console 42 belonging to the printing press, for the purpose of data sharing. In the preferred embodiment, the computer 34 of the prepress stage and the control unit 39 of the plate logistics management system and/or the control unit 40 of the production planning system can provide their respective data to the plate exposure device 33 via the same communications system 41, which is indicated in FIG. 7 as an alternative to the separate connection between the computer 34 of the prepress stage and the plate exposure device 33 by a dashed line connecting the computer 34 of the prepress stage to the communications system 41.

The printing formes 01 ready for use and required for a specific production run are supplied to a printing unit 44 (FIG. 2) of the printing press, for example, in one of a plurality of available mobile collecting containers 43, wherein said collecting containers 43 can be moved manually by a press operator or preferably automatically, and are, for example, a component of an automatic transport system. In the respective collecting containers 43, the printing formes 01 required at a specific location of use in the printing press, for example on a specific forme cylinder 06, are preferably stored as a set, i.e., as a self-contained unit of integral printing formes 01, to be transported together to the relevant forme cylinder 06. The printing formes 01 which have been transported manually or, for example, in the respective collecting container 43 to the relevant location of use, particularly the forme cylinder 06, are arranged on the relevant forme cylinder 01, in their respective installation positions on the relevant forme cylinder 06, for example, manually by an operator or preferably automatically by means of a conveyor device 80 (FIG. 24), which can be controlled from the control console 42, for example, and which is particularly embodied as connected to a printing forme magazine 09.

Figure 8:
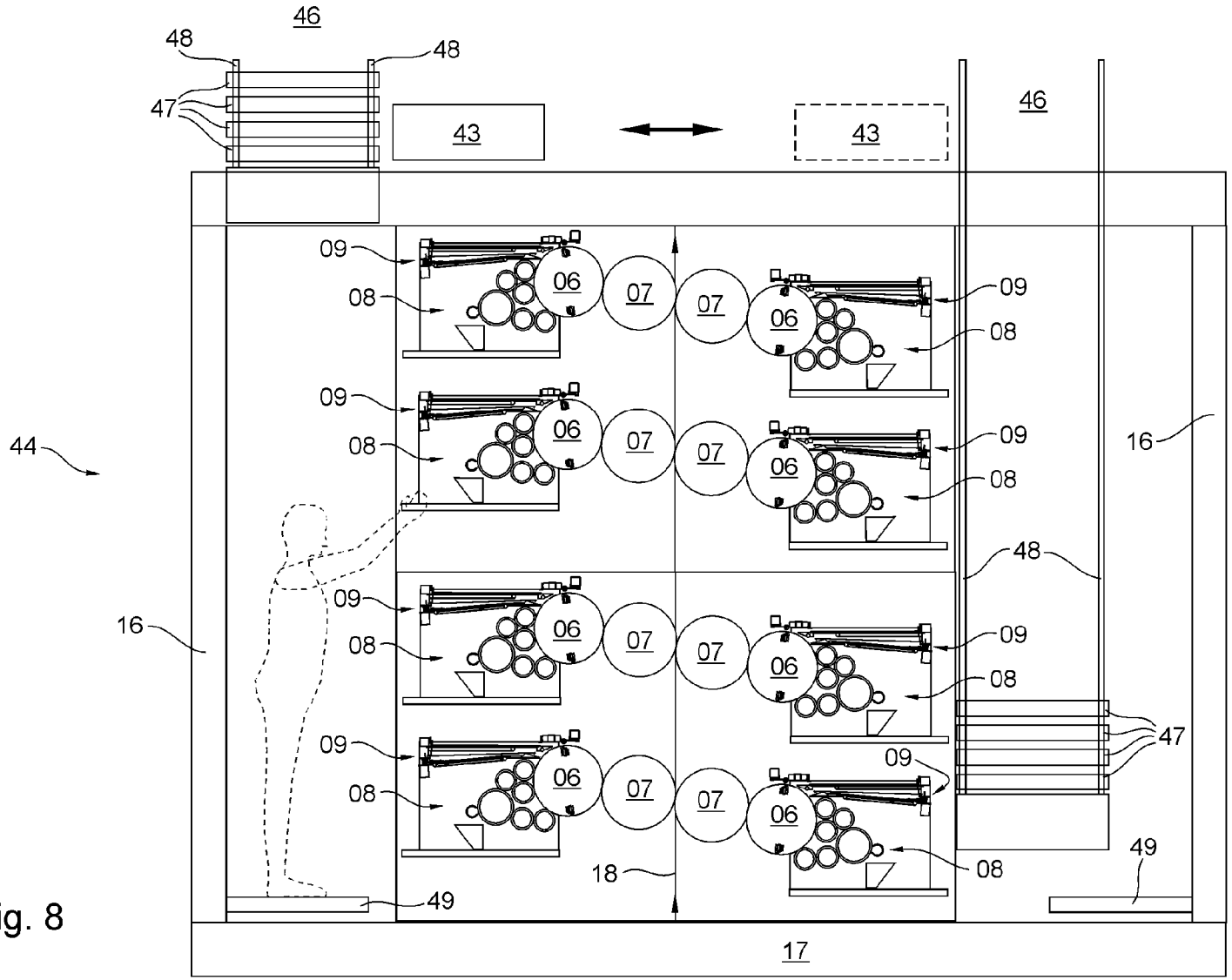
FIG. 8 a further development of the printing unit according to FIG. 2.

FIG. 8 shows a printing unit 44 similar to the unit shown in FIG. 2, and therefore all corresponding components and elements are identified by the same reference signs. The printing unit 44 shown in FIG. 8 represents a further development, in that a handling device 46 is preferably arranged on each of the two operating sides of the printing unit 44, which handling device preferably comprises a plurality of platforms 47, each disposed on at least one guide element 48, wherein with said platforms, ready-to-use printing formes 01 can be transported to the relevant printing forme magazines 09, wherein the relevant printing formes 01 are conveyed automatically by the respective platform 47 to the relevant storage position of the respective printing forme magazine 09. The handling device, 46 with its platforms 47 is embodied, for example, as a lifting device, which executes a vertical movement on the relevant operating side of the printing unit 44. The ready-to-use printing formes 01 transported by the mobile collecting container 43 to the relevant printing unit 44 are preferably automatically received by the platforms 47 of the handling device 46 and then transported to the relevant printing forme magazine 09. In FIG. 8, a double arrow indicates that each mobile collecting container 43 transports a set of ready-to-use printing formes 01 to either one of the operating sides of the relevant printing unit 44. The printing unit 44 shown in FIG. 8 is therefore expanded over the printing unit 44 shown in FIG. 2 to include a transport system, wherein said transport system comprises, for example, a distribution system comprising a handling device 46, and a loading system for loading the printing forme magazines 09 with ready-to-use printing formes 01. The printing unit 44 preferably has a walkway 49 on each of its two operating sides, the height of which can preferably be adjusted by means of a controllable drive, which walkway facilitates access for press operators to the respective printing couples of said printing unit 44. The drive for adjusting the respective height of the walkway 49 operates, for example, on a hydraulic, pneumatic or electrical operating principle. The height-adjustable walkway 49 can have a conveyor basket which can be moved to different heights, or can be embodied as a lifting platform. The respective heights are preferably referred to the base 17 of the printing unit 44.

As was described above, the device required for producing ready-to-use printing formes 01, referred to as a plate line, at least has at least one plate exposure device 33, and generally also has at least one developing unit 36 and at least one bending unit 38. In practice, however, printing formes 01 belonging to the same set frequently are not produced in a gapless sequence, one directly in front of the other, and are instead particularly exposed in a more random sequence in the plate exposure device 33, for example, due to a different editorial completion of the content of the print images 126 to be printed, and therefore, following their respective exposure, the printing formes 01 must be grouped into sets that are required at the respective locations of use in the printing press, in order to avoid unnecessary transport paths between the device for producing printing formes 01 ready for use in the printing press and the respective locations of use in said printing press. Therefore, said device for producing printing formes 01 that are ready for use in a printing press is expanded to include at least one storage device 51 (FIG. 7), in which printing formes 01 that have each been provided with at least one print image 126 are temporarily stored until a complete, integral set of printing formes 01 has been produced, to be transported together to a specific one of the forme cylinders 06 or printing forme magazines 09 arranged in the printing unit 44. Accordingly, the storage device 51 performs the function of a buffer in the production line for producing printing formes 01 that are ready for use in a printing press. A check of the completeness of the printing formes 01 belonging to a specific set is carried out, for example, by or at least in connection with said storage device 51, for example, on the basis of the data provided by the control unit 39 of the plate logistics management system.

The storage device 51 is preferably arranged downstream of the developing unit 36 and upstream of the bending unit 38 in the production flow, represented by way of example in FIG. 7 by a solid directional line, i.e., in the production line for producing the printing formes 01, since flat printing formes 01 that have not yet been bent can be stored in less space, and because the risk of mutual damage caused, for example, by a suspension leg 13; 14 scratching a print image 126, for example, is prevented. The dashed directional lines in FIG. 7 indicate alternative transport paths within the device for producing printing formes 01 that are ready for use in the printing press, particularly a positioning of the storage device 51 downstream of the bending unit 38 in the production line.

The storage device 51 is preferably embodied such that in it, printing formes 01 can be placed in storage and removed from storage at the same time. The storage device 51 has at least as many storage spaces as the number of printing formes 01 belonging to the same set of printing formes 01. The number of printing formes 01 belonging to the same set need not be identical to the maximum number of installation positions on the forme cylinder 06 involved in the pending production run, or the maximum number of storage positions in the relevant printing forme magazine 09, for which the printing formes 01 to be transported are intended. Instead, the relevant set of printing formes 01 comprises the number of printing formes 01 that are to be installed and/or replaced, in the same operating process, on the forme cylinder 06 involved in the pending production run or in the relevant printing forme magazine 09. The storage device 51 is preferably equipped with enough storage spaces to accommodate multiple sets of printing formes 01, for example, all the sets of printing formes 01 that can be used in the relevant printing unit 44.

The storage device 51 has at least one first handling device, with which printing formes 01 that have been supplied to the storage device 51 are stored in storage spaces in said storage device 51, wherein precisely one of the printing formes 01 is preferably assigned to each of the storage spaces. For unloading from storage, at least one additional second handling device, which is different from the first, can be provided, which takes up or grips a printing forme 01 stored in one of the storage spaces and removes it from storage when the set of printing formes 01 to which the relevant printing forme 01 belongs is called up for transport to the printing unit 44. The first and/or second handling device executes a movement relative to the stationary storage spaces of the storage device 51, in the same plane, for example, in two directions, preferably orthogonally to one another. Alternatively, it can be provided that each handling device for placing at least one of the printing formes 01 in storage or removing said forme from storage is stationary relative to the storage device 51, and a magazine comprising the respective storage spaces of said storage device 51 moves translationally and/or rotationally relative to the at least one handling device or relative to the plurality of handling devices, particularly two. Therefore, the processes for placing printing formes 01 in storage and/or removing said formes from storage each involve a relative movement between the storage spaces of the storage device 51 and at least one device which executes the respective placement in or removal from storage, for example, the handling device.

The device for producing printing formes 01 that are ready for use in a printing press therefore at least comprises at least one plate exposure device 33, wherein at least one storage device 51 is provided downstream of this plate exposure device 33, wherein the storage device 51 temporarily stores at least one set of printing formes 01, which are integral with respect to a shared location of use in terms of a specific forme cylinder 06 or a specific printing forme magazine 09, before said formes are transported together to the printing press. The location of use of the printing formes 01, which are to be transported to said location as a set, therefore consists of one of a plurality of forme cylinders 06 or printing forme magazines 09 located in the printing press.

Printing formes 01 stored in the storage device 51 and belonging to different sets are preferably each removed from storage as an integral set of printing formes 01 in an uninterrupted sequence, regardless of whether said printing formes 01 have been presorted in advance into integral sets of printing formes 01 in the storage device 51, or have been temporarily stored in storage spaces in the storage device 51 in a random, i.e., chaotic order. At least if the storage device 51 does not unload stored printing formes 01 from storage in sets, a sorting station 57 for sorting printing formes 01 is provided in conjunction with the storage device 51, for example, downstream thereof, i.e., downstream of a delivery of the printing formes 01 from said storage device 51, which sorting device sorts the printing formes 01 into integral sets of printing formes 01 that are required in the respective printing unit 44 and are associated on the basis of their shared location of use in terms of a specific forme cylinder 06 or a specific printing forme magazine 09. In one variant, the sorting station 57 can be embodied as integrated into the storage device 51. In another variant, it can be provided that the sorting station 57 is arranged between the bending unit 38 and one of the mobile collecting containers 43. As an alternative, the sorting station 57 can also be arranged downstream of the bending unit 38 in the production line represented in FIG. 7 by dashed directional lines, so that in or by means of the sorting station 57, printing formes 01 that have already been bent are sorted into ready-to-use sets and delivered to one of the plurality of mobile collecting containers 43, for example, unless the printing formes 01 are transported manually to the respective location of use in the printing unit 44. FIG. 7 shows a plurality of alternatingly or optionally usable mobile collecting containers 43, for example, three, each of which preferably automatically transports one set of printing formes 01 to its respective location of use in the printing unit 44. As an alternative, dashed directional lines in FIG. 7 indicate transport paths leading out of the device for producing printing formes 01 ready for use to the printing press, with each of said paths extending past the mobile collecting containers 43, indicating a manual transport of the individual printing formes 01 to the relevant printing unit 44. The sorting station 57 or the storage device 51 group printing formes 01 supplied to them, for example, automatically, on the basis of the codes preferably applied to each of said printing formes 01, into integral sets, which are in turn to be supplied, in the same operational step, to the relevant forme cylinder 06 or to the relevant printing forme magazine 09, particularly using one of the mobile collecting containers 43. This coding is embodied, for example, as a data matrix code 22, wherein said code is preferably applied to the non-printed region of the relevant printing forme 01, for example, to a suspension leg 13; 14 which has not yet been bent at the time said printing forme 01 is placed in storage in the storage device 51 (FIG. 3, 4).

To allow the visualization of preferably both the particularly sequential process of producing printing formes 01 that are ready for use in a printing press and the operational status at the location of use of said printing formes 01, for example, a display device 52 with an optical display, for example, particularly a graphic display, which preferably uses at least one symbol, is preferably provided, in connection with the device for carrying out said process, as indicated in FIG. 7, for example, by a dotted-dashed outline, and/or in connection with the temporary storage and transport of the printing formes 01 that have been produced and are ready for use, wherein the display indicates, in an overall display, which simultaneously displays a plurality of installation positions on a forme cylinder 06 having the plurality of installation positions, or a plurality of storage positions of a printing forme magazine 09 having the plurality of storage positions, at which of this plurality of installation positions on the relevant forme cylinder 06 or at which of this plurality of storage positions in the printing forme magazine 09 a printing forme 01 is to be arranged. The display device 52 thus has a preferably electronic display, embodied as a monitor or as a screen mask, for example, which displays at least one use of a printing forme 01 at its location of use in a printing press, wherein at the location of use of the printing forme 01, a plurality of different positions are provided, wherein each position at the location of use relates to one of a plurality of installation positions on a forme cylinder 06 having the plurality of installation positions, or one of a plurality of storage positions in a printing forme magazine 09 having the plurality of storage positions, wherein the display of the display device 52 shows a plurality of different locations of use in the printing press at the same time, wherein the display indicates at which of the positions of a specific location of use having a plurality of positions, each for one printing forme 01 to be arranged there, a printing forme 01 is to be arranged. This display provides a printing press operator with an overview of and control over the status of a process for resetting this printing press for a new production run.

More particularly, the display of the display device 52 can also show different status and/or characteristics relating to at least one of the printing formes 01 that have been produced or at least will be produced, in other words, for example, a) to which installation position on the relevant forme cylinder 06 or to which storage position in the printing forme magazine 09 an already produced, i.e., ready-to-use printing forme 01 is assigned, b) to which installation position on the relevant forme cylinder 06 or to which storage position in the printing forme magazine 09 a printing forme 01 which is currently in the production process, i.e., in the feed line, is assigned, c) at which installation position on the relevant forme cylinder 06 or in which storage position in the printing forme magazine 09 any printing forme will be arranged for the pending production run, d) which installation position on the relevant forme cylinder 06 or which storage position in the printing forme magazine 09 will not be loaded with a printing forme 01 in the pending production run, because in the pending production run, for example, a print substrate 18 having a print substrate width that does not utilize the full printing width of the relevant forme cylinder 06 will be used, or e) at which installation position on the relevant forme cylinder 06 or in which storage position in the printing forme magazine 09 a non-printing printing forme 01, i.e., a so-called dummy plate will be arranged.

The display device 52 can take the information necessary for the respective display, for example, from the data provided by the control unit 39 of the plate logistics management system and/or the control unit 40 of the production planning system, preferably comparing said data with the data that are collected during the production of the printing formes 01 prepared for the pending production run. As is shown in FIG. 7, it is therefore advantageous for the display device 52 to be connected to the communications system 41, to which the plate exposure device 33, the computer 34 of the prepress stage, the control unit 39 of the plate logistics management system and/or the control unit 40 of the production planning system, and the control console 42 belonging to the printing press are also connected, for example, and to enable a sharing of data via the network created in this manner.

The display device 52 is spatially arranged, for example, in the region of the location where the mobile collecting container 43 receives the printing formes 01 relating to a specific forme cylinder 06 or a specific printing forme magazine 09, for example, before said formes are transported to the relevant forme cylinder 06 or the relevant printing forme magazine 09. The display device 52 can also be used to display the current status of the printing formes 01 to be produced for a specific production run, i.e., to display whether a specific printing forme 01 is currently located, for example, in the plate exposure device 33, the developing unit 36, the bending unit 38 or the storage device 51, and therefore the display of the display device 52 particularly indicates to an operator of the printing press whether or not a set of printing formes 01 required for a specific forme cylinder 06 or for a specific printing forme magazine 09 is already complete. The display device 52 can also display for which printing unit 44, which preferably comprises a plurality of forme cylinders 06 and/or printing forme magazines 09, in a complex printing system, i.e., comprising a plurality of printing units 44, at least one set of printing formes 01 is already complete, and/or which of the plurality of sets of printing formes 01 to be arranged in a specific one of the printing units 44 is already produced and ready for use.

Figure 9:
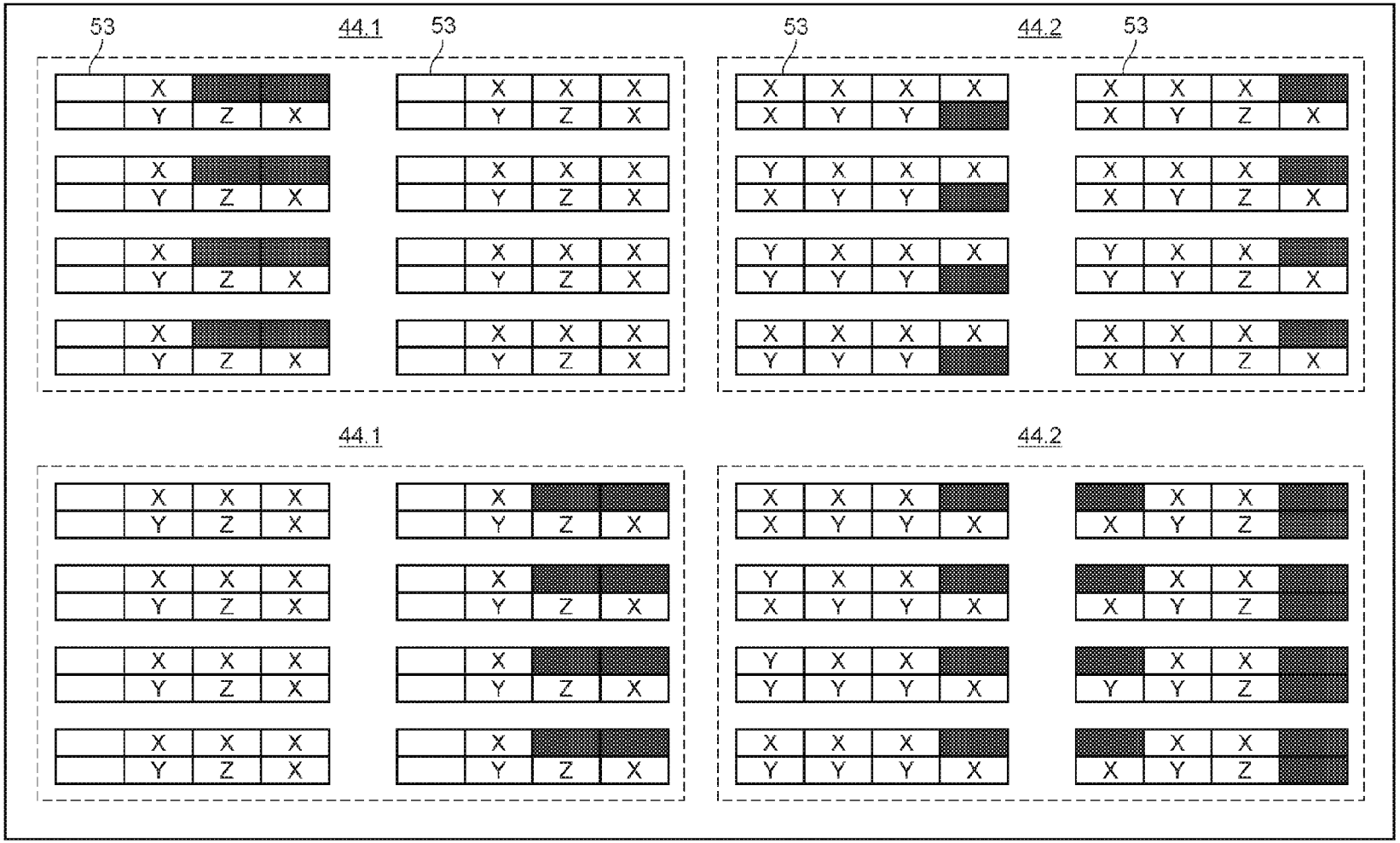
FIG. 9 a display of a display device.

FIG. 9 shows, by way of example, the display of the display device 52 for a printing system comprising at least two printing units 44.1; 44.2, which, for example, in conjunction with additional units, not shown here, for example, a folder, form a section of a printing press. The illustration in the upper half of FIG. 9 relates to a first production run and the illustration in the lower half of FIG. 9 relates to a second production run, different from the first. For each of the two printing units 44.1; 44.2, the respective locations of use for the produced, ready-to-use printing formes 01 are displayed in FIG. 9 in two blocks, arranged in rows, for the two production runs, wherein the location of use for each of said printing formes 01 is on one of a plurality of forme cylinders 06 or printing forme magazines 09 arranged in the printing press, wherein in each block, the locations of use for said printing formes 01, located at the respective operating sides of the respective printing units 44.1; 44.2, are shown in two parallel columns. Each of these blocks, which is assigned to one of the two printing units 44.1; 44.2, is indicated in FIG. 9 by a dashed outline. At each operating side of the respective printing unit 44.1; 44.2, four locations of use for four different sets of printing formes 01 are provided, one above the other vertically, for example, corresponding to the arrangement of the printing couples in the relevant printing unit 44.1; 44.2 (FIG. 2, 8), wherein each location of use has, for example, four installation positions or storage positions, each for one printing forme 01 of the relevant set of printing formes 01, side by side in the axial direction of the relevant forme cylinder 06, and wherein two installation positions or storage positions, for example, each for one printing forme 01 of the relevant set of printing formes 01, are provided, one in front of the other in the circumferential direction of each relevant forme cylinder 06. For each location of use for a set of printing formes 01, an information field 53 is provided in the display of the display device 52, which field, in the example illustrated in FIG. 9, consists of four positions arranged side by side and two positions arranged one on top of the other for printing formes 01 of the relevant set. Each of the two printing units 44.1; 44.2 is therefore assigned a total of eight information fields 53, which display the status of a printing forme 01 to be produced and/or the loading of an installation position or storage position, in each of eight different positions. The display of the display device 52 is therefore capable of displaying simultaneously a plurality of different production runs to be executed in sequence in the same printing press, with a plurality of locations of use, each assigned to said production runs, for the printing formes 01 required for the respective production runs.

On the basis of a code, various pieces of information can be shown on the display of the display device 52. In each information field 53, each position provides a specific piece of information relating to the status of a printing forme 01 and/or the loading of an installation position or storage position. A position that is left blank, as is indicated in FIG. 9 by a white field, can indicate, for example, that for the pending production run, no printing forme 01 is required at that position in the relevant printing unit 44.1; 44.2. A filled position can mean that a printing forme 01 is already located in said position at the relevant location of use, because, for example, the printing forme 01 from a preceding production run can be retained. Positions marked by a symbol, for example, an "X," can indicate, for example, that for each of said positions a printing forme 01 has yet to be produced. Positions marked with a different symbol, for example a "Y," indicate, for example, that for said position a printing forme 01 that has already been at least exposed is located in the storage device 33. Positions marked with a further symbol, for example, a "Z," indicate, for example, that at the relevant position, an unexposed printing forme 01, i.e., a dummy plate, will be used. Printing formes 01 that will be used in the planned next production run in the relevant printing units 44.1; 44.2 in those positions marked with a symbol, for example, with an "X," "Y," or "Z," make up the integral set of printing formes 01 to be transported to the respective location of use. The display of the display device 52 therefore provides, in an overall display which shows a plurality of positions, i.e., installation positions or storage positions, simultaneously, information regarding at which of these positions a printing forme 01 will be arranged, and for which of these positions a printing forme 01 has yet to be produced and/or will be transported to its respective location of use along with other printing formes 01 that are required at the same location of use.

To further assist in the correct positioning of printing formes 01 involved in a pending production run, for example, in positions, wherein said positions relate either to installation positions on a forme cylinder 06 having a plurality of installation positions or to storage positions in a printing forme magazine 09 having a plurality of storage positions, for example, an information field 54, corresponding, for example, to an information field 53 in the display of the display device 52, can also be provided on at least one, for example, but preferably on a plurality of, particularly on each of the printing formes 01 to be arranged on the relevant forme cylinder 06 or in the relevant printing forme magazine 09, which information field 54 contains information at least about the arrangement of an additional printing forme 01 and/or about an operating procedure relating to said forme, the position of which is adjacent to the printing forme 01 containing the information field 54. This information field 54 therefore provides assistance in the use, particularly in the positioning, of a printing forme 01 at one of a plurality of positions of a component belonging to a printing couple of a printing unit 44; 44.1; 44.2 or printing press, wherein said component can be embodied, for example, as a forme cylinder 06 or as a printing forme magazine 09.

For instance, the information field 54 applied, for example, by the plate exposure device 33, preferably in a non-printed area, particularly on the suspension leg 13; 14, of the relevant printing forme 01, can display, for example, a) at which installation position on the relevant forme cylinder 06 or at which storage position in the printing forme magazine 09 the printing forme 01 containing said information field 54 is to be arranged, b) at which other installation position on the relevant forme cylinder 06 or at which other storage position in the printing forme magazine 09 for storing said printing forme 01 another printing forme 01 that has yet to be produced is to be arranged, c) at which installation position on the relevant forme cylinder 06 or in which storage position in the printing forme magazine 09 for storing said printing forme 01 no new printing forme 01 is currently to be installed, i.e., for the pending production run, and instead the present printing forme 01 from a preceding production run will be left in place, d) which installation position on the relevant forme cylinder 06 or which storage position in the printing forme magazine 09 for storing said printing forme 01 will not be loaded with any printing forme 01 during the pending production run, because in the pending production run, for example, a print substrate 18 having a print substrate width which does not utilize the full printing width of the relevant forme cylinder 06 will be used, or e) at which installation position on the relevant forme cylinder 06 or at which storage position in the printing forme magazine 09 for storing said printing forme 01 a non-printing printing forme 01, i.e., a so-called dummy plate, will be arranged. Therefore, the information field 54 can also contain information about a positioning and/or about an operating procedure relating to a plurality of, or preferably all of the positions relating to the same component.

The information about the arrangement of printing formes 01 involved in a pending production run in the relevant positions can preferably be provided in the information field 54 graphically, for example, using at least one symbol. The information shown in the respective information field 54 is taken, for example, from the data provided by the control unit 39 of the plate logistics management system and/or the control unit 40 of the production planning system. Alternatively or additionally, the information shown in the respective information field 54 can result from a comparison with the data collected during the production of the printing formes 01 prepared for the pending production run. Each information field 54 applied to the printing forme 01 can be applied along with, i.e., in addition to, a data matrix code, for example, on the suspension leg 13; 14 of the relevant printing forme 01.

Using the above-described information field 54, a method for correctly arranging printing formes 01 involved in a pending production run at positions of a component of a printing press, embodied as a forme cylinder 06 or as a printing forme magazine 09, can be implemented, wherein one of the printing formes 01 is arranged in each of the positions of the component, embodied either as installation positions on the forme cylinder 06 having a plurality of installation positions or as storage positions in the printing forme magazine 09 having a plurality of storage positions, wherein information on at least one of said printing formes 01 regarding the arrangement of the printing formes 01 to be arranged in the positions of the relevant component is displayed in the information field 54, wherein the printing forme 01 having the information field 54 is arranged in one of the positions of the component, wherein at least one additional printing forme 01 to be arranged in one of the positions of the component is arranged on the basis of the information on the printing forme 01 that has the information field 54, wherein the position of said additional printing forme 01 in relation to the relevant component is adjacent to the printing forme (01) that has the information field 54.

The result is an arrangement of printing formes 01 involved in a pending production run in positions of a component of a printing press, wherein one of the printing formes 01 can be arranged at each of the positions of the component, wherein at least one of said printing formes 01 has an information field 54 consisting of a plurality of individual position elements 56, with information about the arrangement and/or about an operating procedure relating to an additional printing forme 01 to be arranged at one of the positions of said component, wherein the position elements 56 are grouped according to the positions of said component, wherein the position of the additional printing forme 01 in relation to the arrangement of printing formes 01 in positions of the relevant component is adjacent to the printing forme 01 that has the information field 54. In this case, the component is preferably embodied as a forme cylinder 06 or as a printing forme magazine 09, wherein accordingly, the positions of the component are embodied either as installation positions on the forme cylinder 06 having a plurality of installation positions or as storage positions in the printing forme magazine 09 having a plurality of storage positions. Said positioning elements 56 are preferably detectable by a camera system or a sensing device, and can be automatically evaluated with respect to their information to be provided.

Figure 10:
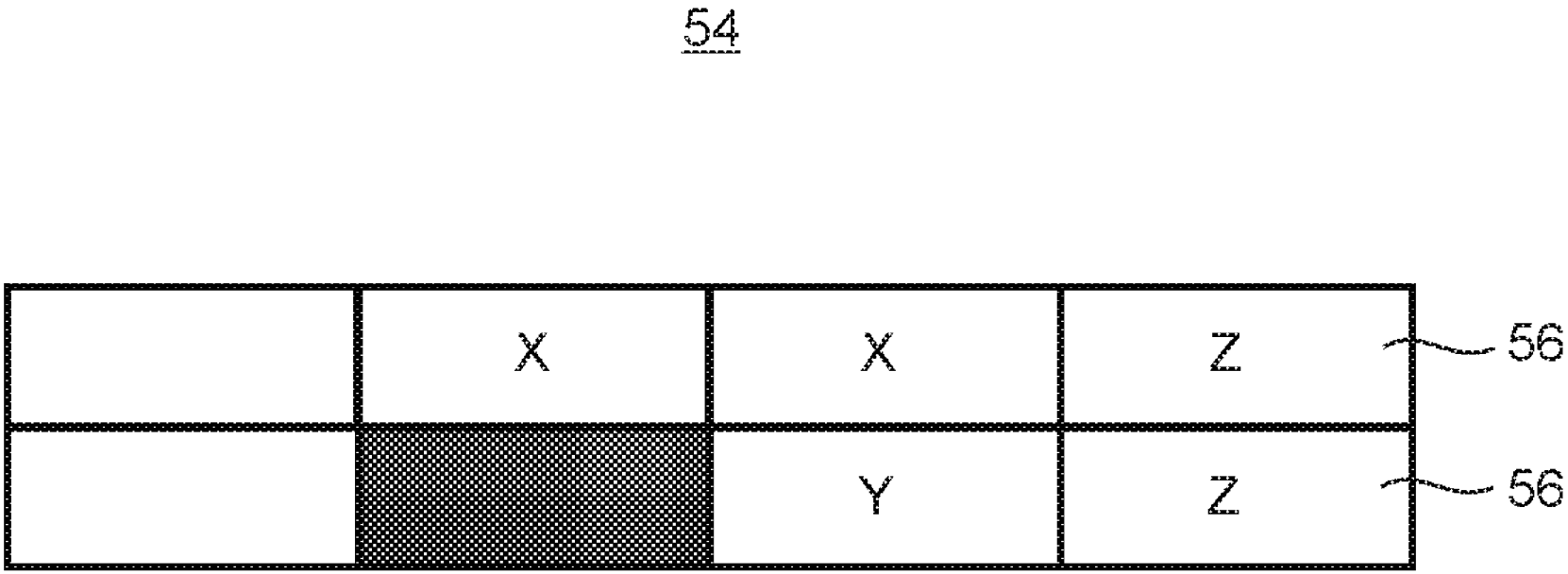
FIG. 10 an information field applied to a printing forme.

FIG. 10 shows an information field 54 of this type, applied to at least one of the printing formes 01. The information field 54 consists of a plurality of individual position elements 56, which are grouped according to the positions of the component, i.e., according to the installation positions on the relevant forme cylinder 06 or the storage positions in the relevant printing forme magazine 09, in this case, for example, in two parallel rows of four columns each. The position elements 56 use a suitable code to provide information about an arrangement and/or about an operating procedure relating to at least one additional printing forme 01, which is positioned adjacent to the printing forme 01 that contains the information field 54. A position element 56 that is left blank indicates, for example, that no printing forme 01 will be arranged at that position, whereas a filled position element 56 indicates, for example, that the printing forme 01 containing said information field 54 is to be arranged precisely at that position in the component which corresponds with the position element 56 in the information field 54. In accordance with, or at least similar to, the manner described above in connection with the display of the display device 52, a position marked by a symbol, for example, an "X," can indicate, for example, that a printing forme 01 has yet to be produced for this position. A position marked by a different symbol, for example, a "Y," indicates, for example, that at that position an unexposed printing forme 01, i.e., a dummy plate, will be used. A position marked by a further symbol, for example, a "Z," can indicate, for example, that no new printing forme 01 will be arranged at that position, and instead the existing printing forme 01 will be left in place there.

In reference to FIGS. 11 to 17, a method for preferably automatically changing printing formes 01 used in the printing press will now be specified, which can be easily implemented, for example, in the printing units 44; 44.1; 44.2 of the printing press, each of which will be loaded with printing formes 01. This method is particularly suitable for printing units 44; 44.1; 44.2 according to the embodiment shown in FIG. 2, each having a plurality of printing couples, preferably in a printing unit 44; 44.1; 44.2 according to the example of FIG. 8, because the example of FIG. 8 shows a walkway 49, the height of which can be adjusted by a drive, for example, motorized, on each operating side of the relevant printing unit 44; 44.1; 44.2.

Figure 11:
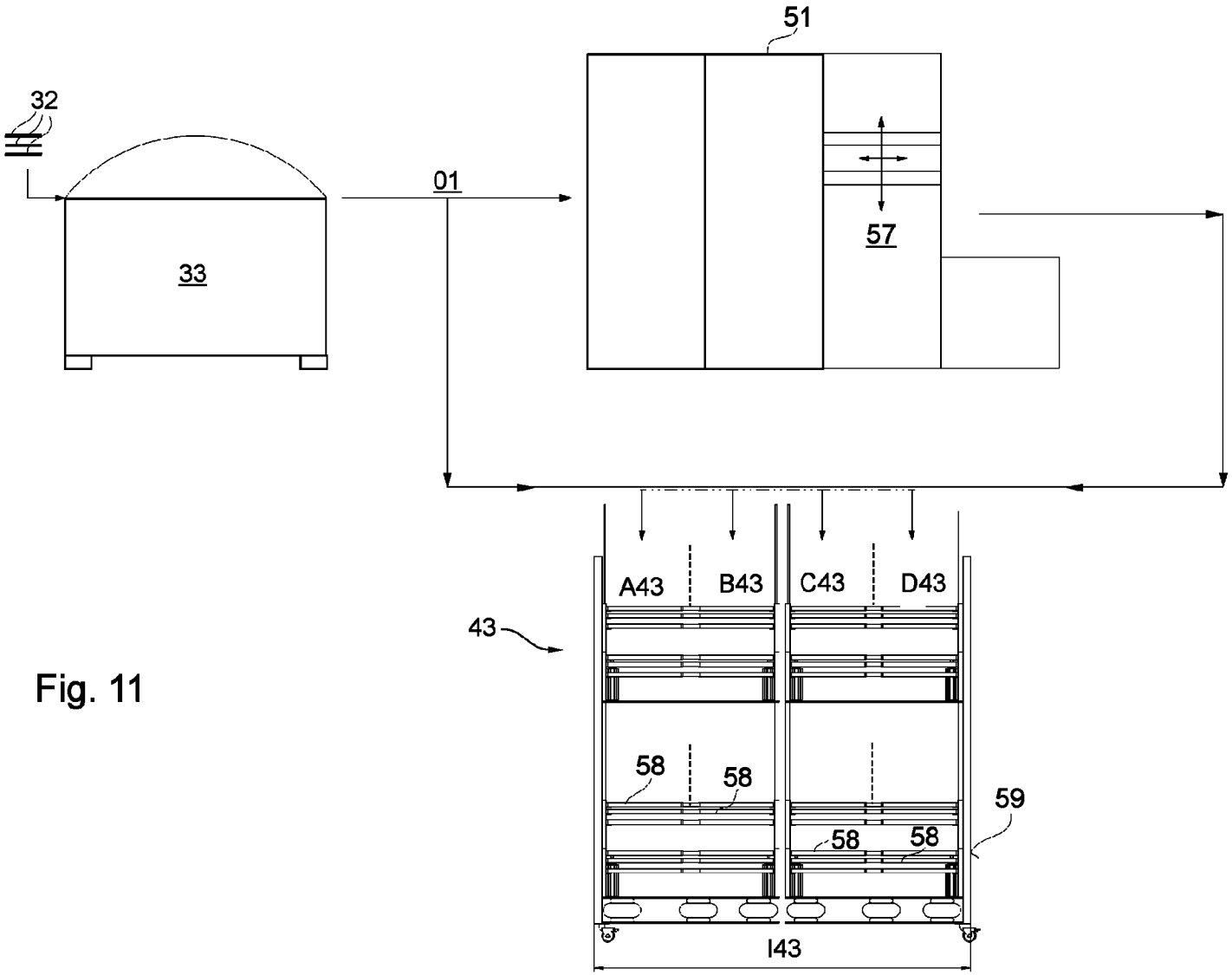
FIG. 11 a diagram illustrating the principle of loading a mobile collecting container with printing formes that have been produced in a plate line and are ready for use.
Figure 18:
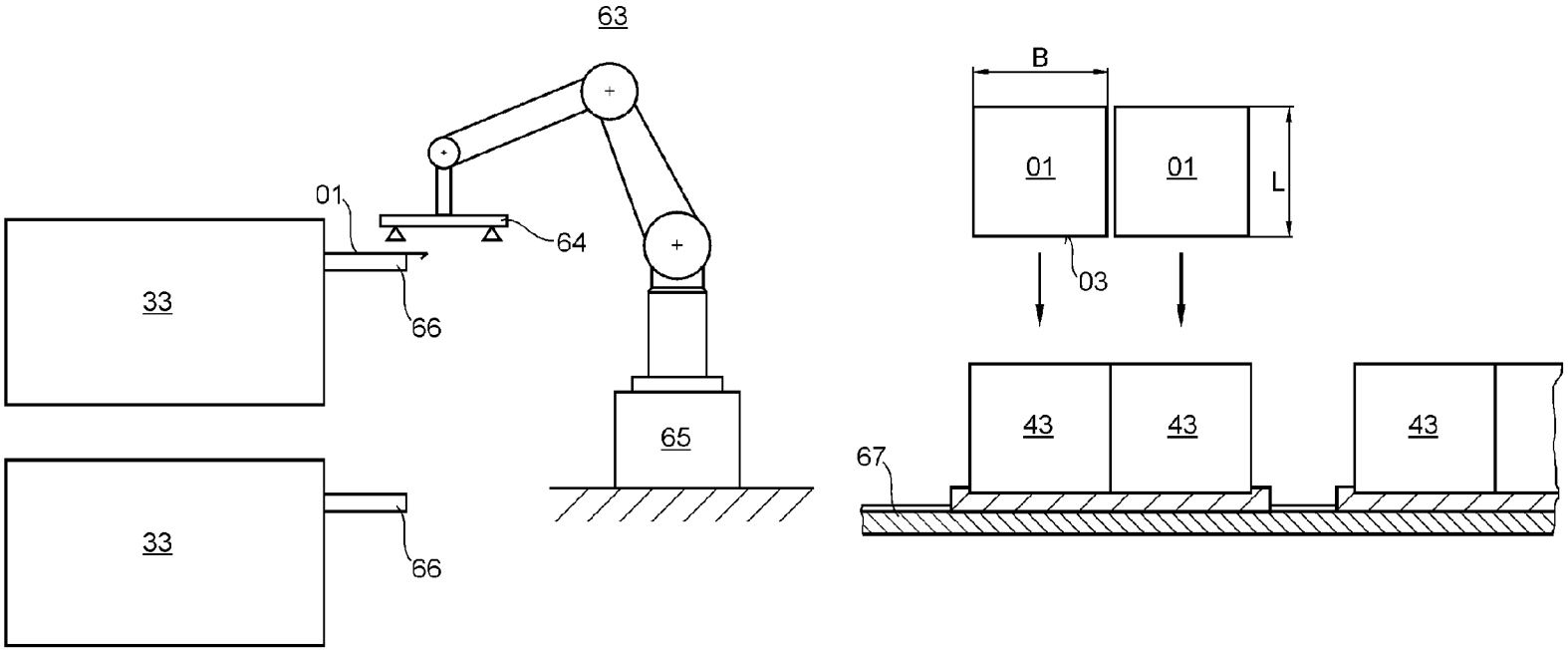
FIG. 18 process steps for automatically sorting printing formes into mobile collecting containers at the end of a plate line.

FIG. 11 is linked to FIG. 7 and shows, by way of example, the plate exposure device 33, to which blanks 32 for the respective printing formes 01 are supplied. The developing unit 36 and the bending unit 38 are not shown in FIG. 11 for purposes of clarity; however, it is understood that they are provided. FIG. 11 assumes that in the plate line arranged spatially separately from the printing press, printing formes 01 which have been produced and are ready for use at the output of said plate line are supplied either directly to a mobile collecting container 43 or first to a storage device 51 for temporarily storing said printing formes 01 and then from said storage device 51 to a mobile collecting container 43, which is indicated in FIG. 11 by the two transport paths indicated by arrows. The storage device 51 can cooperate with a sorting station 57. The printing formes 01 that have been produced and are ready for use are stored in the respective mobile collecting container 43, presorted according to the respective installation positions intended for them on one of the forme cylinders 06 disposed in the relevant printing unit 44; 44.1; 44.2, and are transported together in this collecting container 43 from the plate line to the respective printing unit 44; 44.1; 44.2. The mobile collecting container 43 is movable, particularly drivable, and preferably automatically movable, for example, on rollers, wheels or at least one rail (FIG. 18, 19).

Figure 12:
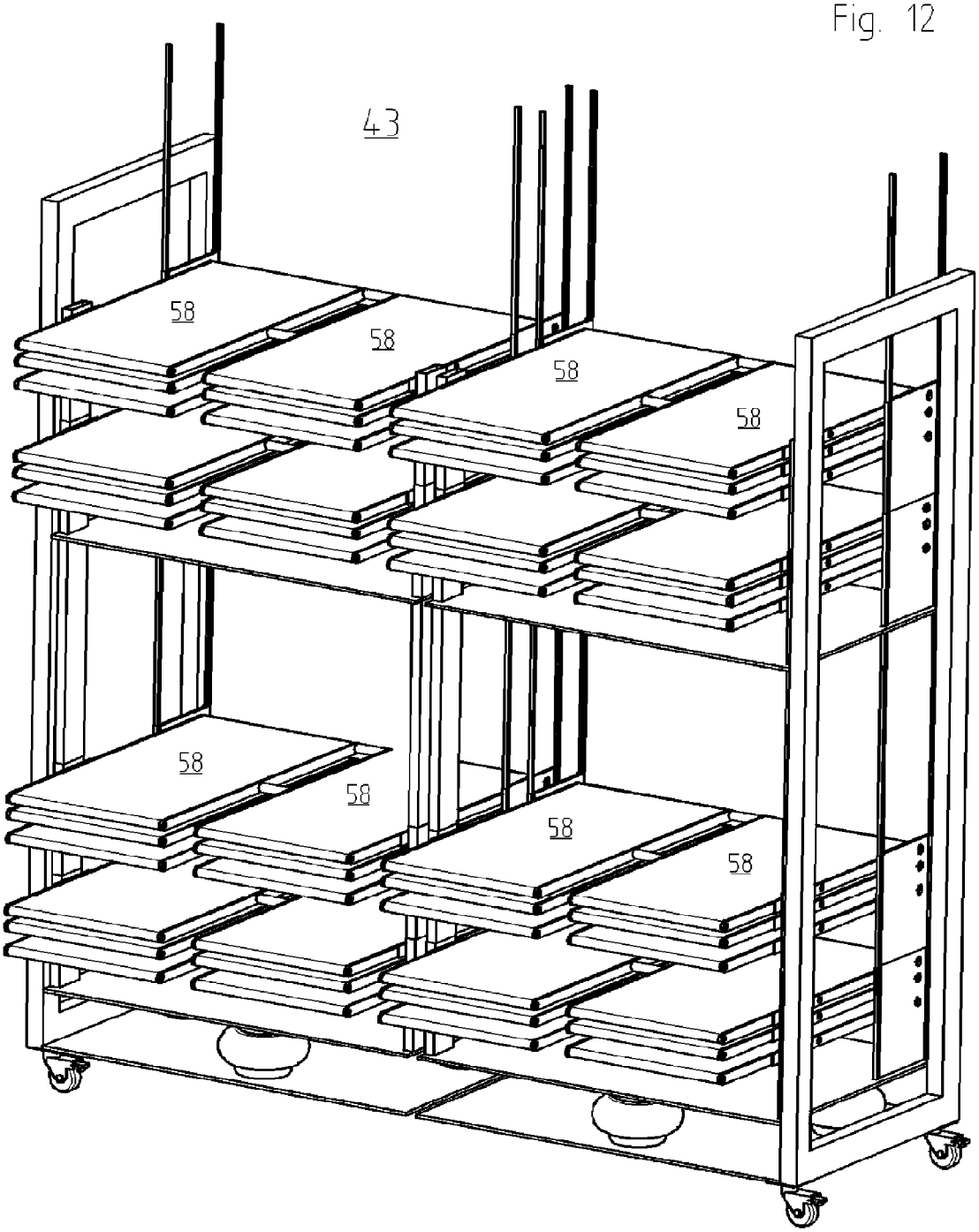
FIG. 12 a perspective view of the collecting container of FIG. 11.
Figure 13:
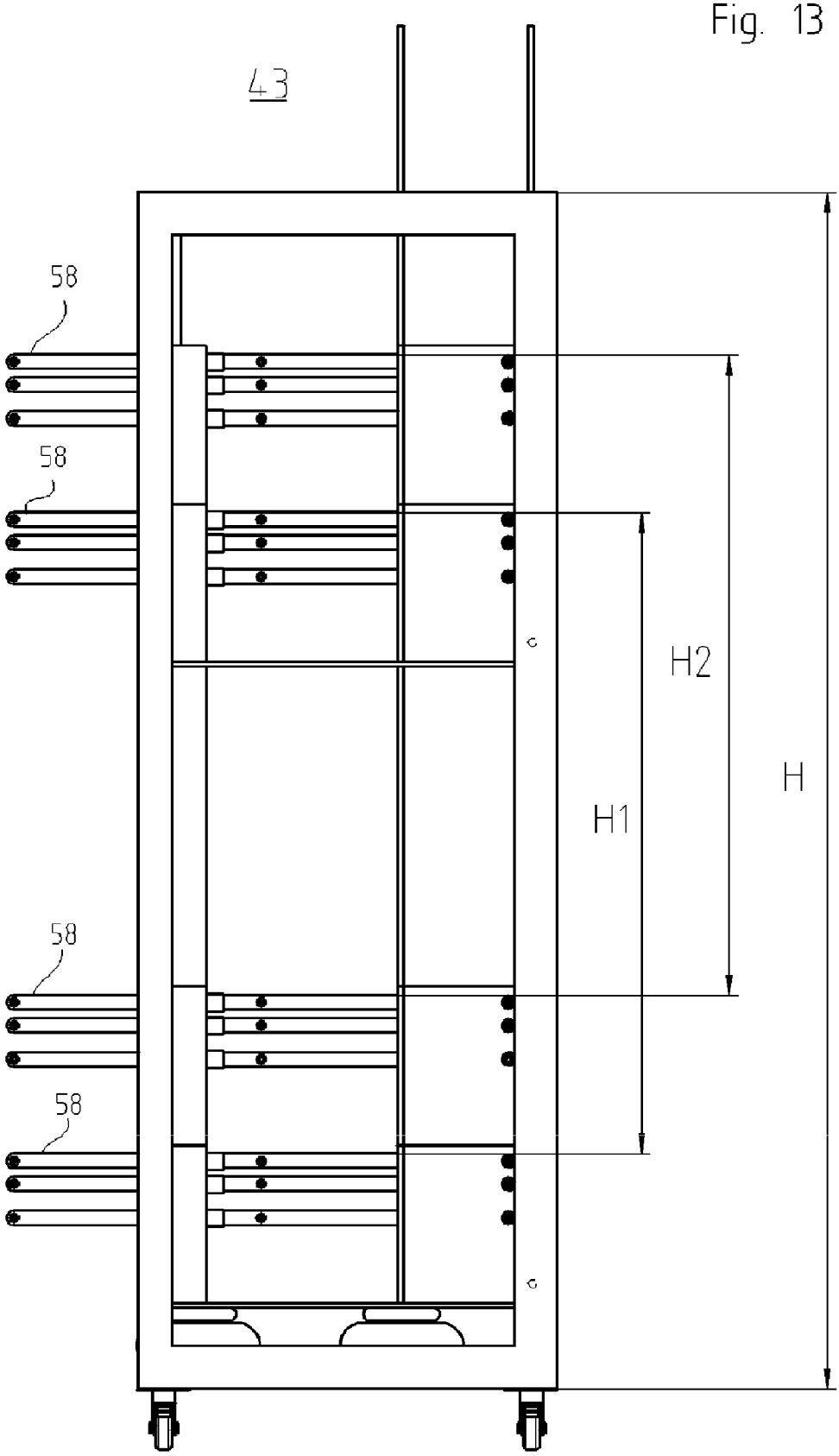
FIG. 13 a side view of the collecting container of FIG. 11.

In accordance with the axial installation positions on the outer surface of the relevant forme cylinder 06, the relevant mobile collecting container 43 has a plurality of storage bays A43; B43; C43; D43, for example four or six, arranged in a row along its length l43, each preferably equipped with a plurality of compartments 58, for example eight, twelve or more, wherein printing formes 01 that have been produced and are ready for use can be assigned, on the basis of their respective codes, for example, to each of said bays (FIG. 4). The individual compartments 58 assigned to a specific storage bay A43; B43; C43; D43 are arranged at multiple levels, vertically one above the other, in the manner of a shelving system, each preferably having the width B, in the longitudinal direction of the relevant mobile collecting container 43, of the printing forme 01 to be stored in the relevant compartment 58 (FIG. 1). FIG. 12 shows a perspective illustration, by way of example, of a mobile collecting container 43 of this type with four storage bays A43; B43; C43; D43 arranged in a row, in each of which a plurality of printing formes 01 that have been produced and are ready for use are stored or at least can be stored. The same mobile collecting container 43 is shown again in FIG. 13 from a side view. Each individual compartment 58 of this plurality of compartments 58 arranged in a plurality of storage bays A43; B43; C43; D43 and in different planes arranged vertically one above the other can be addressed individually using the respective codes on the printing formes 01 to be stored in the relevant mobile collecting container 43. As a result, produced, ready-to-use printing formes 01 are stored, presorted on the basis of their respective installation positions on one of the forme cylinders 06 of the printing press, in the compartments 58 of the relevant mobile collecting container 43.

Figure 14:
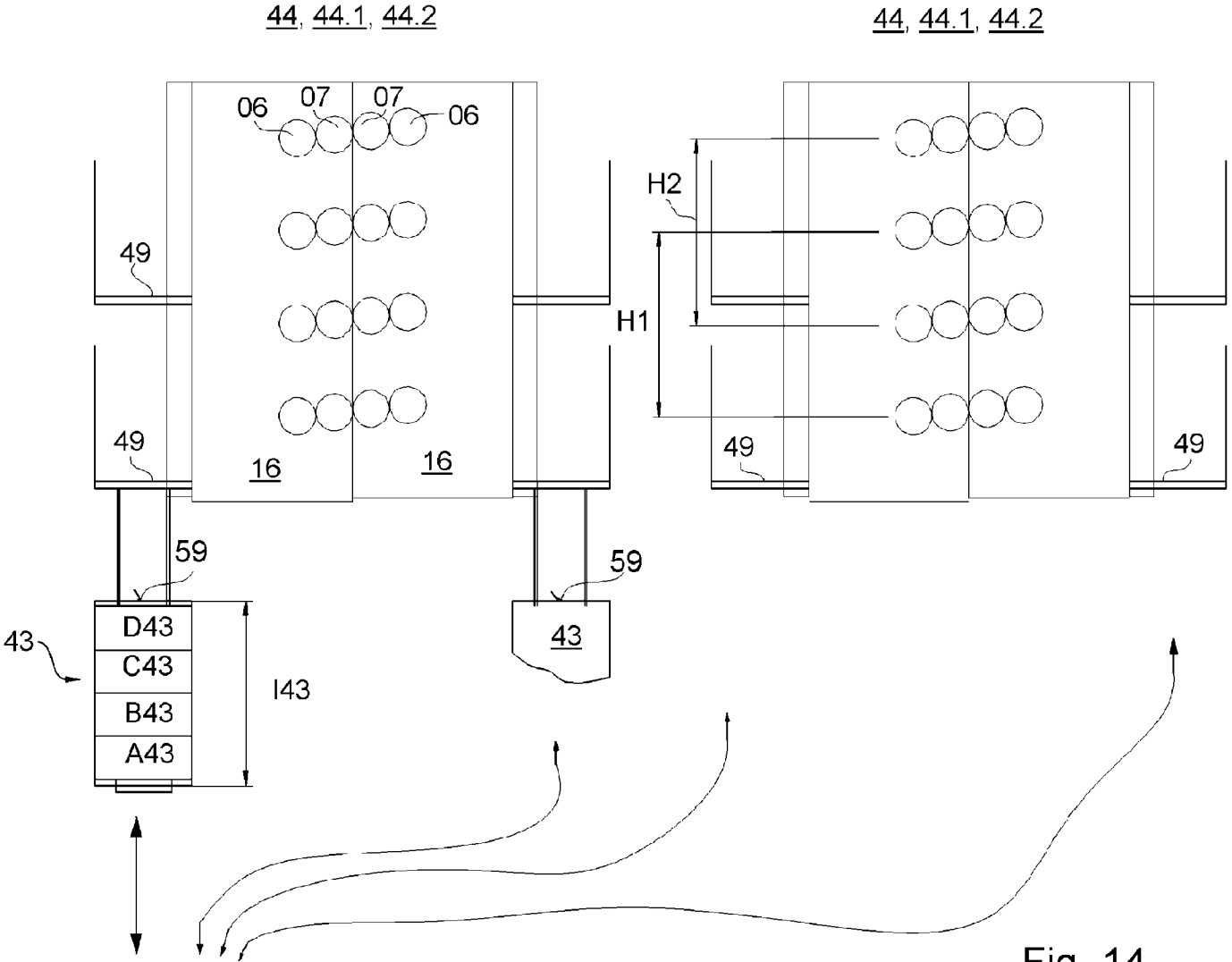
FIG. 14 a simplified diagram illustrating the principle of transporting at least one mobile collecting container to a printing unit.

FIG. 14 provides a simplified sketch illustrating the principle of transporting at least one of the mobile collecting containers 43 to the printing unit 44; 44.1; 44.2 of the printing press, which preferably comprises a plurality of printing units 44; 44.1; 44.2, the forme cylinders 06 of which are to be loaded with printing formes 01 stored in the relevant mobile collecting container 43, wherein the respective transport path of the mobile collecting container 43 to the respective printing unit 44; 44.1; 44.2 is indicated in each case by a double arrow. The mobile collecting container 43 can preferably be transported from the plate line to the relevant printing unit 44; 44.1; 44.2 automatically, for example, mounted on a rail. The relevant mobile collecting container 43 is transported up to the operating side of the relevant printing unit 44; 44.1; 44.2 with its narrow end surface 59 facing the respective height-adjustable walkway 49, so that the relevant mobile collecting container 43 is situated with its length l43 aligned parallel to the rotational axis 124 (FIG. 44) of the forme cylinder 06. The length l43 of the mobile collecting container 43 preferably corresponds to the entire width of the relevant printing unit 44; 44.1; 44.2 extending in the axial direction of the forme cylinder 06, however it can also correspond to only a part, for example, one-half, of the width of the relevant printing unit 44; 44.1; 44.2, so that a plurality of such mobile collecting containers 43, for example two, can be arranged in a row along their respective end surfaces, for example, on the same height-adjustable walkway 49. The respective mobile collecting container 43 arranged on the operating side of the relevant printing unit 44; 44.1; 44.2, on the respective height-adjustable walkway 49, is aligned there with its length l43 parallel to the width of the relevant printing unit 44; 44.1; 44.2, and is preferably locked or fixed in its alignment, by actuation of a brake device, specifically such that the storage bays A43; B43; C43; D43 of the mobile collecting container 43, arranged in a row, are situated opposite the respective axial installation positions on the outer surface of the relevant forme cylinder 06. FIG. 14 shows one of the height-adjustable walkways 49, positioned on the relevant printing unit 44; 44.1; 44.2, at two different heights. Rather than two walkways 49 that can be operated independently of one another between two adjacent printing units 44; 44.1; 44.2, a single walkway 49 to be shared by these two printing units 44; 44.1; 44.2 can also be provided. If at least one of the two halves of at least one of the two adjacent printing units 44; 44.1; 44.2, i.e., at least the frames 16 thereof, is embodied as individually displaceable horizontally (FIG. 20), it can be provided that the two walkways 49 of these adjacent printing units 44; 44.1; 44.2 are embodied as displaceable above one another or below one another, for example, and therefore arranged in the same vertical plane, in order to avoid a collision during separation of the relevant printing couple halves.

The compartments 58 of the mobile collecting container 43 can be tiltable or foldable, i.e., adjustable to an angled position, about an axis oriented parallel to the length l43 of the mobile collecting container 43, at least in the transport path thereof from the plate line to the relevant printing unit 44; 44.1; 44.2, for example, by means of a mechanical or pneumatic device, for example, actuated by the movement of the mobile collecting container 43, to allow them to accommodate the printing formes 01 to be stored in the compartments 58, which formes may have a greater length L (FIG. 1) than the width of the mobile collecting container 43, fully within the interior of the respective mobile collecting container 43, at least in the transport path from the plate line to the relevant printing unit 44; 44.1; 44.2, for example.

Figure 15:
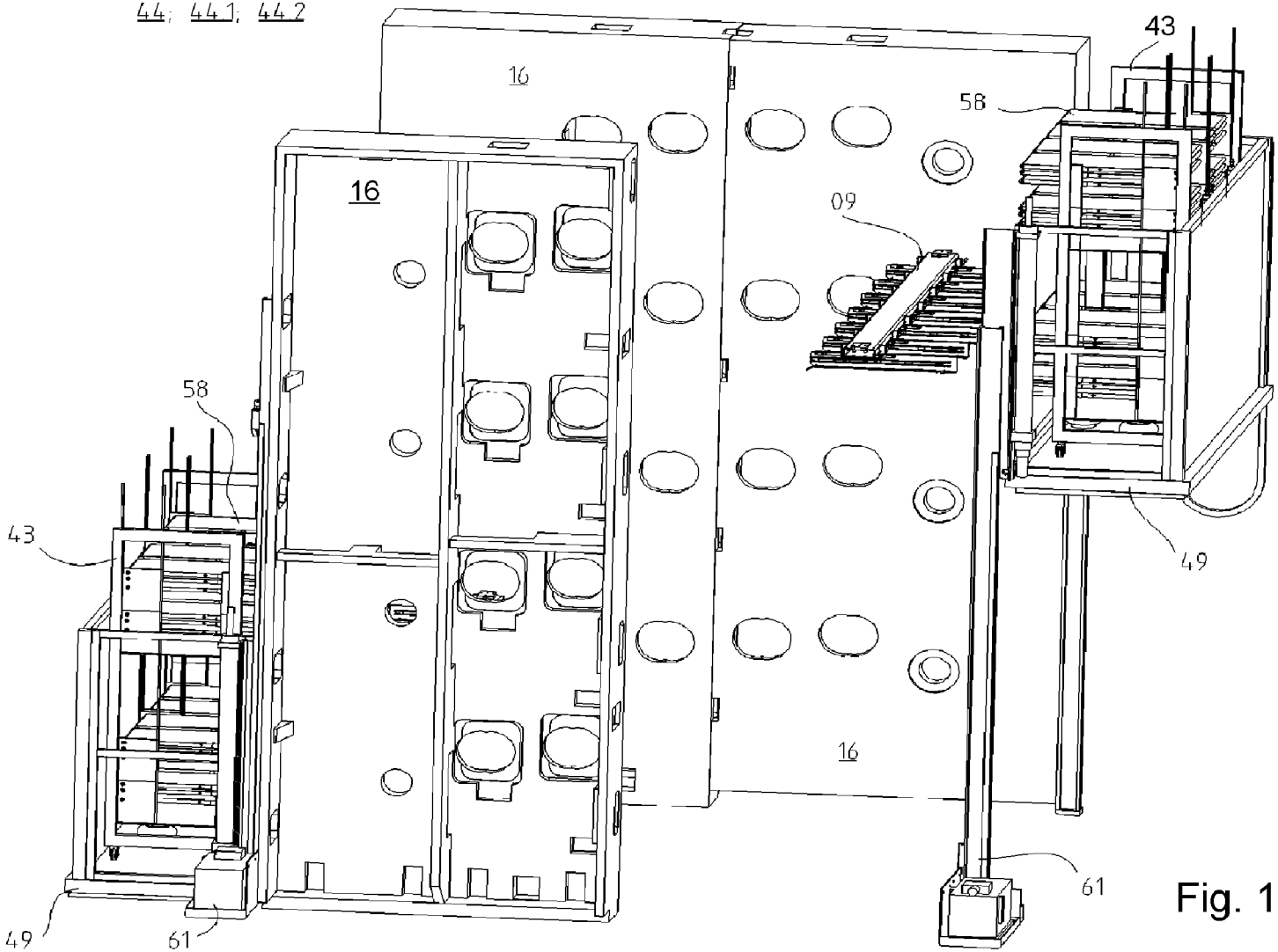
FIG. 15 a perspective view of a part of a printing unit with height-adjustable walkways attached to both of its operating sides.

FIG. 15 shows a perspective view of a part of the frame 16 of a printing unit 44; 44.1; 44.2 preferably embodied as an eight-couple tower, with four forme cylinders 06 arranged vertically, one above the other, on each of its two operating sides, and with height-adjustable walkways 49 attached on the two operating sides thereof, wherein the eight printing couples arranged between the frame walls are not shown here for purposes of clarity. On each of the two walkways 49 of said printing unit 44; 44.1; 44.2, which is substantially symmetrical in structure with respect to the transport plane of the print substrate 18, one of the mobile collecting containers 43 is positioned, as is illustrated by way of example in FIGS. 12 and 13. The height of each of these two walkways 49 can be adjusted separately and independently of the respective other walkway 49 by means of a lifting device 61 assigned specifically to said walkway and having a drive, and can thereby be adjusted to different heights along the height of the printing unit 44; 44.1; 44.2.

Figure 16:
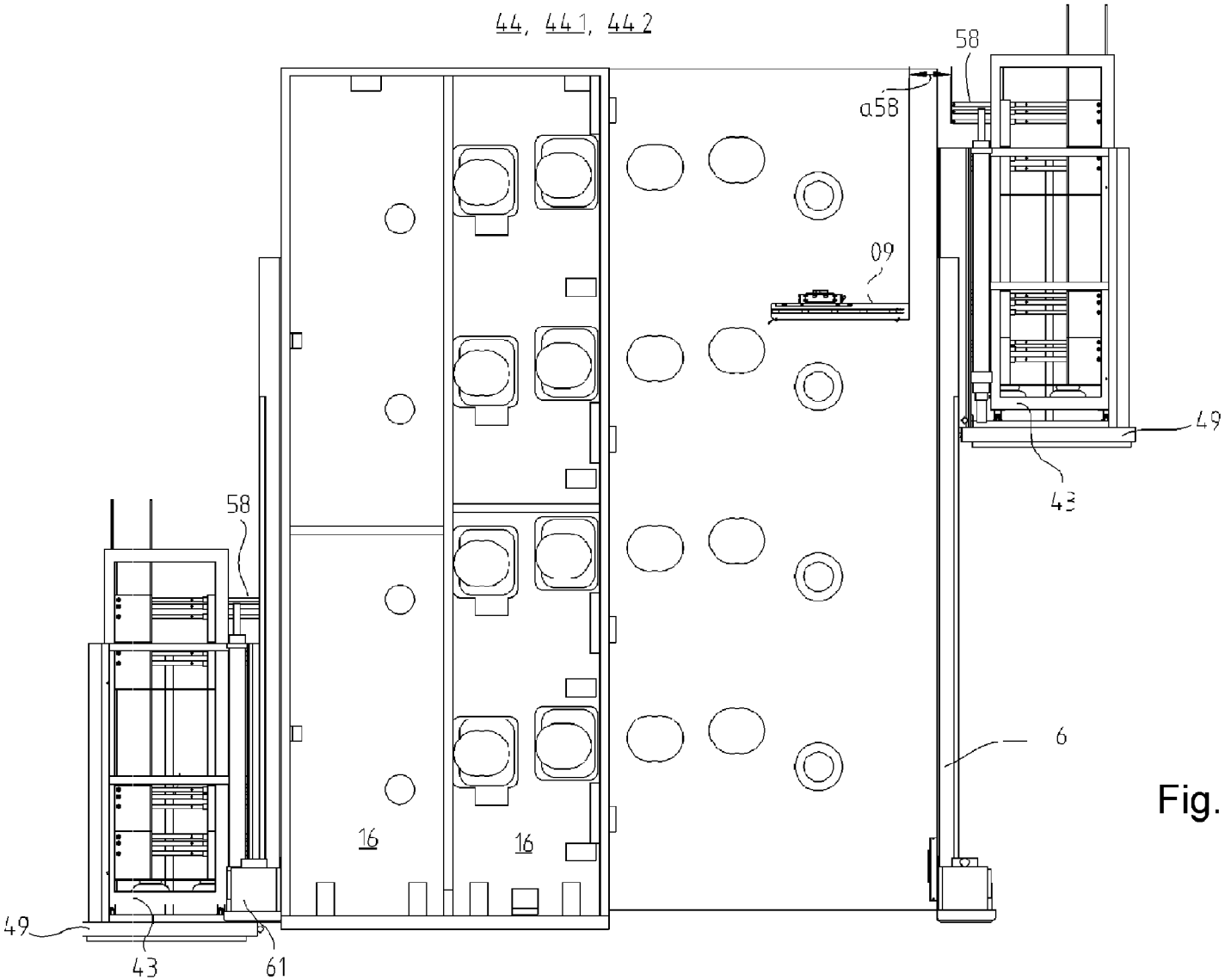
FIG. 16 a side view of the printing unit illustrated in FIG. 15.

In FIGS. 15 and 16, the total of eight printing forme magazines 09 in this example of an eight-couple printing tower, arranged between the walls of the frame 16 which are opposite one another in pairs, and assigned to the respective forme cylinders 06, are suggested by the illustration of only one of said printing forme magazines 09 (FIGS. 2 and 8), wherein the illustration of the depicted printing forme magazine 09 is also highly simplified. In any case, the four printing forme magazines 09, arranged one above the other, of the left half of the printing unit 44; 44.1; 44.2 shown in FIGS. 15 and 16 are concealed by a frame wall situated in the foreground of the drawing. The mobile collecting container 43 arranged on the respective walkway 49 is moved to a height on the relevant operating side of the relevant printing unit 44; 44.1; 44.2 using the relevant lifting device 61, at which height compartments 58 of the mobile collecting container 43 that are assigned to a specific plane are able to enter into a functional connection with printing forme magazines 09 that are arranged at a specific height, side by side in the axial direction of the respective forme cylinder 06, on the relevant operating side of said printing unit 44; 44.1; 44.2, for the purpose of an automatic change of printing formes 01. The compartments 58 arranged at fixed positions in terms of their respective heights in the mobile collecting container 43 are therefore adjusted to a height, which can be selected on the relevant operating side of the printing press, by lifting the walkway 49 that supports said mobile collecting container 43. This situation is illustrated again in FIG. 16 in a side view of the relevant printing unit 44; 44.1; 44.2 along with its two walkways 49. The printing forme magazines 09 in the relevant printing unit 44; 44.1; 44.2 are each arranged fixed in the frame, that is, stationary, specifically in the immediate vicinity of the respective forme cylinder 06 to which they are assigned, wherein immediate vicinity means that a printing forme 01 to be exchanged between the respective printing forme magazine 09 and the forme cylinder 06 to which it is assigned projects, during its conveyance out of the relevant printing forme magazine 09 or into said magazine, with its first end 03 into the relevant printing forme magazine 09, and the other, second end 04 of said printing forme 01, spaced from the first end 03 by the length L (FIG. 1), is still or already in contact with the relevant forme cylinder 06. The compartments 58 of the respective mobile collecting container 43 are adjusted to a height that matches that of the relevant printing forme magazine 09. A change of at least one printing forme 01 between the relevant mobile collecting container 43 and the printing forme magazine 09 chosen on the basis of the height can then be carried out, for example, initiated by a control command issued remotely, for example, from the control console of the printing press.

Figure 17:
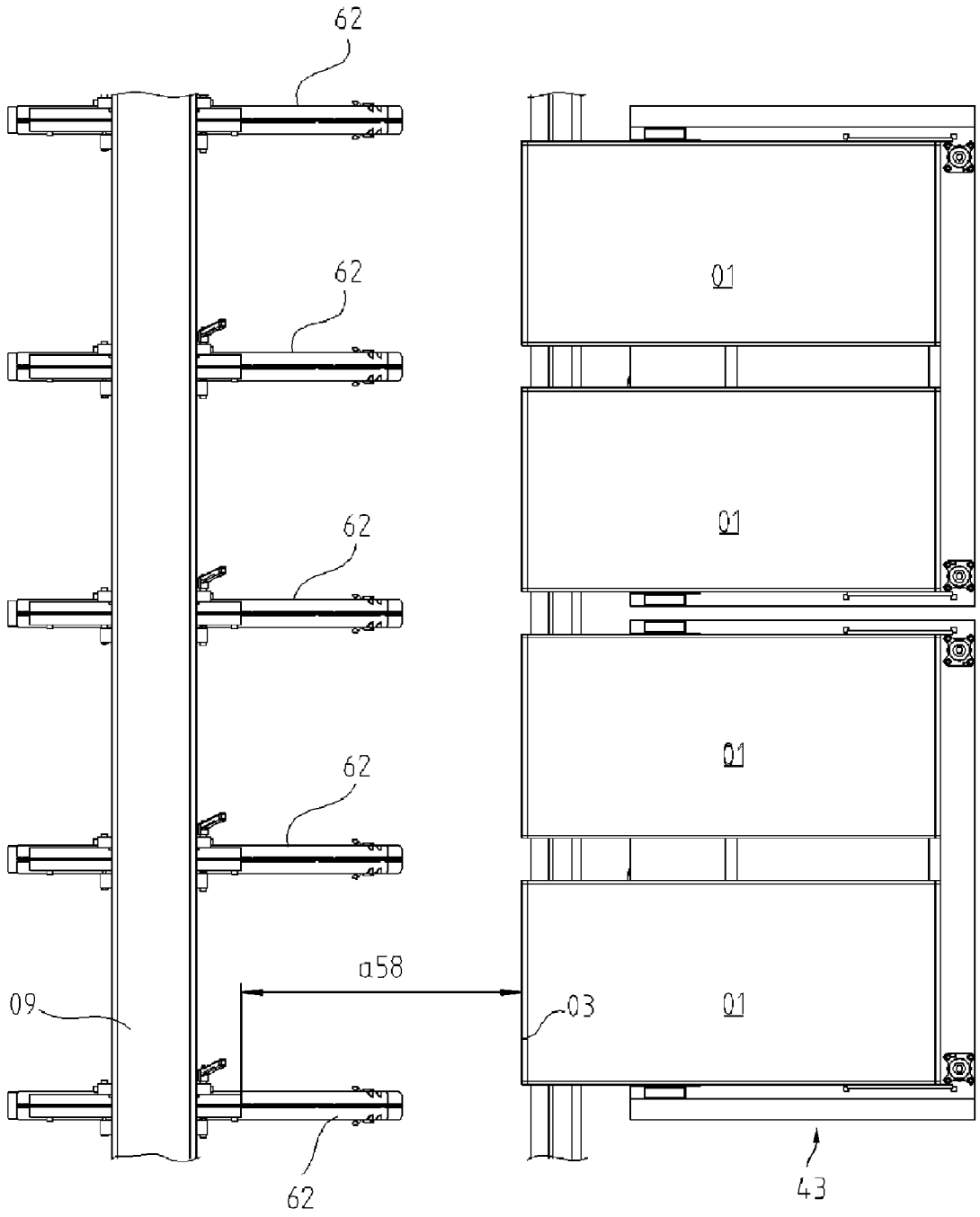
FIG. 17 a plan view of a printing forme magazine interacting with compartments of a mobile collecting container.

FIG. 17 shows a plan view of a printing forme magazine 09, as can be installed in a printing unit 44; 44.1; 44.2, for example, according to one of FIG. 2, 8, 15 or 16, in cooperation with compartments 58 of the mobile collecting container 43, which has been moved up to the relevant operating side of the printing unit 44; 44.1; 44.2, wherein said mobile collecting container 43 with its storage bays A43; B43; C43; D43 is positioned along the printing forme magazine 09 in such a way that said storage bays A43; B43; C43; D43 are opposite storage positions arranged side by side in the axial direction of the forme cylinder 06. At least one of said storage bays A43; B43; C43; D43 is positioned opposite at least one of the storage positions of the printing forme magazine 09 at an at least nearly matching height at a horizontal distance a58 (FIG. 16), in such a way that at least one printing forme 01 stored in a compartment 58 of one of the storage bays A43; B43; C43; D43 can change from the relevant compartment 58 to the storage position of the printing forme magazine 09 that is opposite said compartment 58, by means of a linear, particularly horizontal, movement directed orthogonally toward the operating side of the printing unit 44; 44.1; 44.2. This change of at least one printing forme 01 out of one of the compartments 58 of the mobile collecting container 43 to a storage position of the printing forme magazine 09, or vice versa, is preferably initiated by remote actuation, for example, at the control console of the printing press. The horizontal distance a58, at which a compartment 58 of the mobile collecting container 43 is positioned opposite a corresponding storage position of the printing forme magazine 09, is shorter than the extended length L (FIG. 1) of the ready-to-use printing forme 01 that is to be changed, so that in this case as well, a printing forme 01 to be exchanged between the respective compartment 58 of the mobile collecting container 43 and the relevant printing forme magazine 09 extends, during its conveyance out of the relevant compartment 58 of the mobile collecting container 43 or into the same, with its first end 03 projecting into the relevant printing forme magazine 09, and the other, second end 04 of said printing forme 01, spaced from the first end 03 by the length L (FIG. 1), still or already in contact with the relevant compartment 58 of the mobile collecting container 43.

In one preferred embodiment, multiple or even all printing formes 01, each assigned to different storage positions of the printing forme magazine 09 arranged side by side, can be changed, i.e., replaced, simultaneously, with the corresponding compartments 58 arranged in different storage bays A43; B43; C43; D43 of the mobile collecting container 43. In one particularly preferred embodiment, compartments 58 of the mobile collecting container 43 arranged in different horizontal planes are spaced from one another in pairs along a height H of said collecting container 43, at a vertical distance H1; H2 (FIG. 13), in such a way that a change of printing formes 01 stored in said compartments 58, each compartment being arranged at the vertical distance H1; H2, in printing forme magazines 09 arranged in the frame 16 of the relevant printing unit 44; 44.1; 44.2 at the same vertical distance H1; H2 (FIG. 2; 14), or the storage positions thereof, can be carried out simultaneously, i.e., synchronized. The distance H1 is generally the same as the distance H2.

FIG. 17 shows the operational status of a preferably simultaneous transfer of a plurality of printing formes 01, which are stored or will be stored in the same horizontal plane in different compartments 58 arranged side by side in a row of the mobile collecting container 43, to or from storage positions of the printing forme magazine 09, arranged side by side and corresponding with said compartments 58. To carry out the transfer of said printing formes 01 from the mobile collecting container 43 to the printing forme magazine 09, or vice versa, gripper devices 62 are preferably provided on the printing forme magazine 09, assigned to the respective storage positions of said printing forme magazine 09, which gripper devices, via remote actuation, grip the printing formes 01 stored in different, side-by-side compartments 58 of the mobile collecting container 43, preferably at the leading end 03 of said formes (FIG. 1), and move these formes into the respective storage positions of the printing forme magazine 09, for example, by pulling, or, in the inverse direction of conveyance, pushing said formes out of the respective storage positions of the printing forme magazine 09 into the corresponding compartments 58 of the mobile collecting container 43. The respective gripper device 62, which grips the respective printing forme 01, for example, in a positive connection or a non-positive connection, is disposed, for example, in a linear guide and can be moved out at least the distance a58 between the relevant printing forme magazine 09 and the leading end 03 of the respective printing forme 01. The respective gripper device 62 is embodied, for example, in connection with the conveyor device 80 (FIG. 24), which conveys at least one printing forme 01 stored in the relevant printing forme magazine 09 out of said printing forme magazine 09 to the relevant forme cylinder 06.

In the preferred embodiment, the mobile collecting container 43 has no drives which drive the respective gripper device 62 and are therefore used for conveying at least one printing forme 01 from the mobile collecting container 43 to the printing forme Magazine 09, or vice versa. The mobile collecting container 43 is loaded, preferably automatically, at the output of the plate line, particularly at the storage device 51, with printing formes 01, which are presorted for the respective installation positions on the relevant forme cylinder 06 on the basis of their respective codes, and is then transported by hand or preferably automatically to the relevant printing unit 44; 44.1; 44.2. At the relevant printing unit 44; 44.1; 44.2, the mobile collecting container 43 is then automatically unloaded, wherein the printing formes 01 stored, presorted, in the mobile collecting container 43 are transferred in the correct position to the respective storage positions of the relevant printing forme magazine 09. Optionally, the mobile collecting container 43 is also reloaded with printing formes 01 from storage positions of the respective printing forme magazine 09, in order to transport printing formes 01 that are no longer required in the printing process, for example, away from the relevant printing unit 44; 44.1; 44.2 and then dispose of them. The mobile collecting container 43 is preferably removed from the walkway 49 of the relevant printing unit 44; 44.1; 44.2 before a start or restart of production thereon. The mobile collecting container 43 is moved, for example, as a component of an automatic transport system up to the relevant operating side of the printing unit 44; 44.1; 44.2. It can also be provided that the movement of the mobile collecting container 43 is controlled from a control console belonging to the printing press.

The result, therefore, is a method for the preferably fully automatic changing of printing formes 01 used in a printing press, wherein printing formes 01 in installation positions of forme cylinders 06 arranged on the same operating side of the printing press, particularly at different heights, are changed preferably synchronized with one another, i.e., simultaneously, wherein a plurality of printing formes 01 that have been produced for a printing process to be executed in said printing press and are ready for use are stored at the output of a plate line, which is arranged spatially separate from the printing press, on the basis of their intended installation positions on one of the forme cylinders 06, separately, each in a specific compartment 58 of the same mobile collecting container 43 having a plurality of compartments 58, wherein said mobile collecting container 43 transports printing formes 01 to be changed together on the same operating side of the printing press, in the presorted storage condition in the compartments 58, unchanged and all at once, i.e., together, to the relevant operating side of the printing press. The printing formes 01 can also be changed simultaneously at a plurality of installation positions arranged side by side in the axial direction of the relevant forme cylinder 06.

In this case, the at least one printing forme 01 to be changed on one of the forme cylinders 06 is stored in a storage position of a printing forme magazine 09 assigned to the relevant forme cylinder 06, and is supplied from said printing forme magazine 09 to the relevant installation position on the forme cylinder 06. A plurality of the printing formes 01 stored, presorted, in the mobile collecting container 43 are transferred simultaneously in the correct position to the respective storage positions of the at least one relevant printing forme magazine 09. Each of the printing formes 01 stored, presorted, in the mobile collecting container 43 is preferably supplied to the respective storage position of said printing forme magazine 09 by means of a gripper device 62 arranged on the relevant printing forme magazine 09.

The assignment of the printing formes 01 to be stored in one of the mobile collecting containers 43 to specific compartments 58 of the relevant mobile collecting container 43 is carried out on the basis of the coding applied to said printing formes 01, ultimately also on the basis of the data provided by the control unit of the production planning system prior to the storage and transport of said printing formes 01, i.e., in the distribution of the printing formes 01 provided in random sequence at the end of the plate line to the plurality of mobile collecting containers 43 waiting there, and for sorting said printing formes 01 into specific compartments 58 of these mobile collecting containers 43, said data form a basis for determining which printing forme 01 is to be stored in which compartment 58 of the selected mobile collecting container 43 comprising a plurality of compartments 58. Accordingly, the data of the production planning system determine the selection to be made from among the ready mobile collecting containers 43 and among the respective compartments 58 of each of said mobile collecting containers 43. For example, for the purpose of control, the storage of the respective printing formes 01 in the correct position in the relevant mobile collecting containers 43 can be displayed on the display device 52, for example (FIG. 9).

A further method for the preferably automatic changing of printing formes 01 used in the printing press, which can likewise be easily implemented in the printing units 44; 44.1; 44.2 of the printing press that are to be loaded with printing formes 01, and which represents an alternative to the method described in reference to FIGS. 11 to 17, will be described in what follows in connection with FIGS. 18 to 39.

A loading device 63, which is embodied, for example, as a robot 63 which is stationarily positioned, for example, or can be guided on a linear gantry, preferably uses its gripper device 64 to grip a produced and ready-to-use printing forme 01, preferably on its unimaged contact surface 02 (FIG. 1), said forme being provided at an output 66, wherein the output 66, which consists, for example, of sliding rails arranged spaced from one another, particularly parallel, is located at the end of a plate line, wherein at least the plate line has at least one plate exposure device 33. However, the plate line can also have a plurality of plate exposure devices 33 that can be used independently of one another—as indicated in FIG. 18—wherein each of said plate exposure devices 33 is also assigned its own robot 63, wherein each robot 63 is embodied as a multi-axis, particularly six-axis, handling apparatus. The plate line preferably also has at least one developing unit 36 and at least one bending unit 38, which units are understood as present, but for purposes of clarity are not shown in FIG. 18; however, reference is made with regard to these to FIG. 7. The ready-to-use printing formes 01 are provided at the output 66 immediately after their respective production, where they are picked up by the robot 63 by means of its gripper device 64. With this method, temporary storage of the printing formes 01 in a storage device 51 belonging to the plate line (FIG. 7) is generally not necessary, and instead, the printing formes 01 are produced as needed only relatively shortly before the pending production run to be executed in the respective printing unit 44; 44.1; 44.2. In connection with the loading device 63, a control device is provided, which checks to ensure that the printing formes 01 are arranged correctly in the mobile collecting containers 43 on the basis of the print order.

It can be provided that a plurality of plate lines, each having at least one plate exposure device 33, are arranged side by side in parallel (FIG. 18), wherein, for example, each of these plate exposure devices 33 is assigned its own robot 63, wherein the robot 63 belonging to the respective plate line, for example, is not stationary, but preferably linearly movable, particularly positionable, for example, on a gantry 65 preferably extending orthogonally to the alignment of the respective plate line, so that the respective robot 63 is able to execute a bidirectional movement, particularly linear movement, in relation to the output 66 at the end of the respective plate line, starting from the reference point of said robot upstream of or in its gripping region. The gantry 65, which in FIG. 18 extends vertically in relation to the plane of the drawing, for example, is embodied as a rail, for example, particularly as a floor rail, for example, with a toothed rod and a drive unit. A handling region of the robot 63 is preferably enclosed within a fence, at least a zone safety device is provided. Each of the robots 63 can be operated by means of a control unit for controlling its respective movement, for example, at different operating speeds, and can therefore be adapted to an operating cycle that is predefined by the respective plate line. More particularly, the operating cycle is defined by the control unit 39 of the plate logistics management system for the control unit of the respective robot 63.

The gripper device 64 of the robot 63 is embodied, for example, as a controllable suction device, which in its actuated operating state holds a printing forme 01 by preferably applying suction to its contact surface 02 or its printing surface (FIG. 1). The robot 63 inserts the at least one printing forme 01, gripped by its gripper device 64, into one of the mobile collecting containers 43 standing ready in the handling region of the robot 63, in which collecting container 43 the respective printing forme 01 is transported to the relevant printing unit 44; 44.1; 44.2 in which it will be used. In the handling region of the robot 63, a plurality of these mobile collecting containers 43 are preferably provided, separately and/or combined into groups, onto which collecting containers 43 the respective robot 63 distributes printing formes 01 provided at the respective output 66 in random sequence, according to specific assignment criteria. In terms of this distribution function, the respective robot 63 has a working output of, for example, 600 or more printing formes 01 per hour. Each of these mobile collecting containers 43 preferably has a plurality of compartments 58, wherein the respective robot 63 sorts each printing forme 01 gripped by it into a specific one of these compartments 58 at least of one specific collecting container 43, on the basis of the installation position of that relevant printing forme 01. A printing forme 01 in panoramic format, gripped by the robot 63, is sorted, for example, into two collecting containers 43 joined to one another at their end surfaces, which requires that these two joined collecting containers 43 are open at their respective end surfaces that face one another for a printing forme 01 that extends across the two collecting containers 43, and are passable at least with respect to the relevant compartments 58. In place of a plurality of single-width printing formes 01, particularly two, which would be mounted on one of the forme cylinders 06 at a plurality of installation positions, particularly two, arranged axially side by side, the printing forme 01 in panoramic format gripped by the robot 63 is inserted into a group comprising a plurality of provided collecting containers 43, particularly two, according to the assignment criteria established for this printing forme 01 embodied in panoramic format. If necessary, a plurality of printing formes 01, each embodied in panoramic format, can also be sorted into the same group of collecting containers 43 according to their respective assignment criteria. A printing forme 01 gripped by the robot 63 is inserted along its length L (FIG. 1), for example, from above, into a compartment 58 of an upright collecting container 43, as indicated in FIG. 18 by arrows. A printing forme 01 gripped by the robot 63, aligned substantially vertically along its length L, can also be inserted laterally, parallel to its width B (FIG. 1), into a compartment 58 of an upright collecting container 43. Preferably, at least one sensing device, particularly a code reader 28, is provided, which code reader 28, in cooperation with a preferably electronic register device, scans a code applied to the relevant printing forme 01, for example, the data matrix code area 22 thereof (FIGS. 3 to 6), thereby registering which printing forme 01 has been inserted into which compartment 58 of which collecting container 43.

The mobile collecting container 43 is preferably transported to the relevant printing unit 44; 44.1; 44.2 automatically, particularly program controlled, for example, rail-mounted, along a guidance system 67. The guidance system 67 can have at least one, preferably a plurality of switching elements, which enable branching off from the transport paths. The speed of transport of the collecting containers 43 along the guidance system 67, for example, is 0.5 m/s or more, for example, between 0.7 m/s and 1.0 m/s. For example, collecting containers 43 that have been emptied at a printing unit 44; 44.1; 44.2 are preferably returned in a transport loop to the handling region of the robot 63. Each of the individual mobile collecting containers 43 is equipped with an identification code, for example, on the basis of which each of said collecting containers 43 is positioned correctly and moved, toward a target, in connection with a control program. Collecting containers 43, which transport at least one printing forme 01 removed from one of the forme cylinders 06, are guided to a parking position which is separate from the plate line or the handling region of the robot 63, for example, i.e., to an unloading station, in order to be unloaded there manually by operating personnel, for example. After being emptied, these collecting containers 43 are also preferably automatically returned to the handling region of the at least one robot 63.

Figure 19:
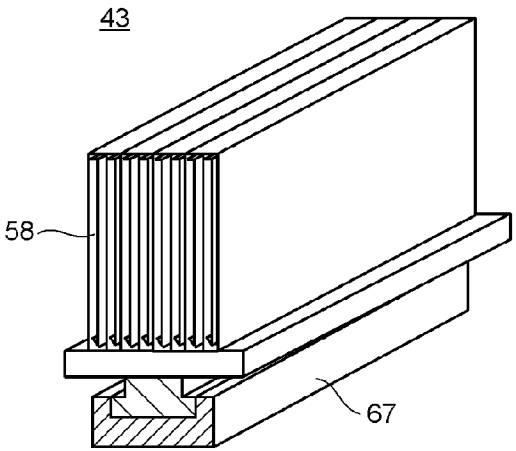
FIG. 19 a perspective illustration of a rail-mounted mobile collecting container having a plurality of compartments for printing formes.

FIG. 19 shows a perspective illustration of one of the mobile collecting containers 43, which along with its compartments 58 is upright and is guided by the guidance system 67, said collecting container having a plurality of separate compartments 58, for example, four, wherein, for example, at least one printing forme 01 is stored in each compartment 58. Each of the compartments 58 can also have a plurality of storage positions, particularly two, so that two printing formes 01 can be stored in each of these compartments 58. The collecting container 43 illustrated in FIG. 19 is closed on its upper side which faces away from the guidance system 67, for example, and is open on at least one end surface which is directed parallel to the direction of transport.

Figure 20:
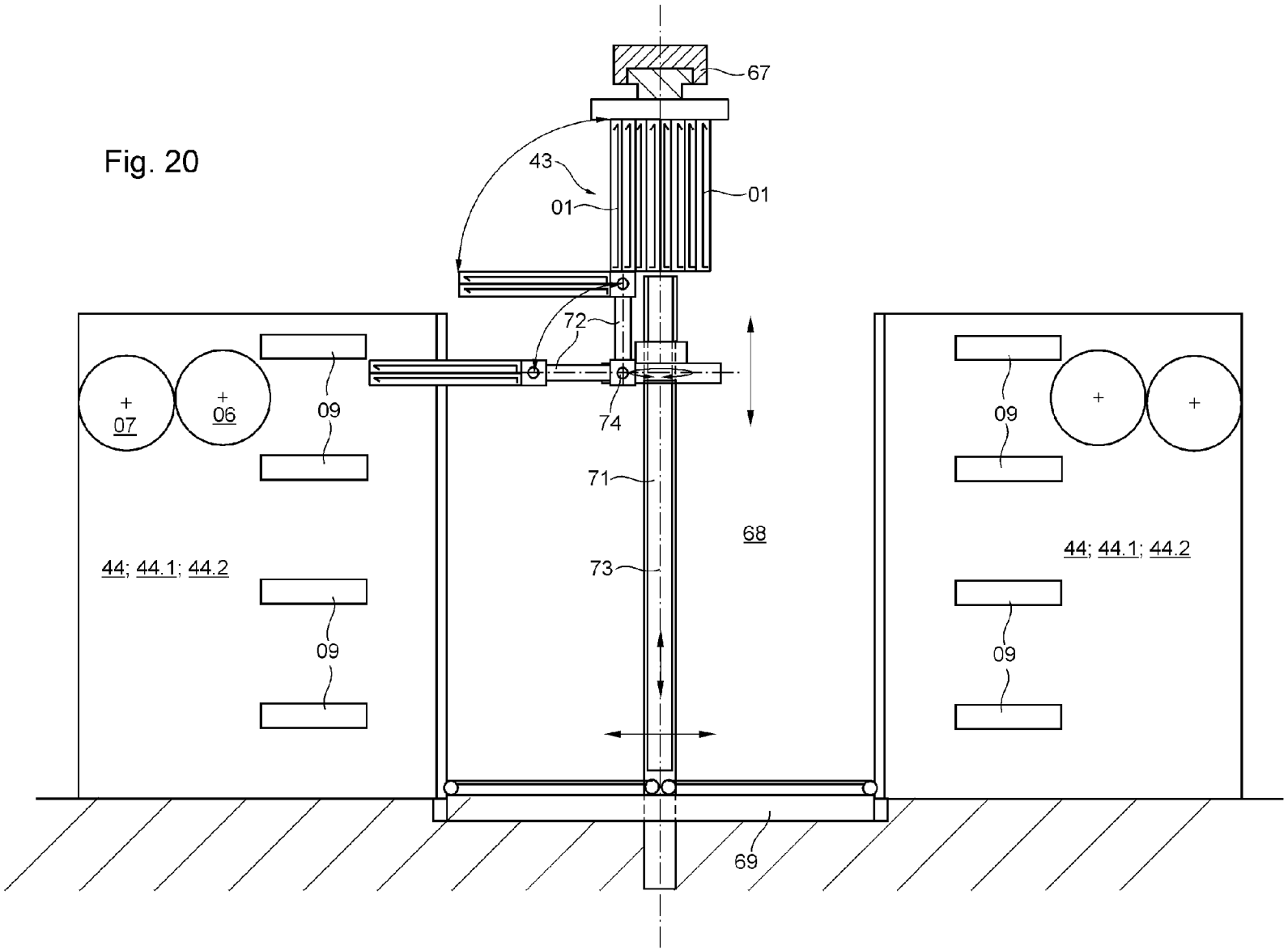
FIG. 20 an illustration of the loading of printing forme magazines of different printing units with printing formes provided in the same mobile collecting container.

FIG. 20 shows a schematic and highly simplified illustration of two printing units 44; 44.1; 44.2, with only one-half of each shown, arranged side by side in the same plane, as were described in connection with FIG. 2, 8 and/or 14, for example. The illustrated halves of the two printing units 44; 44.1; 44.2, which can be part of the same or of different printing presses or of different sections of the same printing press, are spaced from one another by an interstice 68, wherein, however, their respective operating sides, extending axially parallel to their respective printing couple cylinders 06; 07, are arranged facing one another. Preferably centered in the interstice 68 between the two halves of the relevant printing units 44; 44.1; 44.2, a lifting device 71, for example, which can be retracted into a base plate 69, is arranged, wherein the base plate 69 can be located at the level of the base 17 (FIG. 2) of the printing units 44; 44.1; 44.2. A preferably remotely controllable vertical movement of this lifting device 71 is indicated in FIG. 20 by a vertical double arrow. The vertical movement that can be executed by this lifting device 71 extends along a path, which preferably extends at least over the entire height of the printing units 44; 44.1; 44.2, which are embodied as at least nearly equal in height. As an alternative to positioning the lifting device 71 in an interstice 68 between printing units 44; 44.1; 44.2 spaced from one another, said device can also be arranged in allocation to only a single operating side of only one printing unit 44; 44.1; 44.2.

At its upper end, the lifting device 71 has a gripper device 72, which is rotatable, for example, swivelable, about a horizontal axis 74 which extends parallel to the operating side of the relevant printing unit 44; 44.1; 44.2, with which gripper device 72 one or more printing formes 01 provided in at least one of the collecting containers 43 can be removed from the relevant collecting container(s) 43 and supplied to a selected printing forme magazine 09 arranged in one of the relevant printing units 44; 44.1; 44.2. In the embodiment example illustrated in FIG. 20, the relevant collecting containers 43 are preferably provided above the relevant printing units 44; 44.1; 44.2 on the guidance system 67, for example, suspended therefrom. The swiveling movement of the gripper device 72 belonging to the lifting device 71 is indicated in FIG. 20 by an arc. It is preferably provided that either the gripper device 72 alone or the lifting device 71 in its entirety can also execute horizontal movement, in order to supply a printing forme 01 gripped by it to the relevant printing forme magazine 09 arranged horizontally in the relevant printing unit 44; 44.1; 44.2, or to remove it therefrom. This horizontal movement is indicated in FIG. 20 by a horizontal double arrow. The gripper device 72 of the lifting device 71 can also be rotatable at least 180° about a vertical axis 73 of the lifting device 71, so that the same gripper device 72 can be used for both printing units 44; 44.1; 44.2 arranged facing one another, in each case for the purpose of exchanging printing formes 01. The gripper device 72 is preferably embodied in connection with a four- or six-axis robot or as a robot of this type, wherein this robot can be movable as needed along a horizontal gantry, in addition to its vertical movement by means of the lifting device 71. The working area surrounding the robot is preferably secured by a housing or a blocking device.

If printing formes 01 for the two printing units 44; 44.1; 44.2 situated opposite one another are to be supplied and provided to different compartments 58 of the same mobile collecting container 43, for example, these printing formes 01 will have been sorted by the robot 63, for example, into said collecting container 43 in different orientations on the basis of their assignment to one of said printing units 44; 44.1; 44.2, i.e., each of the printing formes 01 will have been sorted into the collecting container 43 in such a way that the contact surface 02 (FIG. 1) of the respective printing forme 01 provided vertically suspended in or at the interstice 68 is arranged facing the operating side of the printing unit 44; 44.1; 44.2, for example, in which the respectively predefined installation position for the relevant printing forme 01 is located. In the preferred embodiment, each of the printing formes 01 provided suspended vertically, for example, along their length L, in one of the collecting containers 43 in or at the interstice 68 has been sorted into the relevant collecting container 43 with its leading end 03 in the direction of production (FIG. 1) pointing toward the guidance system 67. In or at the interstice 68 between the two halves of adjacent printing units 44; 44.1; 44.2, a plurality of mobile collecting containers 43 can also preferably be provided adjacent to one another in a row, parallel to the respective operating side of said printing units 44; 44.1; 44.2, at the same time, wherein, in particular, the same number of collecting containers 43 are arranged in a row as the number of installation positions provided side by side in the axial direction of the forme cylinder 06. In the particularly preferred embodiment, the loading of printing forme magazines 09 with printing formes 01 for installation positions arranged side by side axially on relevant forme cylinders 06 is carried out simultaneously, wherein the gripper device 72 of the lifting device 71 removes printing formes 01 assigned to these installation positions together from collecting containers 43 arranged in a row. Therefore, although the individual collecting containers 43 can be transported individually and at different times to the respective operating side of one of the printing units 44; 44.1; 44.2, it is also possible for all printing formes 01 belonging to installation positions arranged side by side to be removed simultaneously and together from the relevant collecting containers 43.

Figure 23:
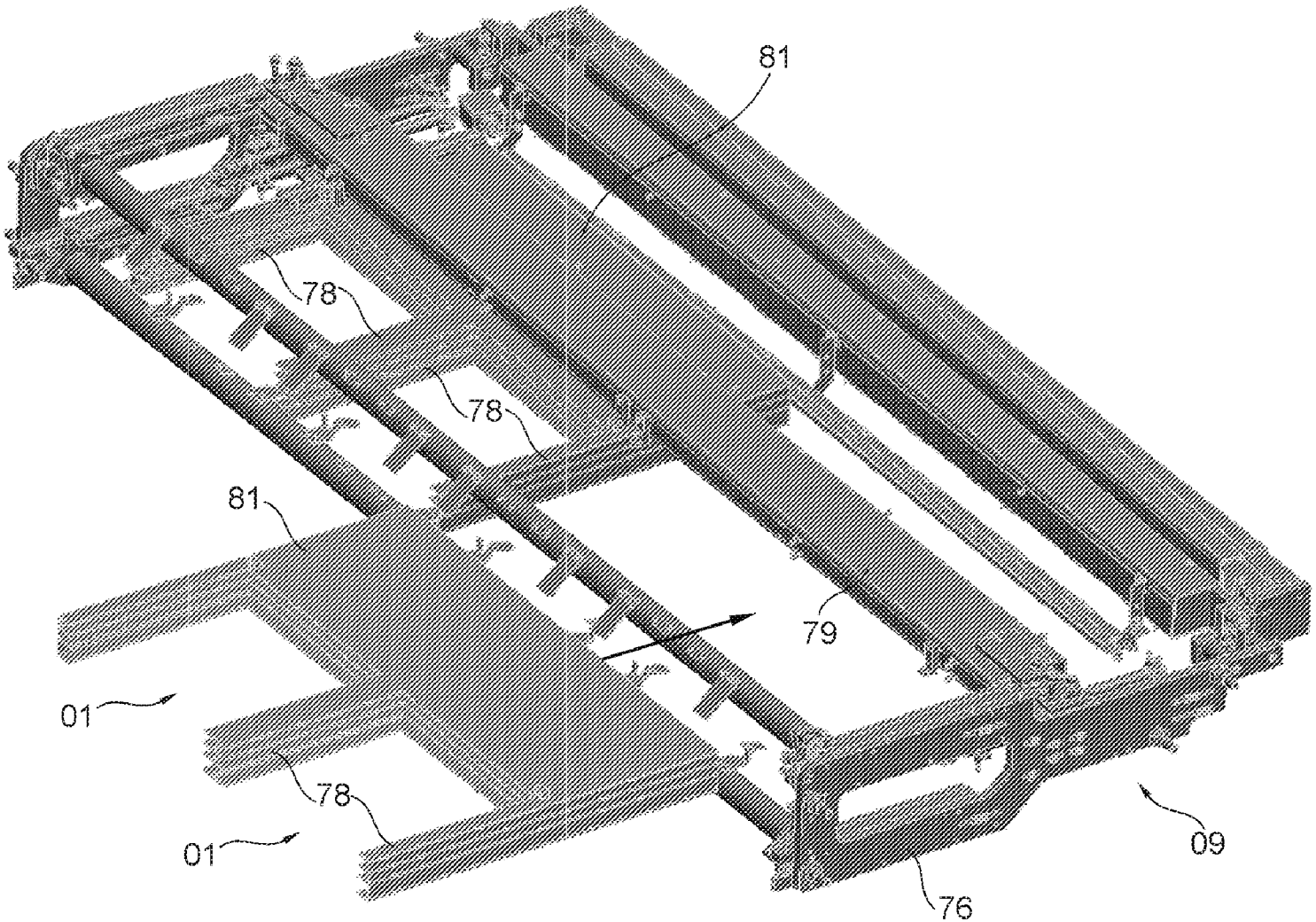

Rather than gripping individual printing formes 01 transported in the respective collecting containers 43, the gripper device 72 of the lifting device 71 can also grip at least one of the mobile collecting containers 43 as an entire unit, and, for example, swivel about the horizontal axis 74, wherein in this variant, the respective collecting container 43 is embodied as detachable from its guidance system 67, and is particularly detached from the gripper device 72 during the production of a contact connection with the respective collecting container 43. A mobile collecting container 43 detached from the guidance system 67 is inserted, along with the printing formes 01 stored therein, into the relevant printing forme magazine 09, wherein in this case the mobile collecting container 43 is embodied as a replaceable cartridge 81 or as a replaceable magazine 81 (FIG. 23). For example, when at least one printing forme 01 embodied in panoramic format has been transported in a group of mobile collecting containers 43 from the handling area of the robot 63 to the respective printing unit 44; 44.1; 44.2, the gripper device 72 grips and releases this integral group of mobile collecting containers 43 together, so that a plurality of cartridges 81 or replaceable magazines 81 are inserted simultaneously, as part of the same handling process of the gripper device 72, into the printing forme magazine 09 arranged in the respective printing unit 44; 44.1; 44.2 and assigned on the basis of the assignment criteria. In one preferred embodiment, the gripper device 72 of the lifting device 71 always grips and releases an integral group of mobile collecting containers 43 together, specifically all of those collecting containers 43 in which printing formes 01 to be arranged side by side axially on the same forme cylinder 06 are stored, so that in each case, printing formes 01 on the same forme cylinder 06 are replaced or at least can be replaced by rows.

In particular, following an exchange of at least one printing forme 01 between the at least one mobile collecting container 43 and an installation position on the relevant forme cylinder 06, the gripper device 72 of the lifting device 71 removes the relevant at least one mobile collecting container 43 from the printing forme magazine 09, and reconnects it/them with the guidance system 67. In this variant, in which the mobile collecting container 43 is detached from its guidance system 67, the mobile collecting container 43 is open at its end surface that faces the guidance system 67. It can be provided that the mobile collecting container 43 can be embodied, if necessary, as having a different number of compartments 58, and can be expanded from its basic configuration to include additional compartments 58.

Figure 21:
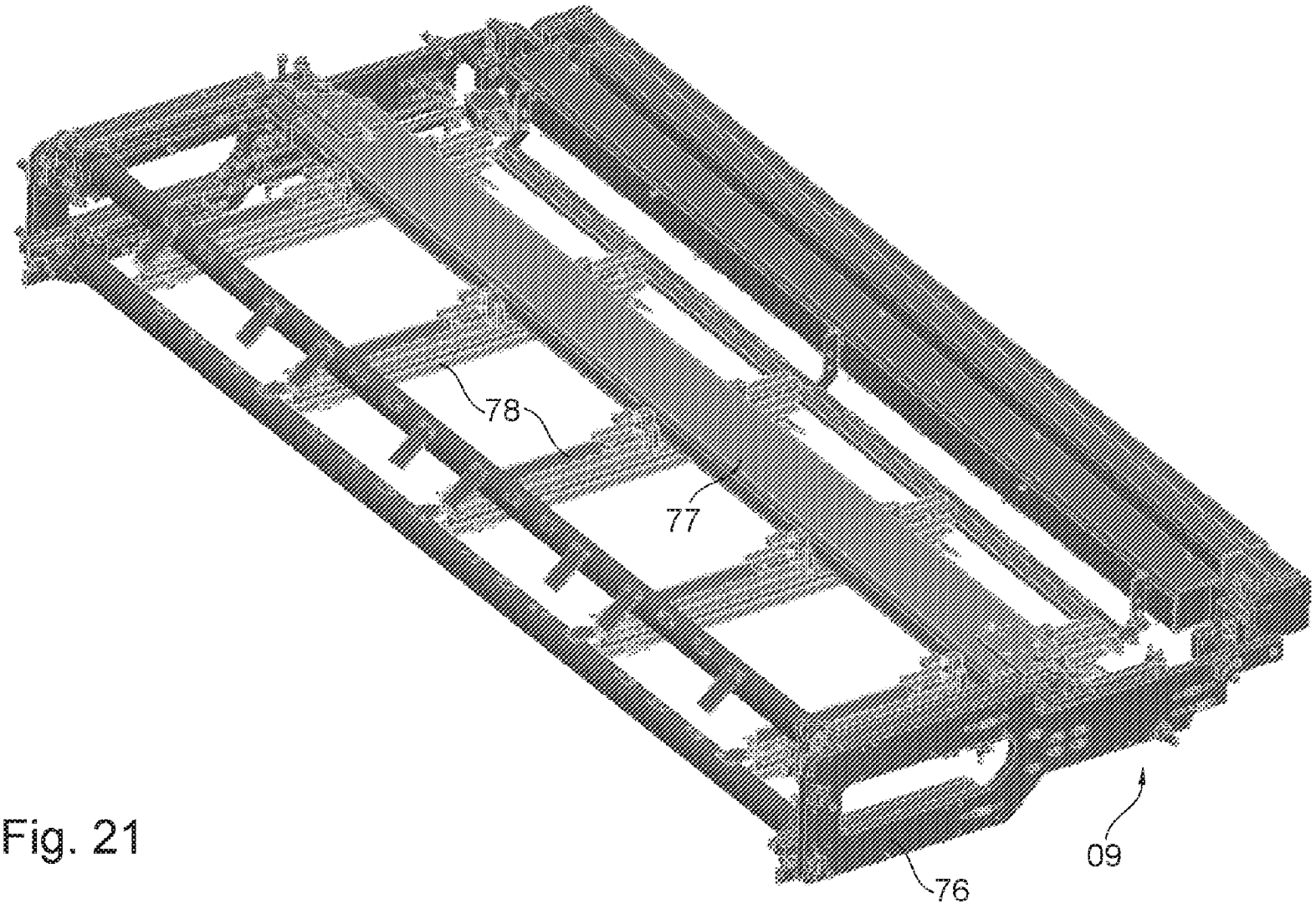
FIGS. 21 to 26 details of the printing forme magazines.

FIGS. 21 to 26 each show a perspective view of additional details relating to one of the printing forme magazines 09 positioned or at least positionable in the respective printing unit 44; 44.1; 44.2, wherein each said printing forme magazine 09 is positioned as stationary, horizontally or with a slight inclination of less than 20°, particularly less than 15°, relative to horizontal in the respective printing unit 44; 44.1; 44.2. FIG. 21 shows a printing forme magazine 09, in which a plate support 77 is detachably arranged within a frame 76, which is fixedly attached or at least attachable in the respective printing unit 44; 44.1; 44.2, wherein in FIG. 22 the plate support 77 is shown as a separate part which has been detached from the frame 76 of the printing forme magazine 09. In this example, the plate support 77 is suitable for accommodating four individual printing formes 01 side by side on guide rails 78 that interact in pairs, i.e., in the state in which the printing forme magazine 09 or at least its frame 76 is installed in the respective printing unit 44; 44.1; 44.2 in the axial direction of the assigned forme cylinder 06. Alternatively, two printing formes 01, each in panoramic format, could be held side by side following the removal of two of the illustrated guide rails 78. The guide rails 78 are preferably embodied such that a plurality of printing formes 01, for example, two, can be held one above the other between a pair of interacting guide rails 78.

Figure 22:
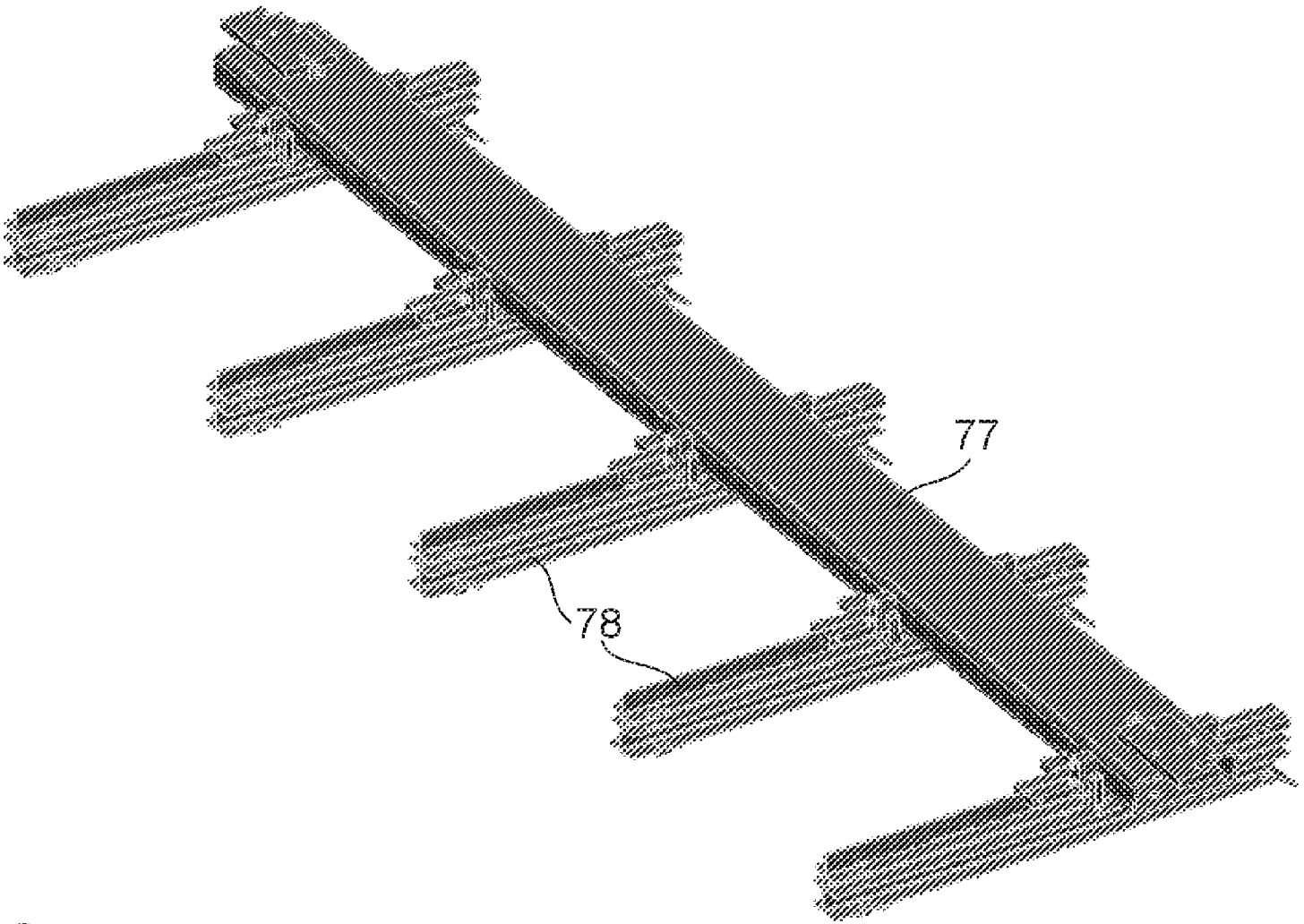

FIGS. 23 to 26 each show a printing forme magazine 09 similar in structure to that of FIGS. 21 and 22, in which, however, rather than a plate support 77, a magazine support 79, again preferably detachable, is provided. The magazine support 79 is suitable for accommodating at least one replaceable magazine 81, but preferably a plurality of replaceable magazines 81, particularly side by side in a row, by insertion thereof into the frame 76 of the printing forme magazine 09, wherein each replaceable magazine 81 is in turn capable of accommodating at least one printing forme 01, but preferably a plurality of printing formes 01, both side by side and one above the other, for example, on guide rails 78 embodied therein and interacting in pairs. The different holding positions in a replaceable magazine 81 correspond in terms of function to the different compartments 58 (FIG. 19) in a mobile collecting container 43. Each of the replaceable magazines 81 can be arranged in one of the mobile collecting containers 43, or the mobile collecting container 43 is embodied in such a way that it can itself be used directly and immediately as one of the replaceable magazines 81. The insertion of printing formes 01 into the respective replaceable magazine 81 and the insertion of the relevant replaceable magazine 81 into the magazine support 79 arranged inside the printing forme magazine 09 are each indicated in FIG. 23 by arrows. Each of the replaceable magazines 81 is then filled with preferably a plurality of printing formes 01 by at least one robot 63, as was described in connection with FIG. 18. The holding positions provided in the relevant replaceable magazine 81 can be provided for different formats of a printing forme 01 at different positions in the relevant replaceable magazine 81, or they are differently embodied within their respective embodiment. In this manner, printing formes 01 of different formats, i.e., of different lengths L and/or widths B (FIG. 1), can be transported using the same transport system without adjustment thereof. It is necessary only to use different replaceable magazines 81, i.e. replaceable magazines 81 having holding positions that are positioned differently or embodied differently for the respective printing formes 01. More particularly, in the same replaceable magazine 81, in preferably each of the compartments 58 thereof, either two single-width printing formes 01 side by side or one printing forme 01 in panoramic format can be transported, wherein a single-width printing forme 01 refers to a printing forme 01 for imaging a single newspaper page in broadsheet format. A replaceable magazine 81 having a plurality of compartments 58 can also be loaded differently with printing formes 01 in its respective compartments 58. For example, two single-width printing formes 01 can be arranged in one compartment 58 of the replaceable magazine 81, while a double-width printing forme 01 is inserted into a different compartment 58 of the same replaceable magazine 81. Printing formes 01 stored in compartments 58 of the replaceable magazine 81 arranged one above the other are supplied to the forme cylinder 06 in sequence, where they are arranged one in front of the other in the circumferential direction of said forme cylinder 06.

Figure 24:
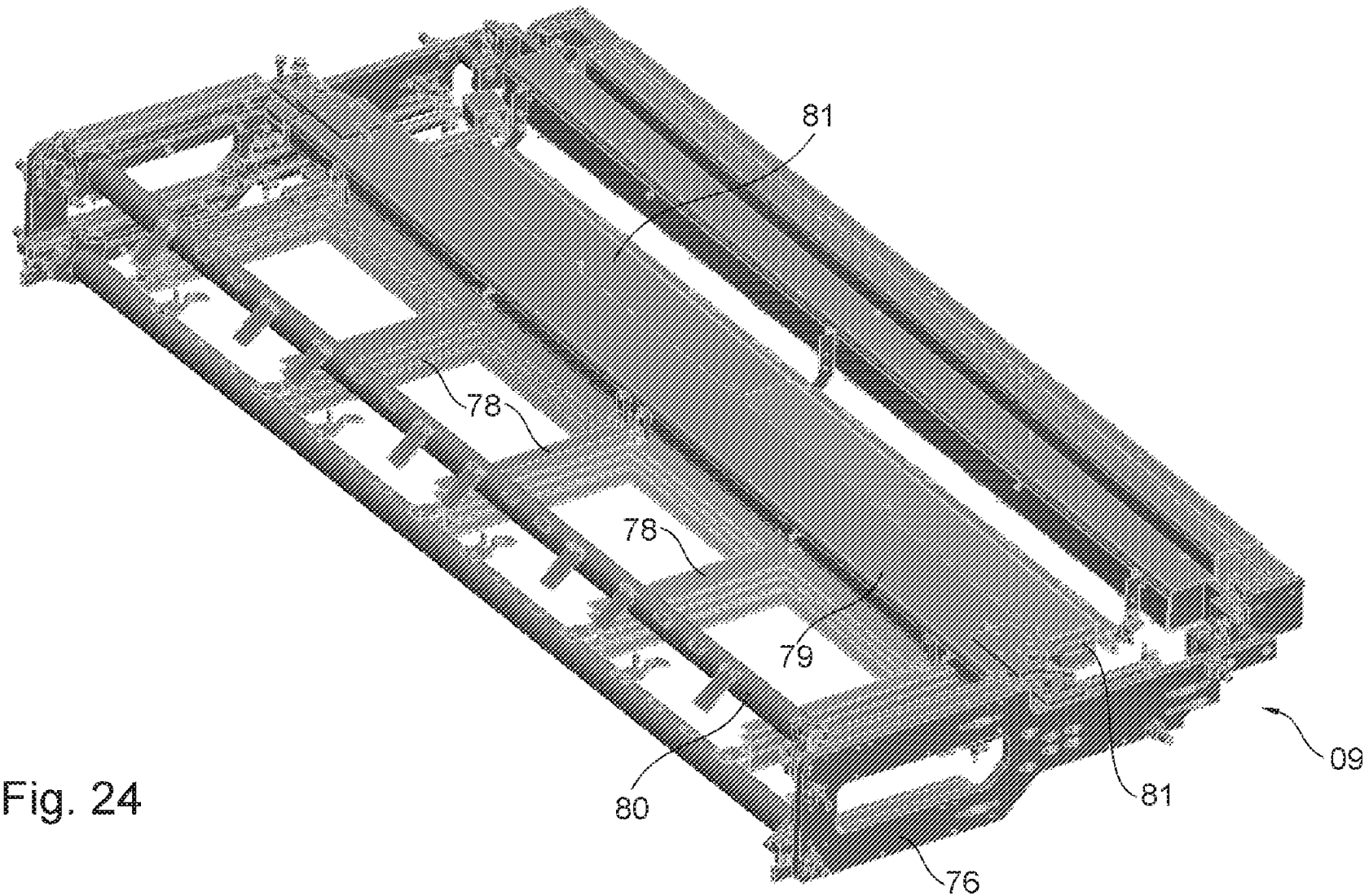

FIG. 24 illustrates the operating state in which two replaceable magazines 81 are arranged side by side on the same magazine support 79 in the same printing forme magazine 09. The printing forme magazine 09 is in turn stationarily positioned in the respective printing unit 44; 44.1; 44.2, horizontally or at a slight inclination of less than 20°, particularly less than 15°, relative to horizontal. Each replaceable magazine 81 is preferably capable of accommodating a plurality of printing formes 01, both side by side and one above the other, on the guide rails 78 provided for this purpose, i.e., in the respective compartments 58 arranged at different levels. The printing forme magazine 09 comprises at least one conveyor device 80 for conveying individual printing formes 01, for example, linearly, at least to the forme cylinder 06, and optionally for use in the reverse direction, i.e., for removing printing formes 01 that are no longer needed on the forme cylinder 06. In the printing forme magazine 09, two conveyor devices 80 are preferably provided, each of which acts with a slide element, for example, over the entire width of the printing forme magazine 09. Also shown are a register device 132 and a contact pressure device 139; for example, a roller strip 139 is shown, which devices will be specified in greater detail in reference to FIGS. 44 and 45. The register device 132 and the roller strip 139 can be arranged on the frame 76 of the printing forme magazine 09, particularly detachably fastened thereto.

Figure 25:
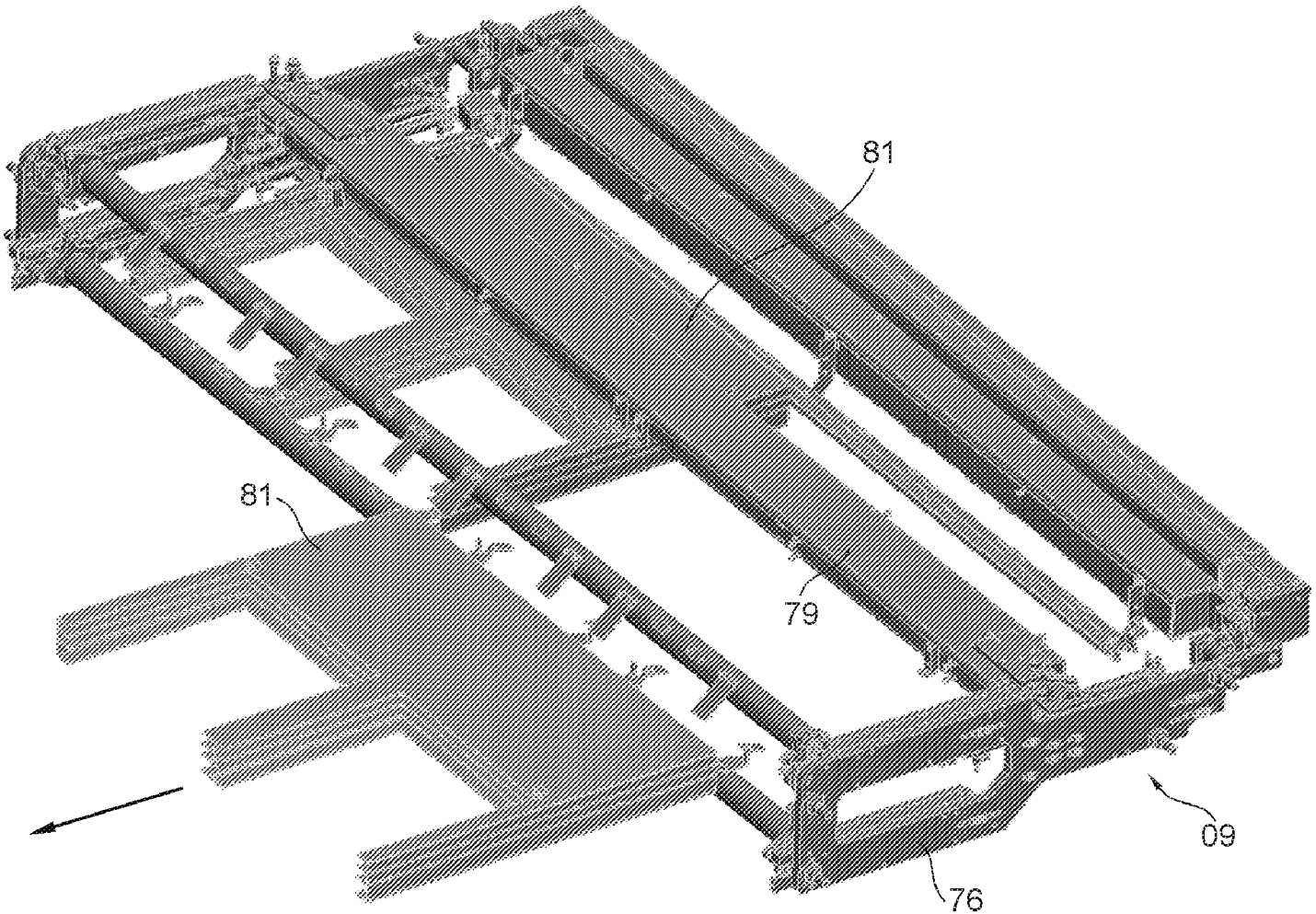
Figure 26:
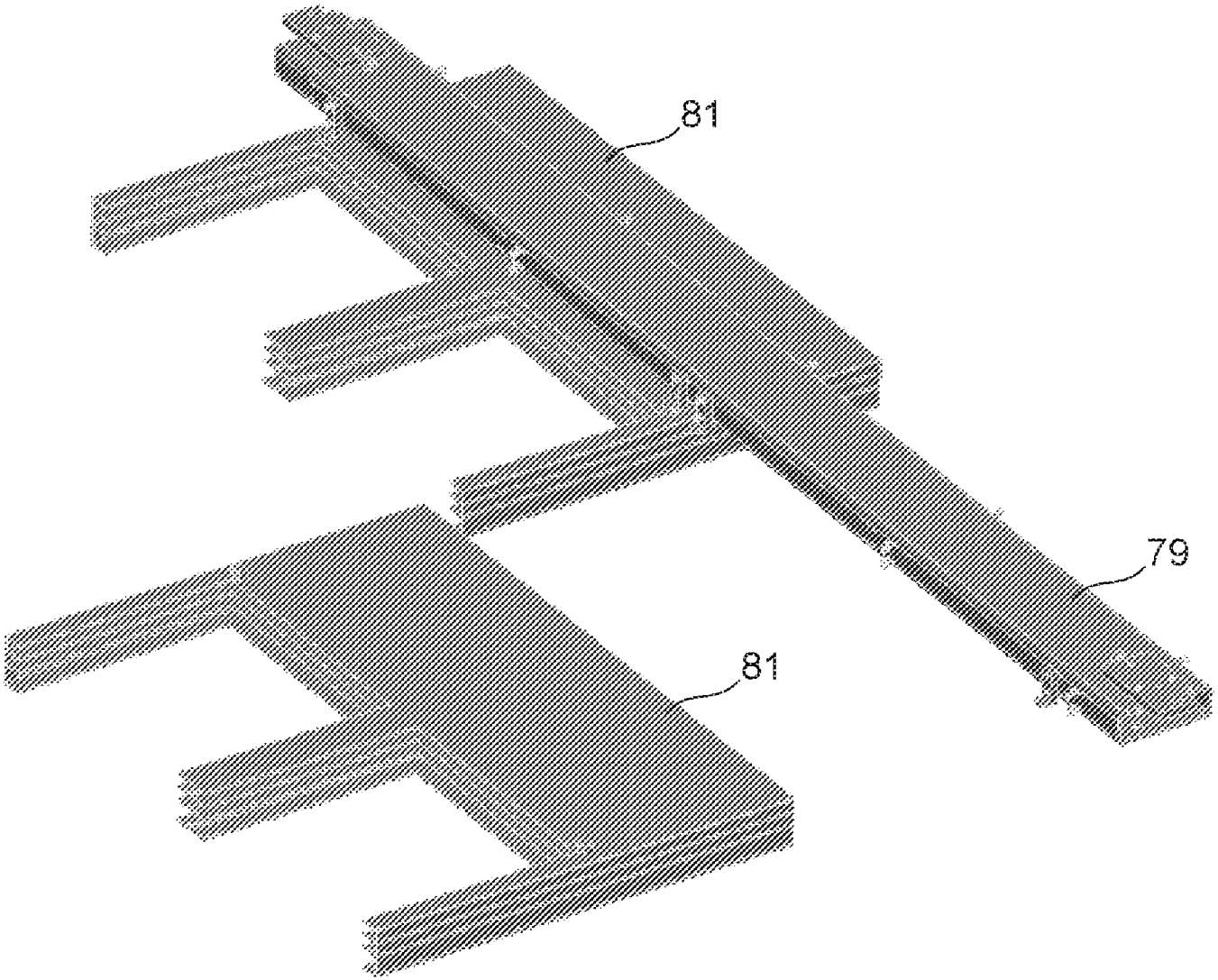

FIG. 25 illustrates the removal of one of the replaceable magazines 81 from the printing forme magazine 09 shown in FIG. 24, as is indicated by an arrow. FIG. 26 shows the magazine support 79 detached and removed from the printing forme magazine 09 as a separate part, wherein one of the replaceable magazines 81 it is capable of holding is still located on the magazine support 79 while another is shown detached from said magazine support 79. Each of the replaceable magazines 81 is arranged in the relevant printing forme magazine 09, aligned with the respective forme cylinder 06, and is held fixed in position by a least one locking device, which at least one locking device is activated by the insertion of the respective replaceable magazine 81 into the relevant printing forme magazine 09 and is deactivated for the removal of said replaceable magazine 81 from the relevant printing forme magazine 09. The activation and/or deactivation of the respective locking device is triggered, for example, by the gripper device 72 of the lifting device 71 which has gripped or intends to grip the respective replaceable magazine 81.

Figure 27:
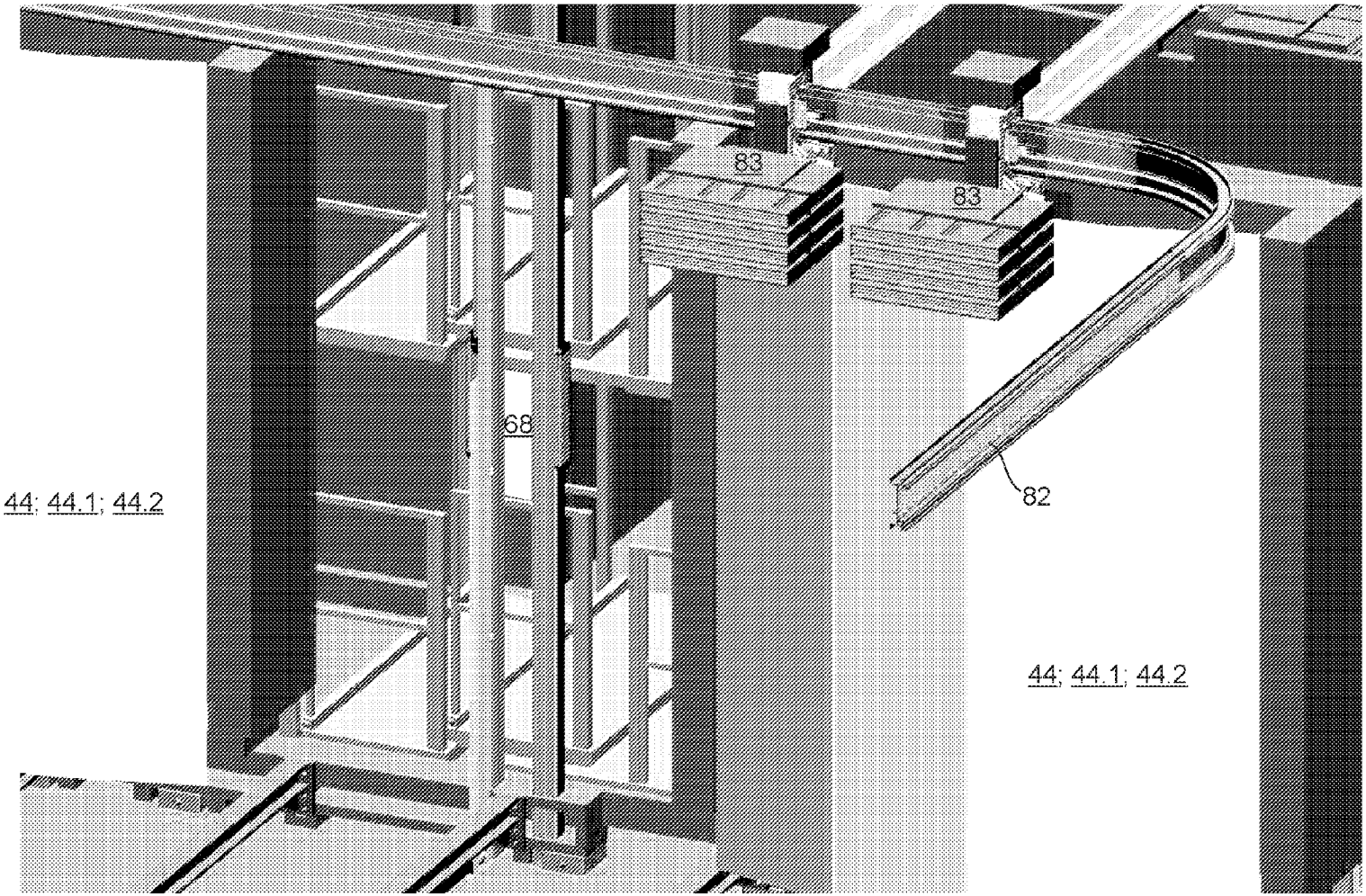
FIGS. 27 to 35 details of a transport system for transporting printing formes.
Figure 28:
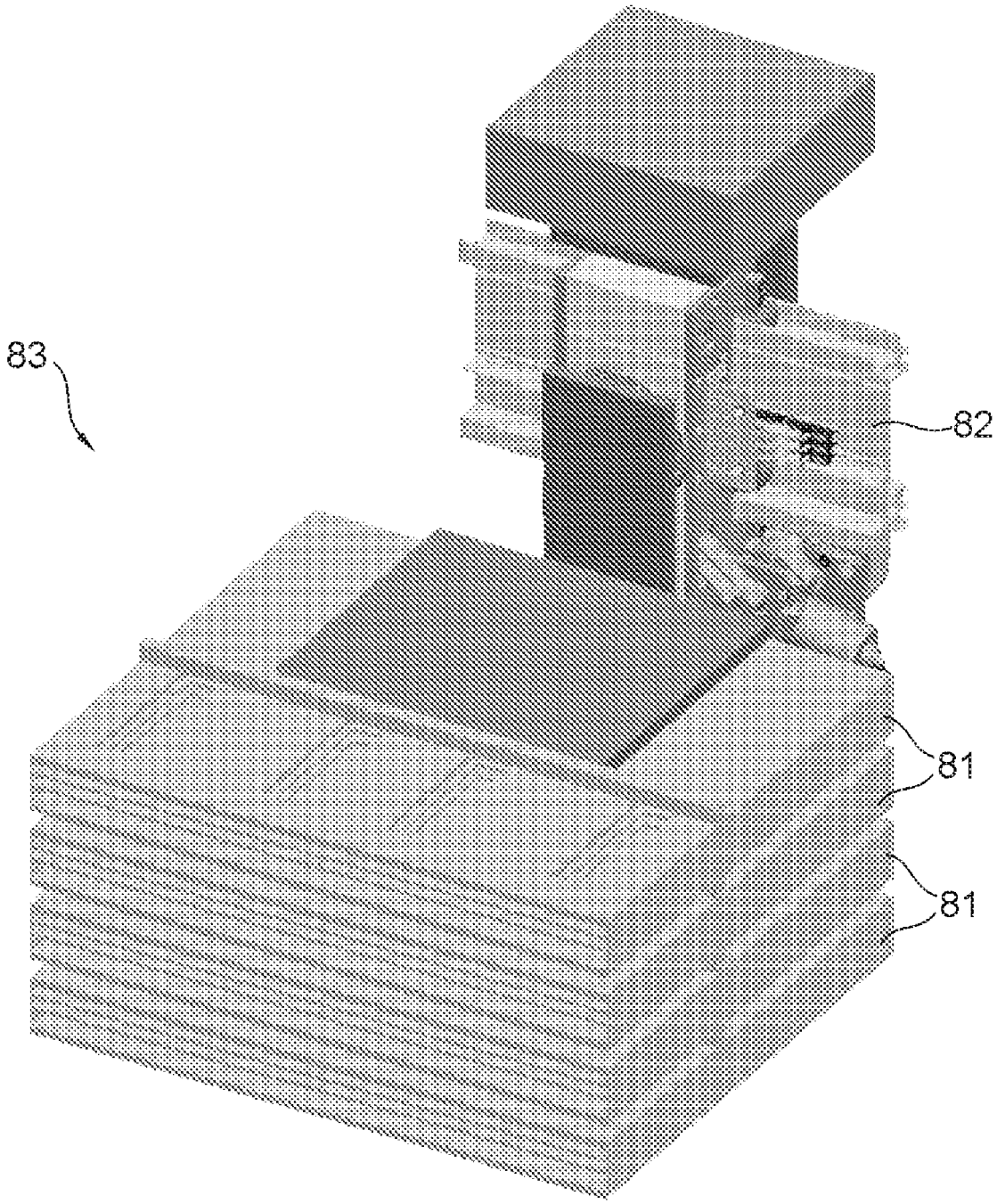

FIGS. 27 to 35 show further perspective illustrations, by way of example, of details of a transport system that uses a guidance system 67, by means of which transport system the mobile collecting containers 43, each of which is embodied, for example, as a replaceable magazine 81, are transported from at least one plate line to the respective printing units 44; 44.1; 44.2. FIG. 27 shows a rail 82, along which at least one transport vehicle 83, but preferably a plurality of transport vehicles 83, are guided or at least guidable. In the example shown in FIG. 27, the rail 82 is embodied as a ceiling rail 82, along which two transport vehicles 83, for example, in close sequence, for example, coming from one plate line are guided to at least one of a plurality of printing units 44; 44.1; 44.2 of a printing press. A transport carriage or support system 84 of the transport vehicle 83 is therefore always guided next to the rails 82. For details on these printing units 44; 44.1; 44.2, reference is made, for example, to FIG. 2, 8 or 20. These transport vehicles 83 can be parked particularly in specially designated parking positions, for example, on or in an interstice 68 between adjacent printing units 44; 44.1; 44.2, particularly in preparation for a new production run on one of the printing units 44; 44.1; 44.2. A single one of the transport vehicles 83 is illustrated in FIG. 28. The transport vehicle 83, arranged on the rail 82 and automatically actuable, preferably controlled by a control unit, is capable of transporting at least one, preferably multiple, particularly four replaceable magazines 81 or cartridges 81 simultaneously, wherein in the example shown here, the transport vehicle 83 transports the replaceable magazines 81 lying one above the other, i.e., each in an at least nearly horizontal alignment, or substantially horizontally. The constantly horizontal alignment of the transport carriage of the transport vehicle 83 along the entire transport path is preferably controlled by means of a position sensor arranged on the transport carriage. Slight deviations from horizontal of up to +/−20° can be permissible.

Figure 29:
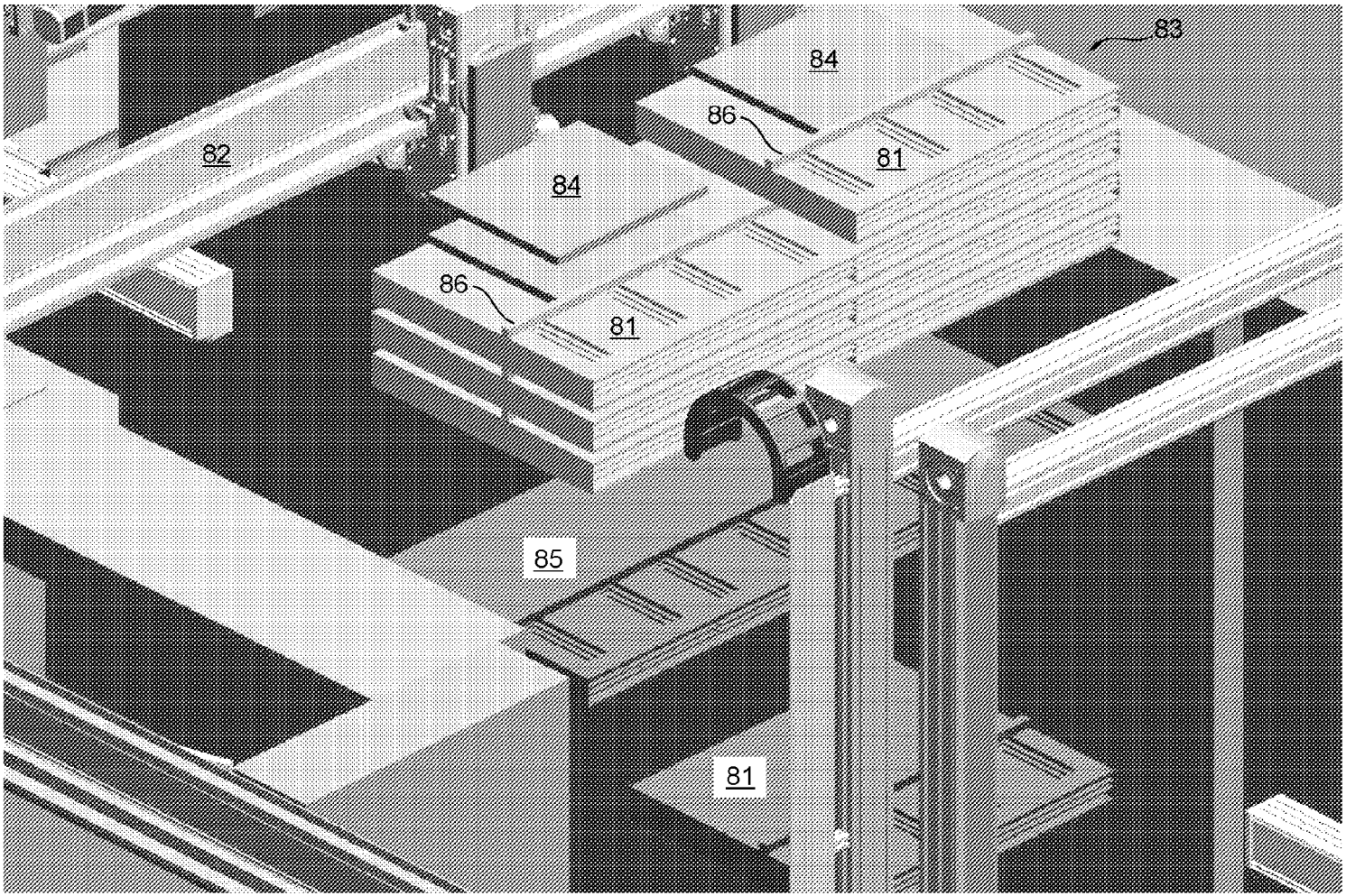
Figure 30:
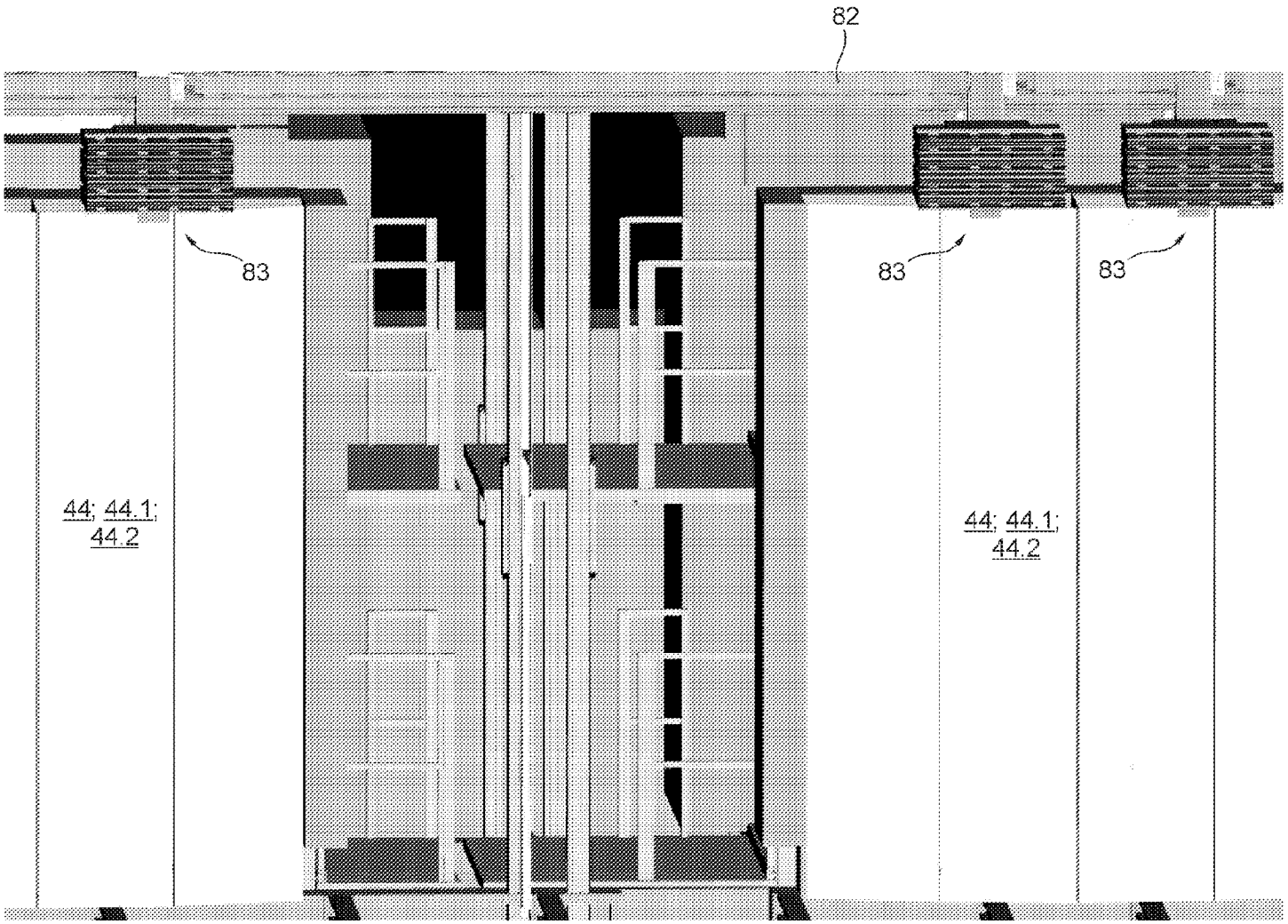
Figure 31:
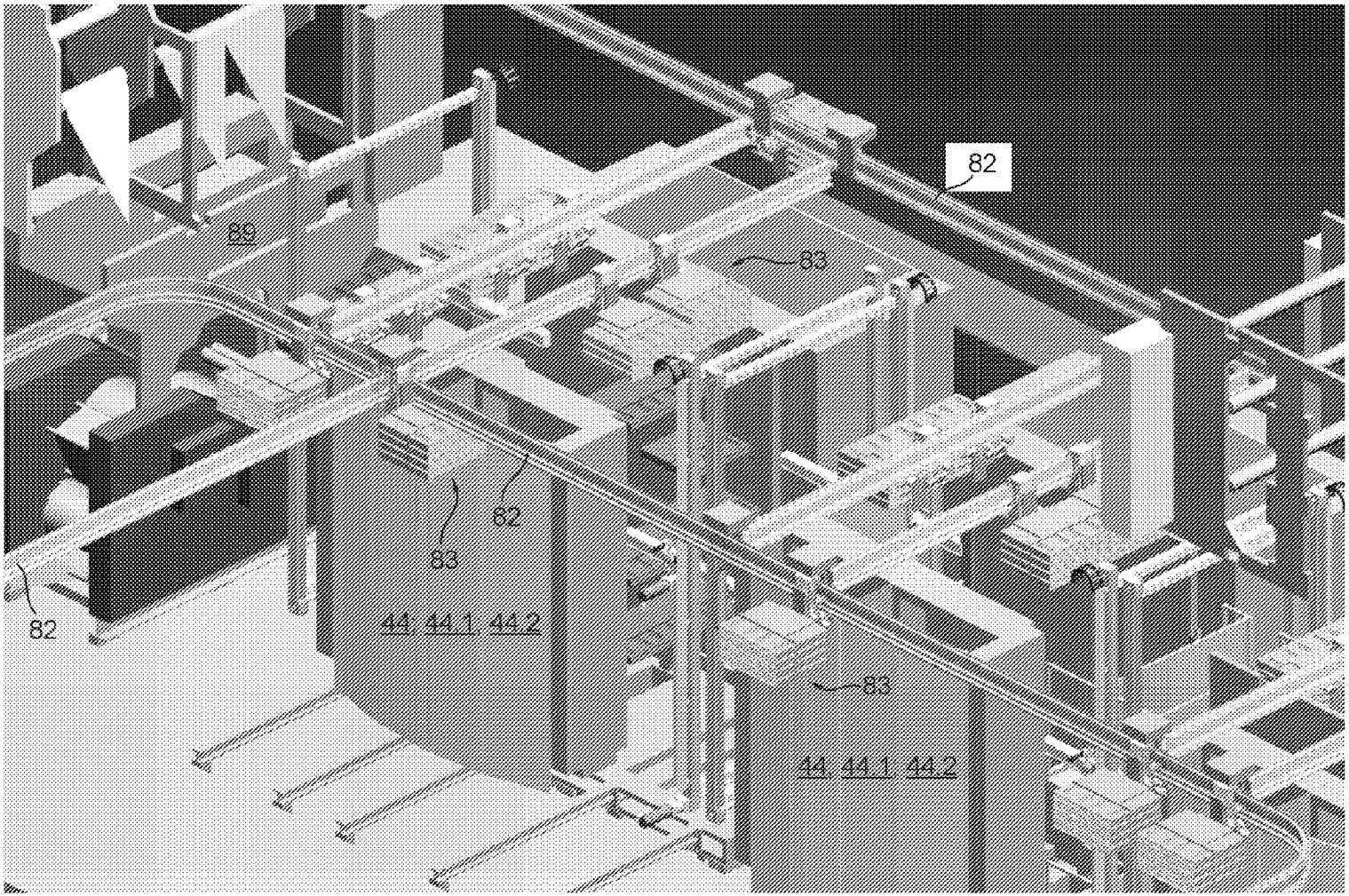
Figure 32:
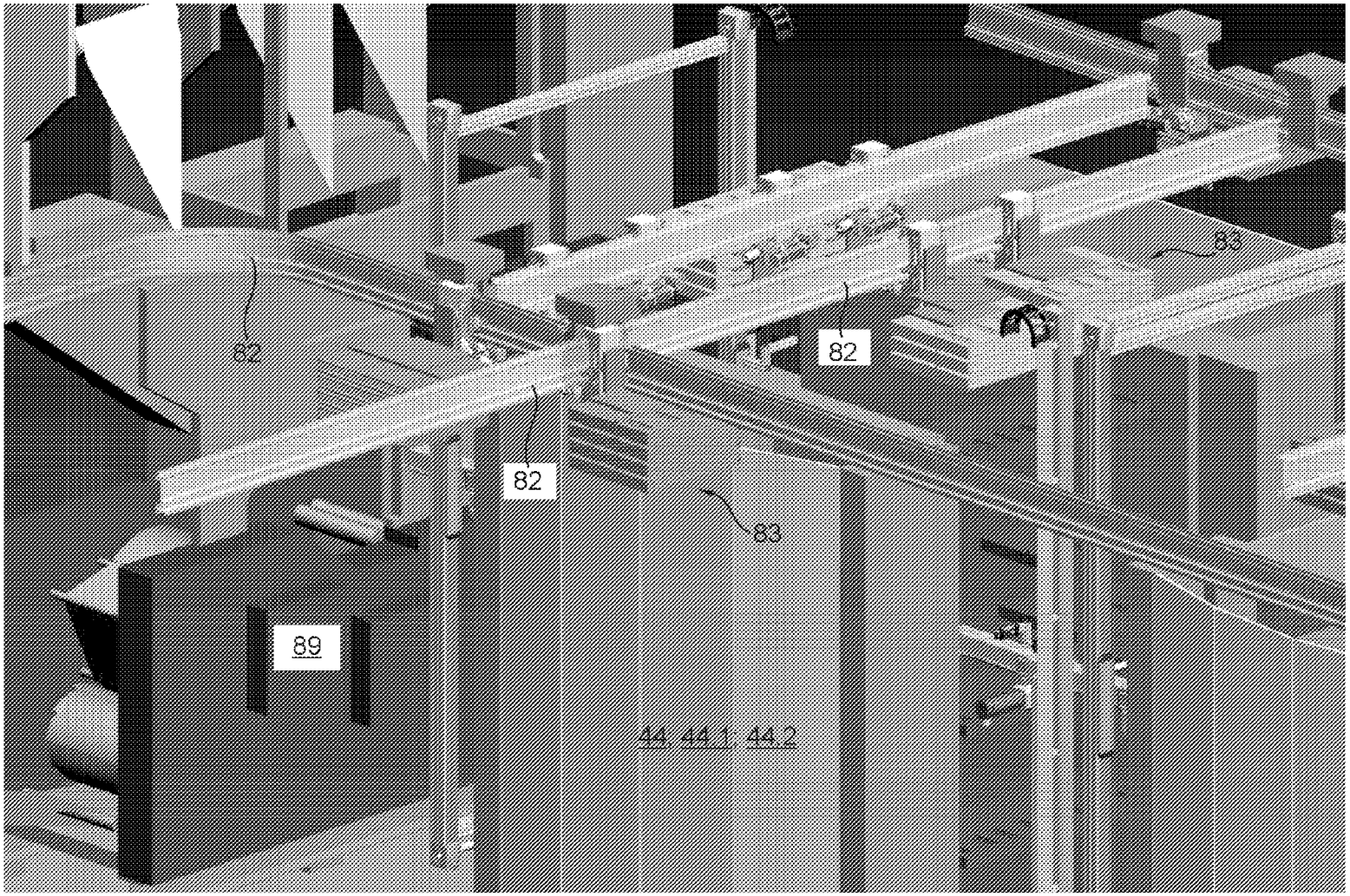
Figure 33:
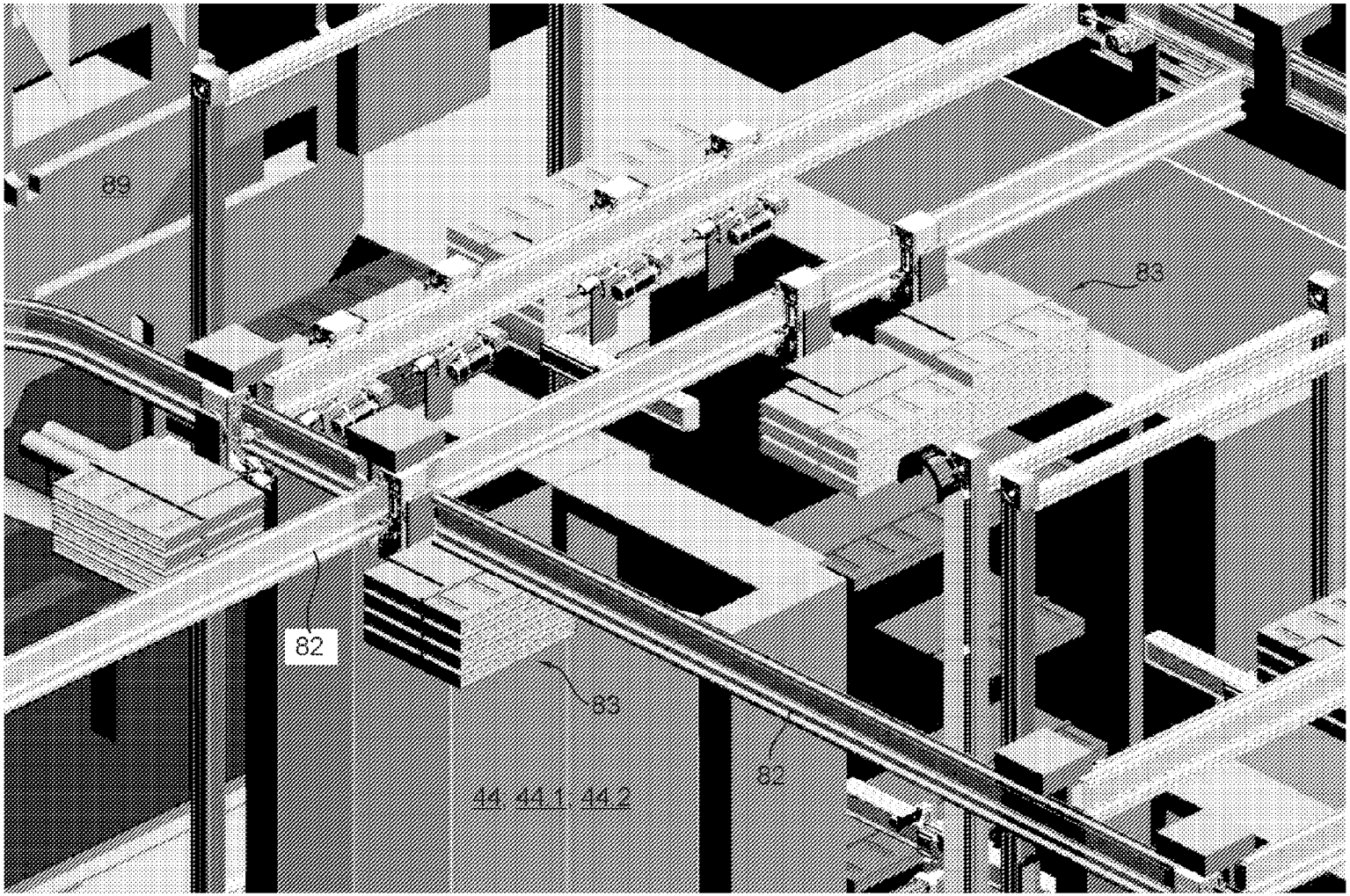

As is clear from FIG. 29, the replaceable magazines 81 are held by the support system 84 of the relevant transport vehicle 83, in each case on a shelf space, wherein the relevant replaceable magazine 81 is inserted into an open shelf space in the support system 84, for example. On the operating side of the printing unit 44; 44.1; 44.2, for every parking position for a transport vehicle 83, another holding space 85 for replaceable magazines 81 to be replaced is provided, with the number of said spaces exceeding the number of printing forme magazines 09 arranged on said operating side of the printing unit 44; 44.1; 44.2 by one. This additional holding space 85 is preferably located above the respective printing unit 44; 44.1; 44.2, wherein each of said printing forme magazines 09 is assigned to one of the forme cylinders 06 disposed in the printing unit 44; 44.1; 44.2. Thus on the operating side of the printing unit 44; 44.1; 44.2, n+1 spaces are provided one above the other, and m spaces for replaceable magazines 81 are provided side by side, wherein n designates the number of replaceable magazines 81 that can be transported simultaneously by the relevant transport vehicle 83, and m designates the number of transport vehicles 83 that can be parked side by side on the operating side of the printing unit 44; 44.1; 44.2. Replaceable magazines 81 to be replaced in the n+1 spaces are replaced in sequence using the same gripper device 72 (FIG. 20), wherein the gripper device 72 removes a replaceable magazine 81 from one of the printing forme magazines 09 disposed in the printing unit 44; 44.1; 44.2, and places it on the additionally provided holding space 85, whereupon the gripper device 72 grips one of the replaceable magazines 81 provided by the transport vehicle 83 and inserts it into the space of the previously serviced printing forme magazine 09, which has just been cleared. The gripper device 72 then removes a replaceable magazine 81 from another printing forme magazine 09 located on said operating side of the printing unit 44; 44.1; 44.2, and places it in the open space in the transport vehicle 83. The gripper device 72 then grips another of the replaceable magazines 81 provided by the transport vehicle 83 and the sequence of steps described above is repeated. Once the replaceable magazines 81 of all printing forme magazines 09 on the same operating side of the printing unit 44; 44.1; 44.2 have been replaced, for example, the gripper device 72 finally inserts the replaceable magazine 81 previously placed in the holding space 85 into the usually last open space in the transport vehicle 83, whereby the transport vehicle 83 is again loaded to capacity with replaceable magazines 81, for example.

The relevant replaceable magazine 81 is held in the correct position in the respective support system 84, for example, by means of one or more mechanical stops 86. At least during transport, the replaceable magazines 81 are fixed in place in the relevant support system 84 by means of a fastening device, for example, embodied on the support system 84 and preferably controllable. Replaceable magazines 81 that have been transported to one operating side of a printing unit 44; 44.1; 44.2 can be received there, for example, by a gripper device 72 attached to a lifting device 71, as was described, for example, in reference to FIG. 20. The lifting device 71 provided on the printing unit 44; 44.1; 44.2 can have a gantry, for example, on which a preferably multi-axis, particularly six-axis, robot is arranged as the gripper device 72, wherein said robot is movable, particularly positionable, on the gantry, preferably linearly, at least vertically bidirectionally. The lifting device 71, along with its gripper device 72 or the gantry of the robot for handling replaceable magazines 81 at the printing unit 44; 44.1; 44.2, can be attached, to the height-adjustable walkway 49 or can be embodied as forming a structural component with this walkway 49, wherein this walkway 49 is arranged on one of the two operating sides of the relevant printing unit 44; 44.1; 44.2 (FIG. 8, 15, 16). The sequence of movements particularly of the robot for handling replaceable magazines 81 is monitored by sensors, and its handling area is particularly enclosed within a fence.

FIG. 30 again illustrates how a plurality of transport vehicles 83 belonging to the same particularly rail-mounted transport system are transported up to or away from printing units 44; 44.1; 44.2 of a printing press. FIGS. 31 to 34 show more complex pathways for the transport system for a printing press comprising a plurality of printing units 44; 44.1; 44.2 and at least one folder 89, or a section of a printing press comprising a plurality of sections. More particularly, it is clear in FIGS. 31 to 34 that the transport vehicles 83 are or at least can be guided in different directions and on different paths via intersections. To implement an exchange of individual printing formes 01 or of entire replaceable magazines 81, the transport vehicles 83 for transporting said replaceable magazines 81, for example, are preferably positioned above the relevant printing unit 44; 44.1; 44.2 on the respective operating side thereof, where they stand ready for further handling by the gripper device 72 of the lifting device 71 or by a robot, as described above in reference to FIG. 20.

Figure 34:
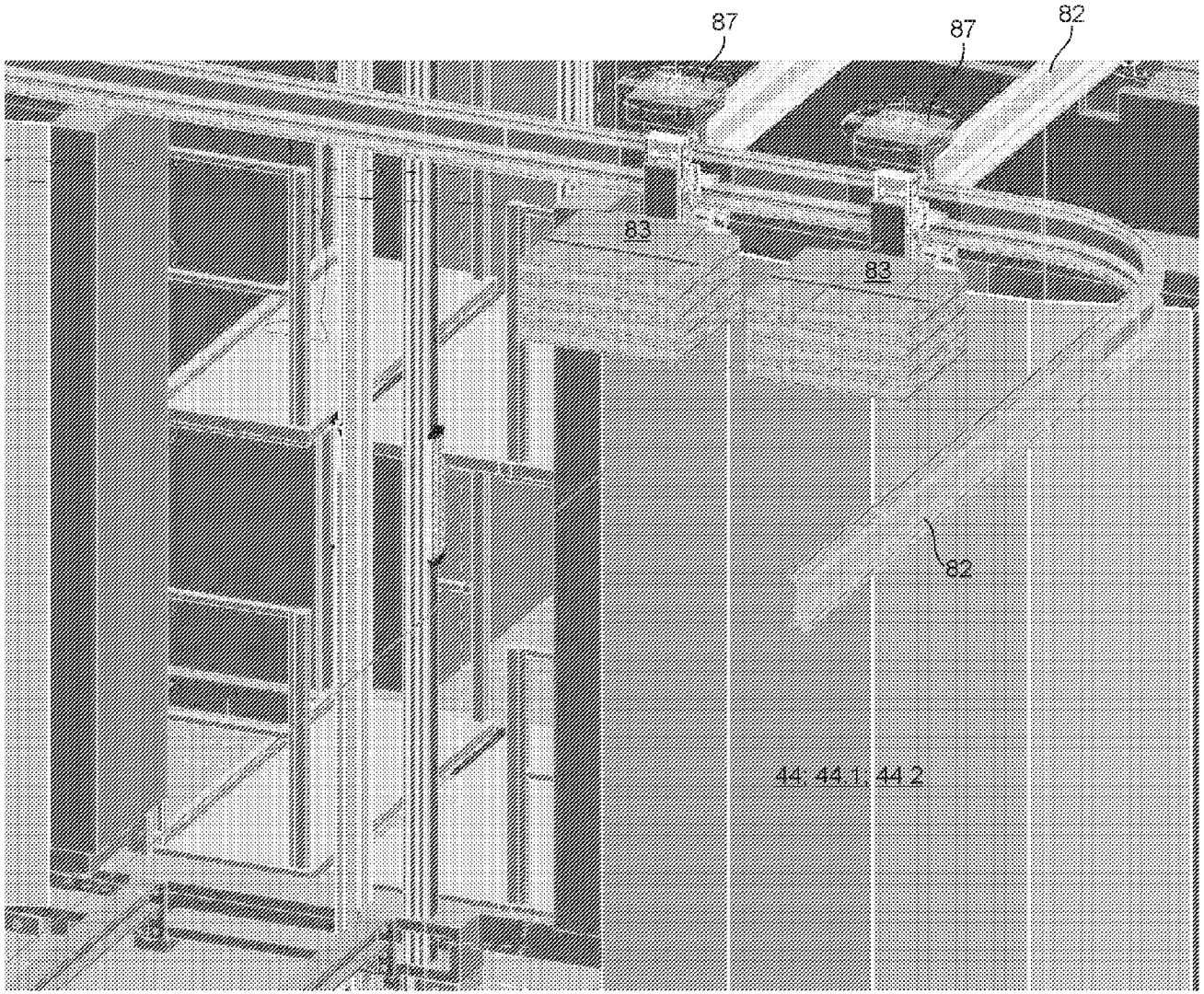
Figure 35:
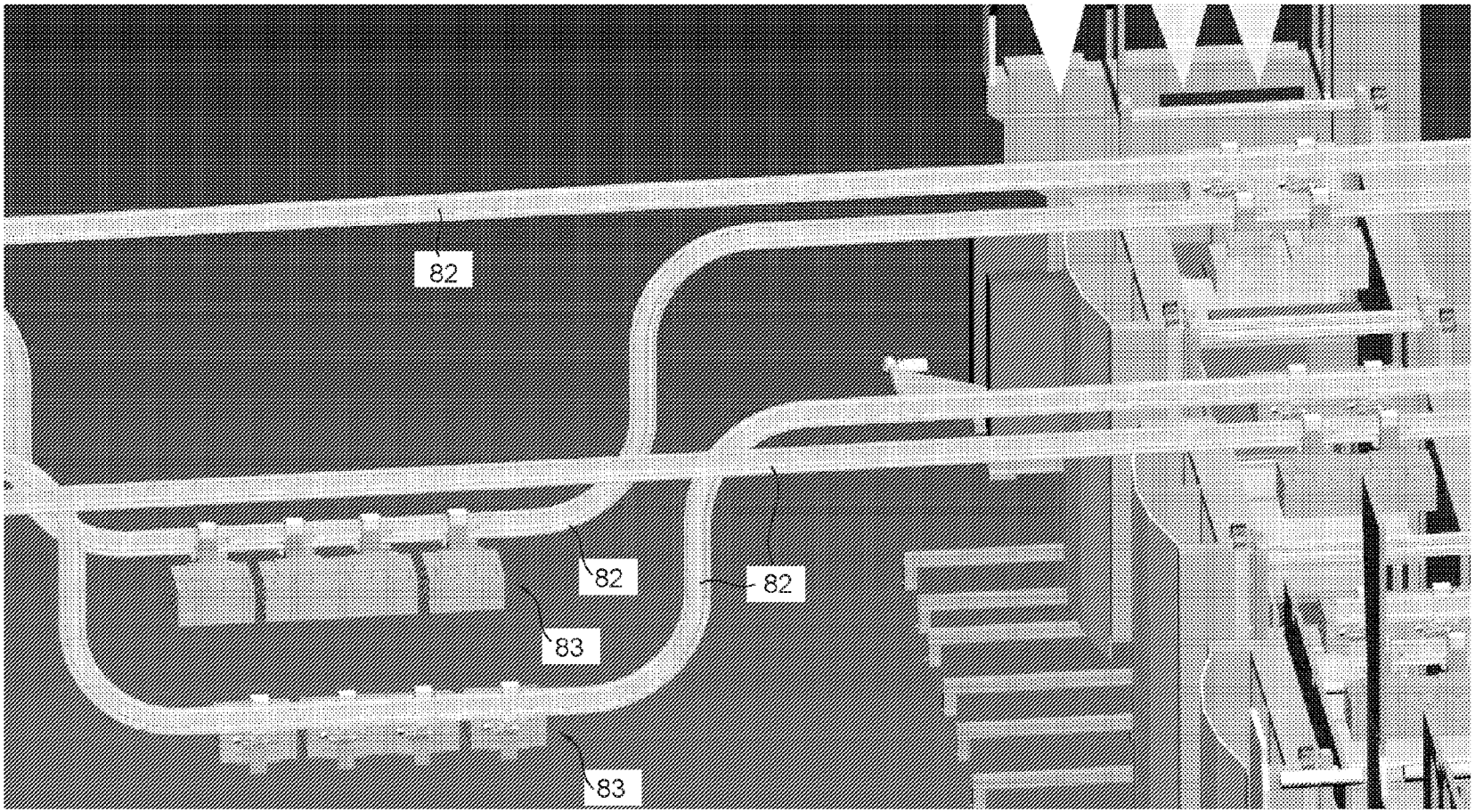

FIG. 34 shows two turntables 87, each for one transport vehicle 83, wherein each of these turntables 87 is capable of turning one transport vehicle 83 90° about a vertical axis, for example, in both directions. A control unit 88, particularly a vehicle master computer 88 (FIG. 36), specifies, for example, a starting position and a target position for each of the transport vehicles 83 traveling in the transport system, wherein each of these transport vehicles 83 then independently determines its respective path using a code applied, for example, to the rails 82, wherein the respective transport vehicle 83 uses the respective code to determine its position and, in connection with at least the target position, generates a drive command. As is clear from FIG. 35, the transport system, which is preferably modular in structure, can comprise horizontal and vertical, as well as straight line and curved, path segments, wherein a curve refers to a curved path segment within a horizontal plane and an arc refers to a curved path segment within a vertical plane. Each of the transport vehicles 83 traveling in the transport system therefore has its own specific identification code that identifies it, and is locatable in the transport system with respect to its current position, so that the current position of at least one, preferably each, transport vehicle 83 preferably can be and is determined at all times.

Figure 36:
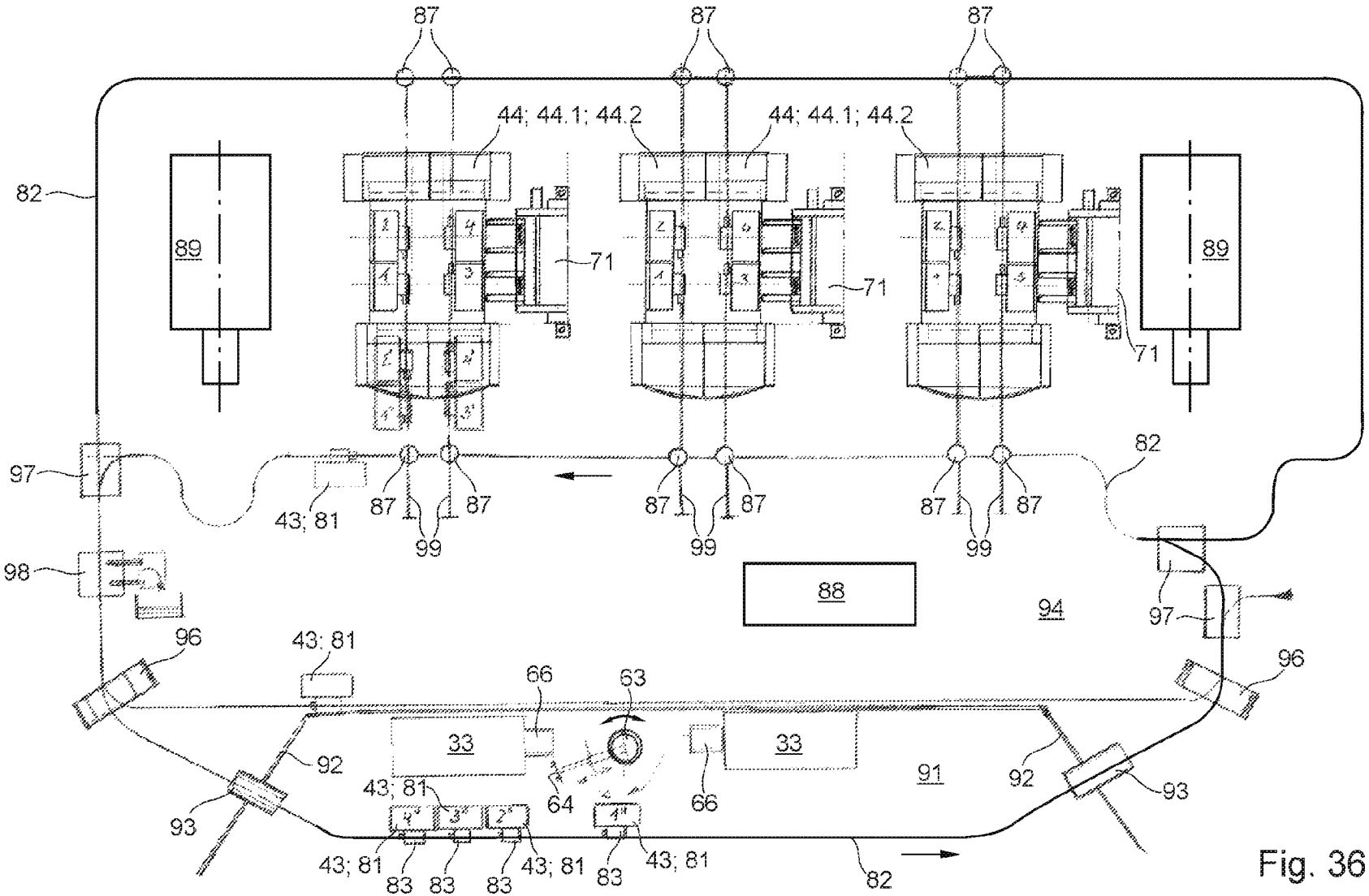
FIGS. 36 to 38 each a schematic overview of different concepts for the transport system illustrated in FIGS. 27 to 35.

FIG. 36 shows a schematic illustration of an example of a transport system, which supplies a printing press, having a plurality of printing units 44; 44.1; 44.2, for example, three, and two folders 89, with printing formes 01, produced in at least one plate line and ready for use. The respective plate line, which has at least one plate exposure device 33, preferably a plurality of these, for example, two, is located spatially separate, for example, from the printing press within a sound-insulating housing 91. At least one robot 63 can be used to pick up, with its gripper device 64, printing formes 01, produced, for example, in random sequence, particularly assigned to different production runs and/or different locations of use in the printing press, and standing ready at least at one output 66 of the respective plate line, and to distribute said formes, on the basis of their respective locations of use in the printing press, among replaceable magazines 81 or mobile collecting containers 43, each of which is moved by a transport vehicle 83 (FIG. 18). The machine room 94 containing the printing press and the sound-insulating housing 91 are at least acoustically separated from one another, for example, by a dividing wall 92, wherein the dividing wall 92 has at least one and preferably a plurality of locks 93, through which locks 93 the transport vehicles 83 can each be moved in sequence through the dividing wall 92. The plate line and the machine room 94 can also be located in different horizontal planes of the same building or even in different buildings, and therefore the transport system has one or more lifting devices 96, for example, by means of which the transport vehicles 83 can overcome the difference in height between these planes. The transport vehicles 83 are preferably guided along a rail 82 in the transport system. The transport path particularly has turntables 87 in the region of the printing units 44; 44.1; 44.2. One or more switching elements 97 can also be provided, which allow the transport vehicles 83 to travel alternative paths if necessary. The transport system also has at least one unloading station 98, where used printing formes 01, which have been removed from their respective locations of use in the printing press to one of the replaceable magazines 81 or mobile collecting containers 43, can be unloaded from the transport system, preferably automatically. In addition to disposing of the used printing formes 01, the unloading station 98 can also perform the function of registering replaceable magazines 81, located on a transport vehicle 83, on the basis of their respective identification codes 104 (FIG. 40), thereby reconfiguring the relevant transport vehicle 83 in the transport system before receiving new printing formes 01 into the respective replaceable magazines 81. The entire sequence of movements of the transport vehicles 83 belonging to this transport system is controlled, for example, by the vehicle master computer 88, wherein the vehicle master computer 88, particularly embodied as a real-time industrial computer, acts on all of said transport vehicles 83, for example, by means of wireless data transfer, wherein each of the transport vehicles 83 has a transmitting and receiving unit and a control unit which controls at least its respective movement, and a drive unit controlled by said control unit. In each case, at least one transport vehicle 83 which has been moved up to one of the printing units 44; 44.1; 44.2 can be parked, for example, in a parking position 99 designated specifically for this purpose, for example, which is separate from the main path of the transport system. The parking position 99 is embodied, for example, as an alley-type path segment, and is reached by the respective transport vehicle 83, for example, by using a turntable 87 disposed in the main pathway. The transport vehicles 83 are moved in the transport system along the rail-mounted pathway, for example, in a preferred direction which is indicated in FIG. 36 by arrows.

Figure 37:
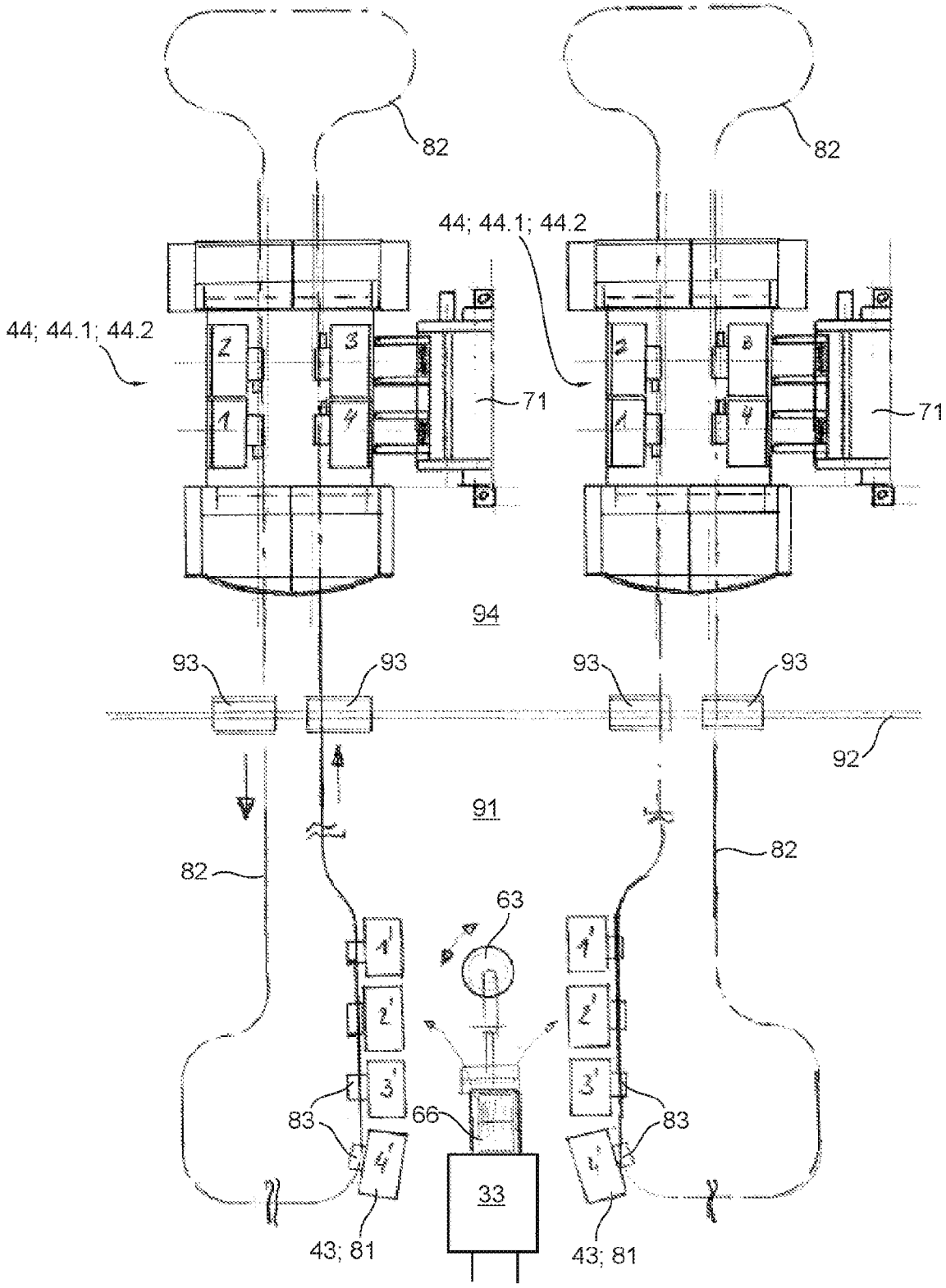
Figure 38:
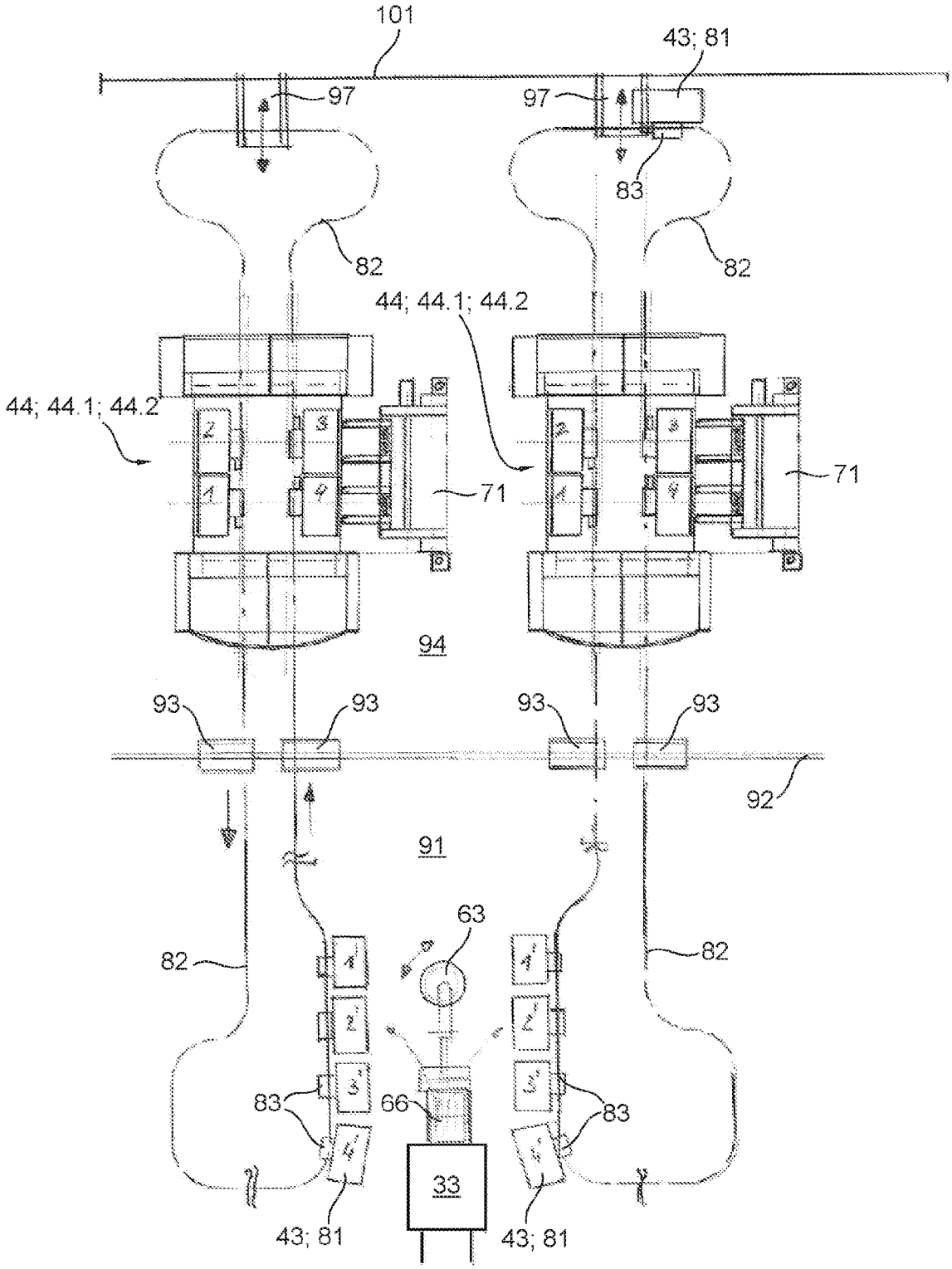
Figure 39:
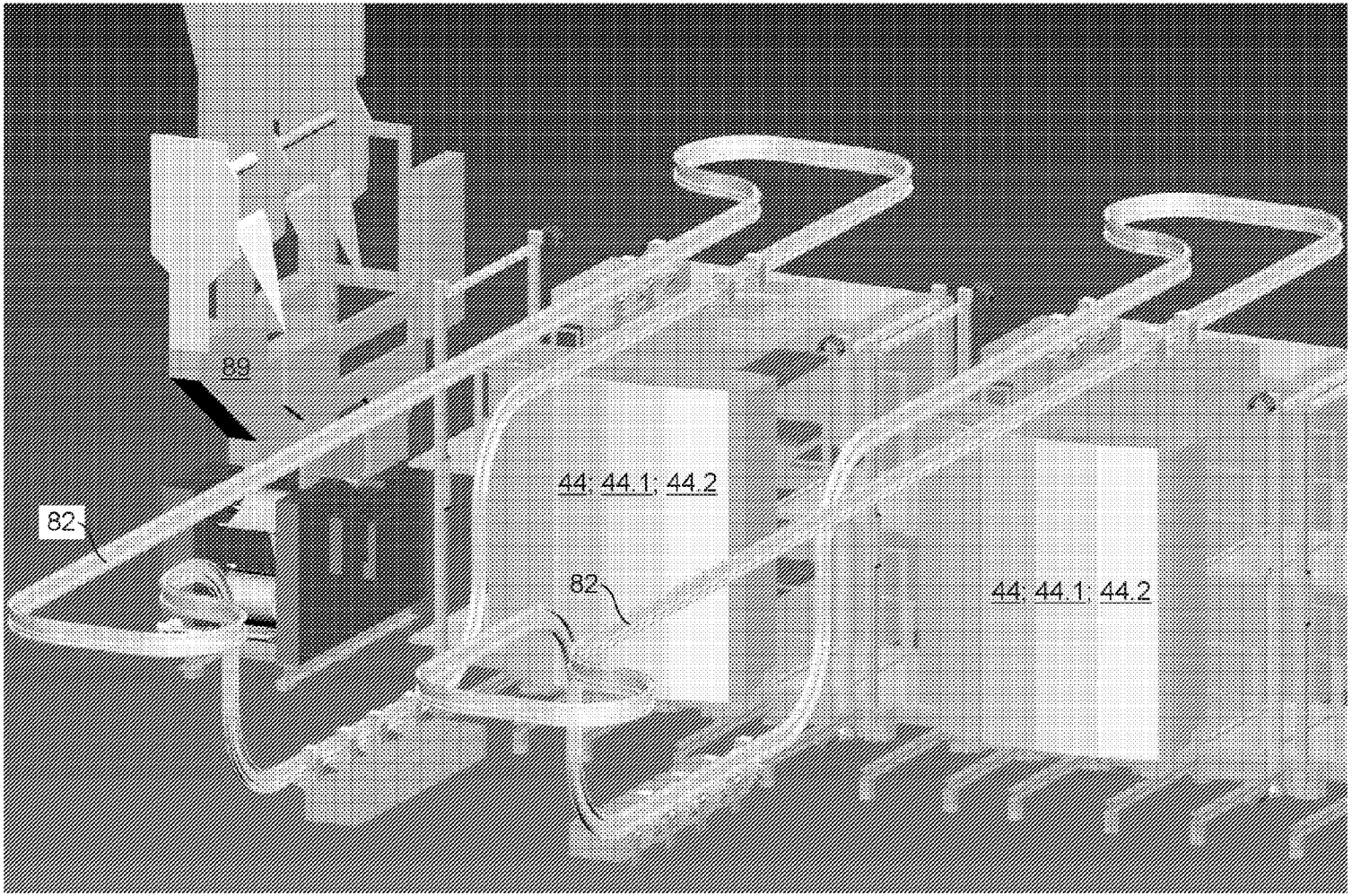
FIG. 39 a perspective illustration of the concept shown in FIG. 37.

The transport system illustrated by way of example in FIG. 36 shows a concept in which all printing units 44; 44.1; 44.2 of the printing press are supplied with printing formes 01 by a plurality of transport vehicles 83 traveling along the same pathway. Alternative concepts can consist in, for example, providing each printing unit 44; 44.1; 44.2 of the printing press with its own pathway for traveling transport vehicles 83, which is illustrated in FIGS. 37 and 38. The concept illustrated in FIG. 38 expands upon the concept illustrated in FIG. 37 such that the respective pathways of the transport system, each of which supplies printing formes 01 to only a single printing unit 44; 44.1; 44.2 of the printing press, can be connected to one another. This optional connection among the pathways assigned to the individual printing units 44; 44.1; 44.2 is achieved, for example, by positioning at least one switching element 97 in each of the pathways assigned to the individual relevant printing units 44; 44.1; 44.2, via which element at least one of the transport vehicles 83 can be diverted away from the pathway of the transport system that is assigned to a first printing unit 44; 44.1; 44.2 and can be guided to a connecting path 101 that bridges the distance between the first printing unit 44; 44.1; 44.2 and a different, second printing unit 44; 44.1; 44.2, so as to then be guided by said connecting path 101, again via at least one switching element 97, to the pathway of the transport system that is assigned to the second printing unit 44; 44.1; 44.2. The concept of FIG. 38 offers the advantage that, even if a malfunction occurs in one of the pathways assigned to one of the printing units 44; 44.1; 44.2, the respectively other printing unit 44; 44.1; 44.2 can be automatically supplied with printing formes 01 by at least one transport vehicle 83 of the transport system. In the concepts of the transport system illustrated in FIGS. 36 to 38, the respective pathways thereof can also be embodied as a one-way pathway, for example, rather than as a loop. The respective switching element 97 can be embodied, for example, as a sliding switch, which is indicated in FIG. 38 in each case by a double arrow. A possible pathway for the concept illustrated in FIG. 37 is shown in perspective in FIG. 39.

In a description of the sequence of steps in a process for providing ready-to-use printing formes 01 to at least one printing unit 44; 44.1; 44.2 of the printing press, reference is made to FIG. 7. On the basis of production data, provided by a control unit 40 of a production planning system to a control unit 39 of a plate logistics management system, and on the basis of masters 37 produced, for example, in a prepress stage and stored there in a computer 34, printing formes 01, which are ready for use at installation positions on one of the forme cylinders 06 of the printing unit 44; 44.1; 44.2, are produced in at least one plate line from particularly plate-type blanks 32, and, using mobile collecting containers 43 or replaceable magazines 81, each of which has a plurality of compartments 58 (FIG. 19), are transported, presorted, to the relevant printing unit 44; 44.1; 44.2. The sorting of the ready-to-use printing formes 01 into the mobile collecting containers 43 or replaceable magazines 81 standing ready, for example, at the output of the plate line can be implemented automatically by the at least one robot 63. In the transport system for transporting the printing formes 01 to their respective locations of use in the printing press, at least as many transport vehicles 83 are provided, for example, as the number of installation positions on the forme cylinder 06 to be supplied with said printing formes 01, side by side in the axial direction thereof. In the relevant transport system, preferably three times as many collecting containers 43 or replaceable magazines 81 are used as the number of installation positions provided on the forme cylinders 06 that are to be supplied with printing formes 01 in the at least one printing unit 44; 44.1; 44.2 that is supplied with printing formes 01 by said transport system.

In the concepts of a transport system illustrated in FIGS. 37 and 38, the transport vehicles 83 are used in a fixed sequence, which is indicated in FIGS. 37 and 38 by a sequential numbering of the transport vehicles 83 used, corresponding to the installation positions on the forme cylinder 06 or at least the locations of use in the printing unit 44; 44.1; 44.2. A fixed sequence of transport vehicles 83 in use has the disadvantage, however, that these transport vehicles 83 must also make empty trips or partially filled trips, for example, when it is not necessary to change at least one printing forme 01 on one of the axially side by side installation positions of the forme cylinders 06. The preferred direction of movement of said transport vehicles 83 is indicated in FIGS. 37 and 38 by a directional arrow. According to the concept illustrated in FIG. 36, each of the transport vehicles 83 can be moved up individually and optionally to one of the printing units 44; 44.1; 44.2. In the plate line, ready-to-use printing formes 01 can be temporarily stored as needed in a storage device 51 and/or can be presorted with the help of a sorting station 57. The exposure device 33, the developing unit 36, the bending unit 38 and, if applicable, the storage device 51 and/or the sorting station 57 are preferably each equipped with their own control unit, which is able to share data, particularly control data, at least with the control unit 39 of the plate logistics management system and/or with the control unit 40 of the production planning system, and/or with a computer 34 of the prepress stage, via a preferably shared, for example, Ethernet-based communications network 41, so that the sequence of the process for providing ready-to-use printing formes 01 to at least one printing unit 44; 44.1; 44.2 of the printing press can be centrally controlled, wherein individual process steps can also be controlled locally, independently of other devices and/or control units. FIG. 7 indicates the optional data connection between the control unit 39 of the plate logistics management system and the control unit of the bending unit 38 by dashed lines. The control unit 39 of the plate logistics management system preferably controls the entire sequence or process of producing, supplying, transporting and changing the printing formes 01 or the mobile collecting containers 43 or replaceable magazines 81 thereof. The control unit 39 of the plate logistics management system performs a controlling function, on the basis of the data available to it, particularly on the bending unit 38, the robot 63 for gripping printing formes 01 at the output 66, the sensing device for scanning a code on the printing formes 01 and/or on the mobile collecting containers 43 or replaceable magazines 81, the vehicle master computer 88, the lifting device 71 embodied, for example, as a robot, along with its gripper device 72, and the respective controllable conveyor device 80 in the respective printing forme magazines 09. The control unit 39 of the plate logistics management system is embodied, for example, as a redundant real-time control system.

As was described above in connection with FIG. 9, a preferably optical display device 52 can be provided at the output of the plate line, for example, which indicates which printing forme 01 is to be sorted, manually or with the help of the robot 63, into which compartment 58 of the respective mobile collecting container 43 or replaceable magazine 81. This display can be provided in the form of symbols or in plain text.

Once at least one compartment 58 of the respective mobile collecting container 43 or replaceable magazine 81 has been successfully loaded, particularly the control unit 39 of the plate logistics management system can check, using the shared data on the basis of the scanned code applied to the relevant printing forme 01, for example, the data matrix code 22 (FIGS. 3 to 6), whether the relevant printing forme 01 has been sorted into the correct compartment 58 according to the production data of the production planning system, and/or whether the transport vehicle 83 transporting the relevant mobile collecting container 43 or the relevant replaceable magazine 81 is on the correct path to the location of use specified according to the production data of the production planning system. If the control unit 39 of the plate logistics management system identifies a deviation from the production data of the production planning system, a warning message can be generated on the display device 52, particularly at the control console 42, even before the start of production in the relevant printing unit 44; 44.1; 44.2 of the printing press, in order to prevent a faulty preprint run and thus wasted print substrate.

Figure 40:
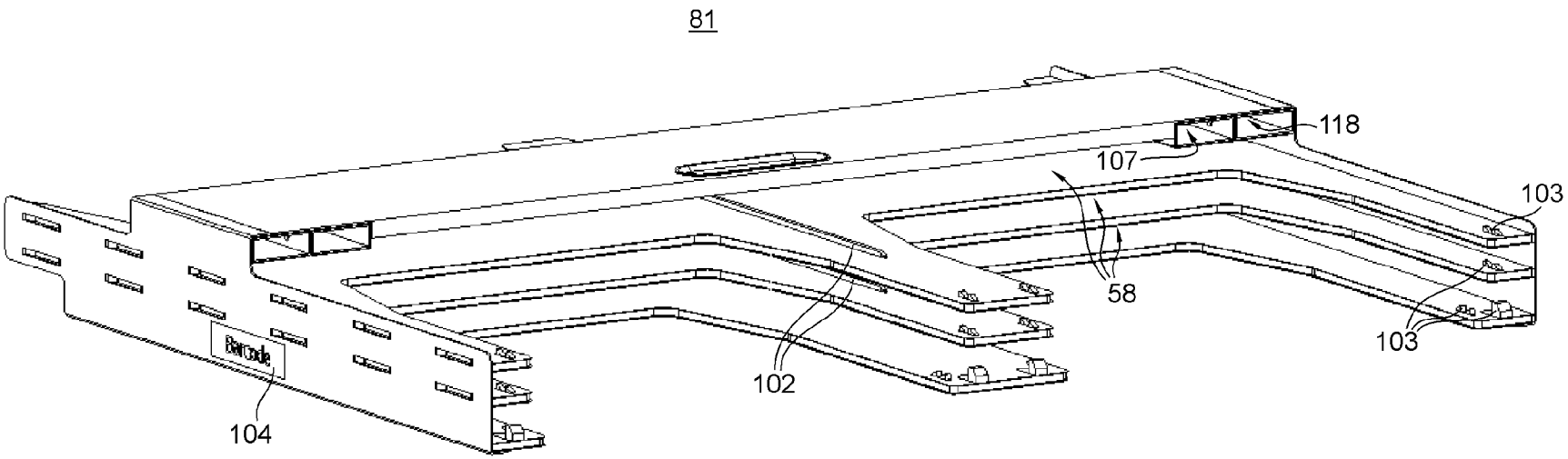
FIG. 40 a perspective illustration of a replaceable magazine.

FIGS. 40 to 43 provide additional details on the replaceable magazine 81 already described in connection with FIGS. 23 to 26, and the locking thereof on the magazine support 79. In this variant, the replaceable magazine 81 is embodied as one of the mobile collecting containers 43 that can preferably be transported horizontally by the automatic transport system. FIG. 40 shows a perspective illustration of a replaceable magazine 81 of this type, embodied as box-shaped, in which, for example, one compartment 58 for accommodating either one double-width printing forme 01 or two single-width printing formes 01 is formed, for example, in each of three planes arranged one above the other, wherein each of the printing formes 01 is inserted into the replaceable magazine 81 at one of the two opposite end surfaces of said magazine, and is removed from the replaceable magazine 81 at the respectively opposite end surface thereof. The two upper compartments 58 hold printing formes 01 to be supplied to the forme cylinder 06, for example, whereas the lower compartment 58 is for storing printing formes 01 that have been removed from the forme cylinder 06. The two upper compartments 58 each have a narrow center land 102, extending in the direction of feed of the printing formes 01 and having a wall thickness of a few millimeters, for example, in the range of less than 5 mm, the smooth side surfaces of which, in a first operating state of the replaceable magazine 81, serve as one of the above-mentioned guide rails 78 (FIG. 23; 24) for single-width printing formes 01 arranged side by side in the relevant compartment 58. The respective center land 102 has a low structural height of only a few millimeters, for example, from 2 mm to 10 mm, so that in a second operating state of the replaceable magazine 81, a double-width printing forme 01, i.e., embodied in panoramic format, placed, i.e., stored, in one of the upper compartments 58, for example, is placed or at least can be placed with its center region in the relevant compartment 58 of the replaceable magazine 81 on the upper edge, i.e., the crown, of the respective center land 102. In addition, in each of the individual compartments 58, at the end surface of the replaceable magazine 81 that faces away from the forme cylinder 06, at least one, preferably a plurality of ramp-shaped catches 103, for example, and/or stops oriented perpendicular to the direction of feed of the printing formes 01, with which printing formes 01 placed in the relevant compartments 58 are held in their respective insertion positions by the suspension legs 14 bent at their respective trailing ends 04 (FIG. 1), and are thereby secured against inadvertently slipping out of said replaceable magazine 81, particularly during the transport of the replaceable magazine 81. The catches 103 thus each define holding positions for printing formes 01 inserted into the replaceable magazine 81. For the unambiguous identification and/or location of each replaceable magazine 81 in a transport system for transporting multiple replaceable magazines 81, as is illustrated by way of example in connection with FIGS. 27 to 39, each of these replaceable magazines 81 is preferably equipped on a side wall, for example, with an identification code 104, for example, a barcode, which can preferably be read by a machine. The replaceable magazine 81 is made, for example, of sheet metal. The side walls and bases of the compartments 58 of the replaceable magazine 81 are preferably of a lightweight construction, for example, made of a multicomponent material, particularly a plastic, in combination with a light metal alloy.

Figure 41:
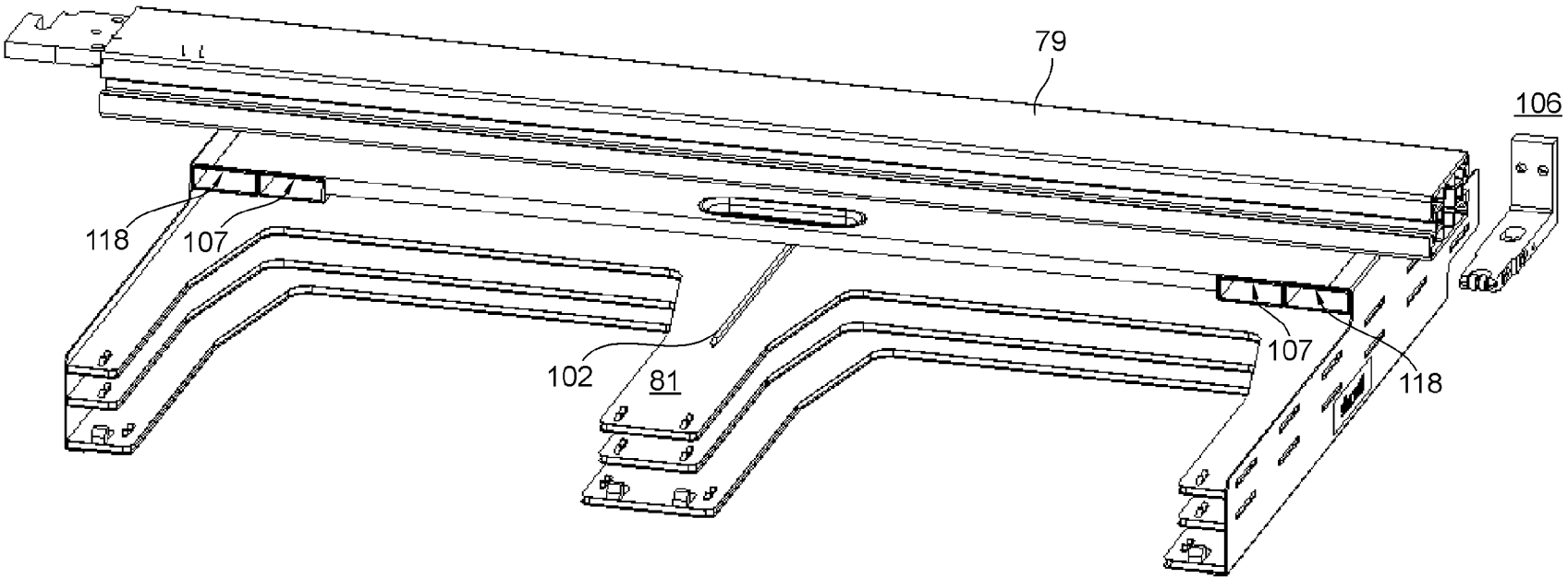
FIG. 41 an interaction of the replaceable magazine of FIG. 40 with a magazine support.
Figure 42:
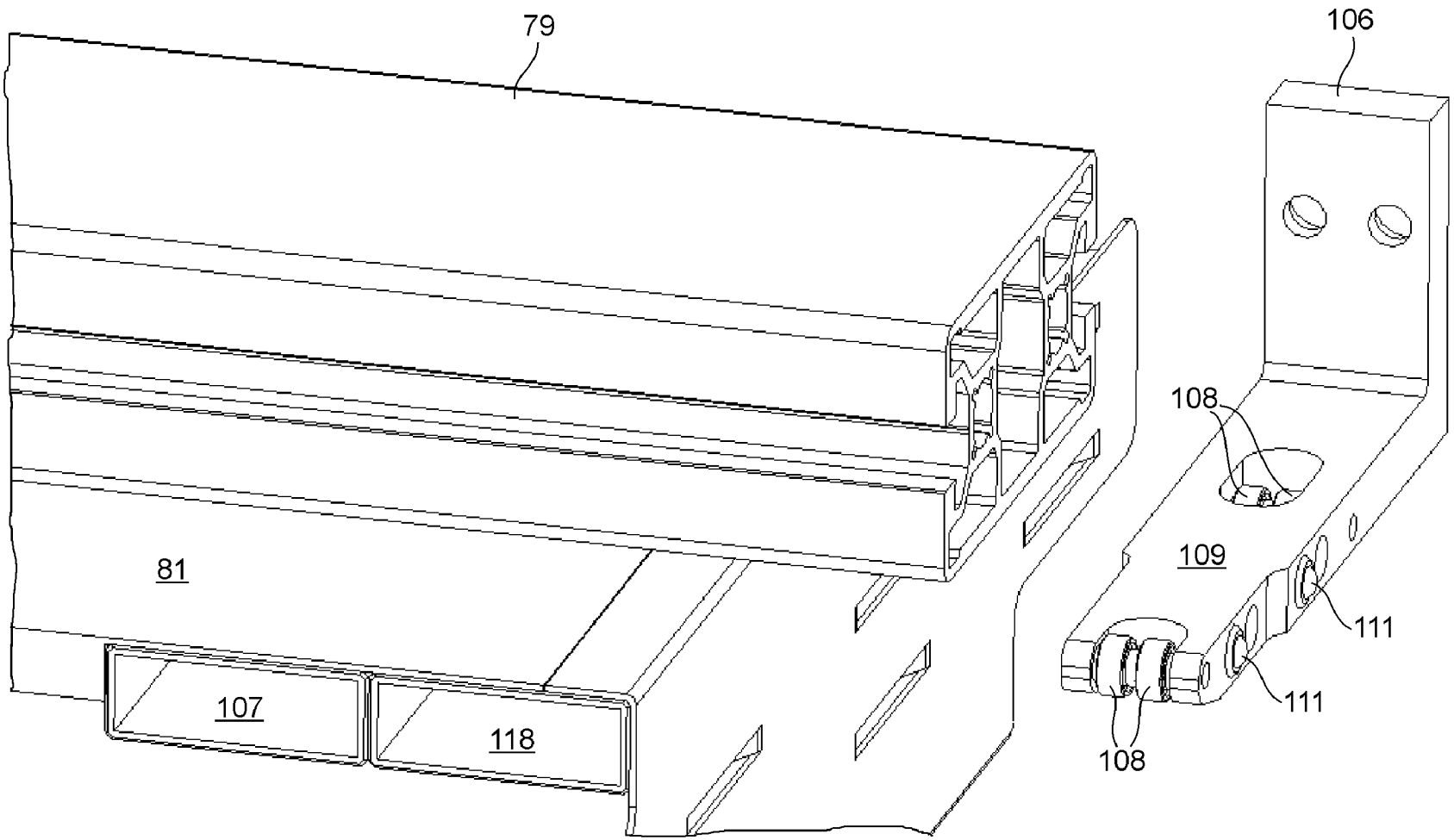
FIG. 42 a section of FIG. 41.

The replaceable magazine 81 is held in place in the printing unit 44; 44.1; 44.2, on a magazine support 79 which extends axially parallel to an assigned forme cylinder 06, by means of a securing device, as will now be described in reference to the perspective illustrations in FIGS. 41 and 42. One or more connecting elements 106 configured for holding at least one replaceable magazine 81 are arranged on the magazine support 79, wherein when the replaceable magazine 81 and magazine support 79 are joined, the relevant replaceable magazine 81 is preferably placed on said elements. In the preferred embodiment, the replaceable magazine 81 has first hollow elements 107, which are open at least on the side that faces the forme cylinder 06 and are configured to match the connecting elements 106, in each of which elements one of the connecting elements 106 arranged on the magazine support 79 coming from the direction of the forme cylinder 06 is able to engage in a preferably positive connection. Connecting elements 106 and matching first hollow elements 107 have a rectangular cross-section, for example, however, other cross-sectional shapes are also possible, for example, round, oval or triangular. In FIGS. 41 and 42, one of the connecting elements 106 embodied, for example, as angular is shown separated from the magazine support 79 for purposes of clarity. FIG. 42 shows an enlargement of a section of FIG. 41. The magazine support 79 is embodied, for example, as a profiled rail having a rectangular cross-section, wherein two connecting elements 106, for example, each embodied in the form of a right angle, for each replaceable magazine 81, are attached to the profiled rail, for example, screw-mounted, spaced from one another, particularly spaced nearly the width of the replaceable magazine 81, wherein one of the legs 109 of the respective connecting element 106 projects outward, for example, from the magazine support 79. On this projecting leg 109 of the connecting element 106, the assigned first hollow element 107 formed on the replaceable magazine 81, and therefore the replaceable magazine 81, is preferably automatically placed, for example, by means of a gripper device 72 (FIG. 20) for handling said replaceable magazine 81. On the projecting leg 109 of the connecting element 106, for example, one or more track rollers 108 are formed, for example, two pairs of track rollers 108 are formed, integrated into the leg 109 of the connecting element 106, i.e., each in a recess in the leg 109 of said connecting element 106, wherein said track rollers 108 roll along a contact surface up to the first hollow element 107 during the joining of replaceable magazine 81 and the relevant connecting element 106. The track rollers 108 serve to improve the sliding of the connecting element 106 within the first hollow element 107.

Figure 43:
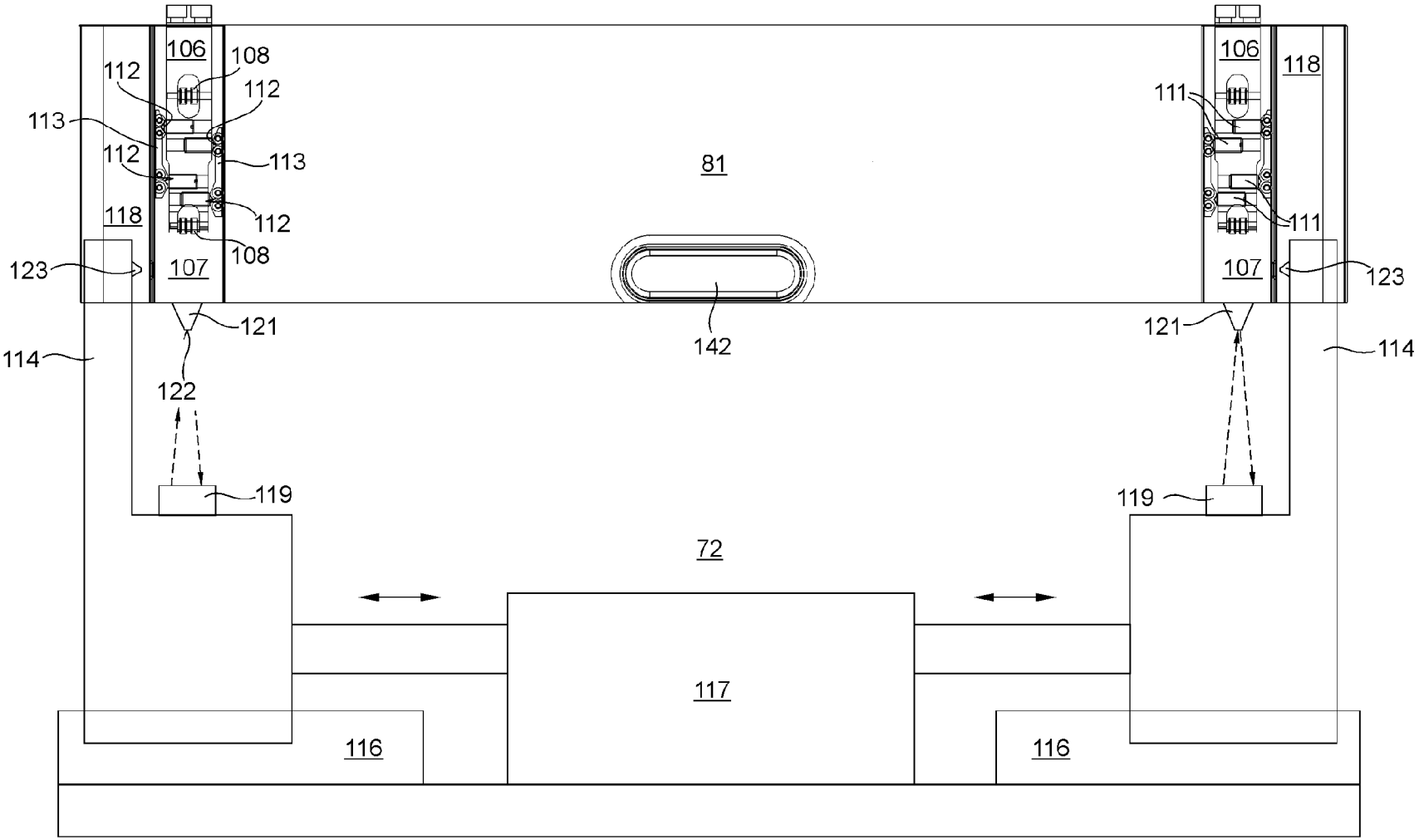
FIG. 43 a replaceable magazine gripped by a gripper device.

To achieve the lowest possible friction in the guidance of the connecting element 106 on at least one of the contact surfaces up to the first hollow element 107, one or more sliding elements 111 or roller elements 111, for example rotatable spheres, can be arranged particularly on at least one lateral guide surface of the projecting leg 109 of said connecting element 106, wherein said roller elements 111 are preferably mounted so as to be movable laterally in relation to the insertion direction of said connecting element 106, for example, against the force of a pressure spring. A simple linear bearing is thereby formed between the first hollow element 107 and the connecting element 106 which is translationally inserted into said first hollow element 107. This is illustrated in FIG. 43, which shows a simplified assembly in a plan view, wherein said assembly comprises at least one replaceable magazine 81 disposed on two connecting elements 106 spaced from one another, and one gripper device 72 for handling said replaceable magazine 81, wherein each of the two connecting elements 106 on the side of the replaceable magazine 81 that faces the forme cylinder 06 is inserted individually, at least partially, into a first hollow element 107 formed on said replaceable magazine 81. The gripper device 72, which is connected particularly to a robot gantry, is situated on the side of the replaceable magazine 81 that faces away from the forme cylinder 06. Inside the first hollow element 107, which receives a connecting element 106, latches or grooves 112, particularly molded parts 113 having said grooves 112, are arranged, for example, particularly extending perpendicular to the direction of insertion of the relevant connecting element 106, in which grooves 112 the track rollers 108 formed on the connecting element 106 to be inserted are able to engage, thereby producing a detachable connection, particularly a latching connection or snap connection, between the replaceable magazine 81 and the magazine support 79, which supports the connecting elements 106, and which is not shown in FIG. 43 for purposes of clarity. The magazine support 79 and a frame 76 for the printing forme magazine 09 that holds the replaceable magazine 81 are preferably securely connected to one another in their respective arrangement in the printing unit 44; 44.1; 44.2, and are also permanently disposed in the printing unit 44; 44.1; 44.2, for example, connected via screws to the frame 16 of said printing unit 44; 44.1; 44.2. On the holding device of the transport vehicle 83 for transporting the replaceable magazines 81 (FIG. 28), i.e., on the horizontal transport carriage, the same connecting elements 106 as on the magazine support 79 are preferably attached, to allow the transport vehicle 83 to hold the replaceable magazines 81 securely, for example, also via a positive connection.

The gripper device 72 illustrated in FIG. 43 and arranged spatially close to the printing unit 44; 44.1; 44.2, but operated independently of said printing unit 44; 44.1; 44.2, has two gripper arms 114, for example, each of which, for example, is movable bidirectionally, preferably linearly, within a guide element 116, along an adjustment path indicated in each case by a double arrow, wherein each respective adjustment path extends parallel to the width of the replaceable magazine 81, and is therefore also oriented parallel to the axis of rotation 124 of the forme cylinder 06. The movement of the gripper arms 114 is driven by a drive 117, for example, an electric motor, which is remotely controllable, for example, from the control console 42. Alternatively, the drive 117 can also be embodied as a pneumatic drive. The gripper arms 114 are preferably moved by the drive 117 synchronously, particularly counter to one another, i.e., they move uniformly either toward one another or away from one another. Alternatively, the drive 117 can displace the gripper arms 114 individually and independently of one another. The gripper arms 114 on the side of the relevant replaceable magazine 81 that faces away from the forme cylinder 06 can be inserted into second hollow elements 118, which are arranged on said replaceable magazine 81 and are open at least on the side of the replaceable magazine 81 that faces away from the forme cylinder 06. The gripper device 72 has at least one positioning device, preferably one such device for each gripper arm 114, with which device the gripper arms 114 can be positioned in front of the respective openings in the second hollow elements 118, allowing the gripper arms 114 to be inserted at least partially into the relevant second hollow elements 118 via a preferably linear movement directed toward the replaceable magazine 81, as is illustrated in FIG. 43. The first and second hollow elements 107; 118 formed on the replaceable magazine 81 are arranged adjoining one another in pairs, for example, parallel to one another, at the respective ends of the relevant replaceable magazine 81 widthwise. The first and second hollow elements 107; 118 can be substantially identical in structure, particularly with respect to cross-section. The hollow elements 107; 118 are particularly implemented as square tubes. On the replaceable magazine 81, a recessed handle 142 can be formed to allow the replaceable magazine 81 to be manually transported.

The positioning device has, for example, at least one reflex scanner 119, which transmits a preferably electromagnetic wave, for example, light, to the top surface 122 of a conical cone 121, said surface facing the reflex scanner 119, wherein the conical cone 121 is arranged with its base surface on the replaceable magazine 81, on the side thereof which faces away from the forme cylinder 06 and therefore toward the gripper device 72, wherein the top surface 122 of the conical cone 121 has a diameter, for example, of 0.5 mm to 2 mm, preferably 1 mm or less. Light emitted by a transmitter, for example, a laser diode of the reflex scanner 119, toward the conical cone 121 is received by a receiver of the reflex scanner 119 only when the top surface, facing the transmitter, of the conical cone 121, which is securely connected to the replaceable magazine 81, and the reflex scanner 119, which is securely connected to the gripper device 72, are immediately and directly opposite one another, within permissible tolerance limits, so that as a result of the signal reflected from the top surface 122 of the conical cone 121 and received by the receiver of the reflex scanner 119, the gripper arms 114 can be positioned in front of the respective openings in the second hollow element 118, when this signal is used for controlling the drive 117 which drives the gripper arms 114. The positioning device can be used to adjust the horizontal and vertical positions of the gripper device 72 relative to the replaceable magazine 81. The gripper arms 114 of the gripper device 72 illustrated by way of example in FIG. 43 each have at least one connecting element 123, for example, a journal or a conical bolt, with which a gripper arm 114 inserted into the second hollow element 118 can be connected to the replaceable magazine 81 so as to be detachable, for example, via a positive connection. For example, each of the inserted gripper arms 114 is capable of gripping the replaceable magazine 81 in a positive fashion by moving laterally in relation to the replaceable magazine 81 using its connecting element 123, and is capable of separating said replaceable magazine 81 from the connecting elements 106 of the magazine support 79 holding it by moving linearly, toward the gripper device 72; by means of a tractive force of the gripper arms 114, associated with the movement, the connection, for example, the latch connection or snap connection between the replaceable magazine 81 and the magazine support 79 that supports the connecting elements 106, is released. The gripper device 72 can therefore be used to position a replaceable magazine 81 in the printing unit 44; 44.1; 44.2 on a magazine support 79 which extends axially parallel to an assigned forme cylinder 09, and also to remove said magazine from there. This process can be characterized as a replacement of at least one replaceable magazine 81 in the relevant printing forme magazine 09. A lateral movement of the gripper arms 114 caused by the drive 117 locks the gripper arms to the replaceable magazine 81.

As was described above in connection with FIG. 24, each printing forme magazine 09, in which at least one replaceable magazine 81 can be arranged by means of the gripper device 72, for example, has at least one conveyor device 80, for example, in the form of a sliding element, for the purpose of moving at least one printing forme, but preferably a plurality of printing formes 01, simultaneously to a forme cylinder 06 of the printing unit 44; 44.1; 44.2 or away from the forme cylinder 06 into an assigned replaceable magazine 81, as part of a conveyance process. A plurality of replaceable magazines 81 can preferably be arranged side by side in the printing forme magazine 09, wherein the printing formes 01 thereof, which are stored in the same plane extending parallel to the forme cylinder 06, can be conveyed together by a conveyor device 80 acting on said replaceable magazines 81 together.

Figure 45:
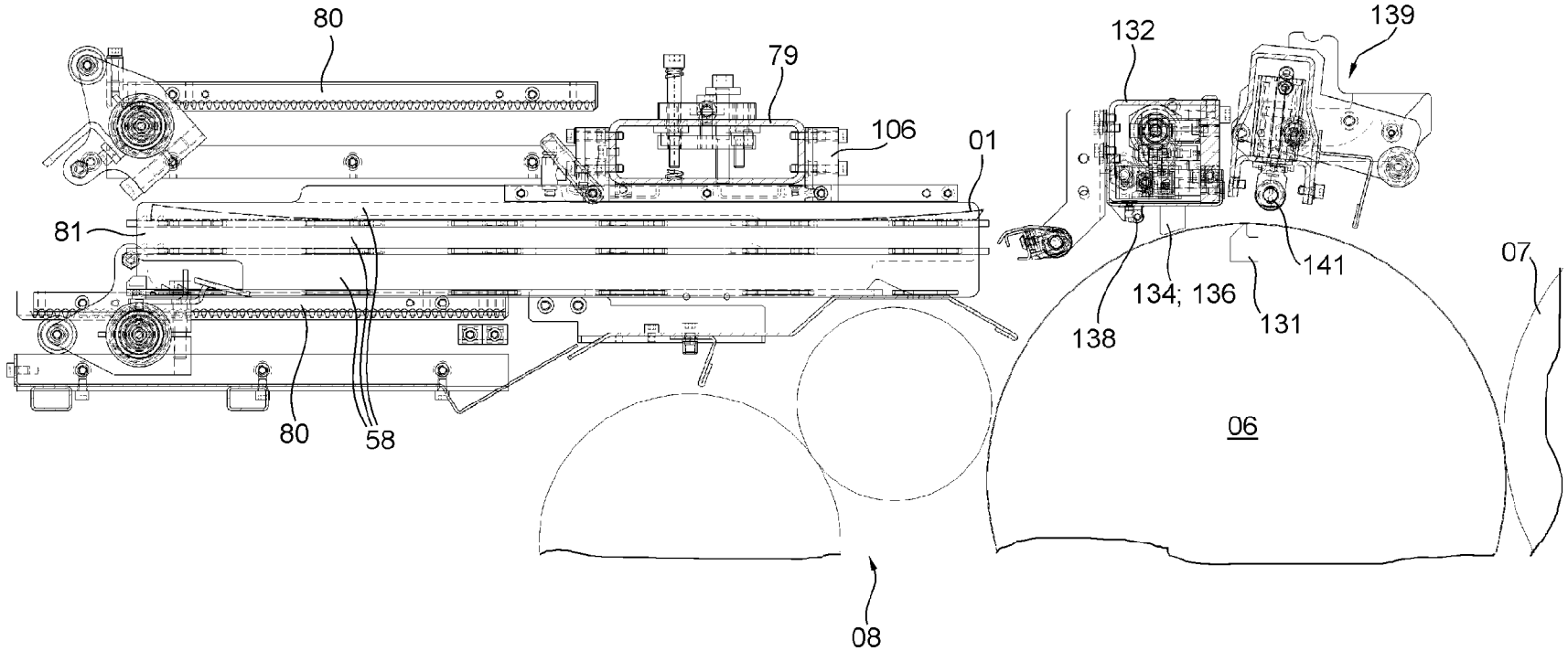
FIG. 45 a sectional illustration of components involved in a change of at least one printing forme carried out in a printing unit.

In what follows, the process for supplying printing formes 01 stored in one of the replaceable magazines 81 to the forme cylinder 06 true to register will be detailed in reference to FIGS. 44 and 45. These printing formes 01, each provided with at least one print image 126, are arranged side by side in the same compartment 58 of the replaceable magazine 81, which is not shown in FIG. 44 for purposes of clarity. In the case of multiple, for example, two, replaceable magazines 81 arranged side by side in the same printing forme magazine 09 (FIGS. 23 to 26), the printing formes 01 to be supplied to the forme cylinder 06 in said replaceable magazine 81 are arranged at least within the same plane 127, i.e., in the supply plane. In FIG. 44, an additional plane 128 for holding additional printing formes 01 to be supplied to or removed from said forme cylinder 06 is indicated, wherein this additional plane 128 can be implemented particularly as an additional compartment 58 formed in the replaceable magazine 81. The printing formes 01 stored in the same plane 127; 128 are preferably supplied to or removed from the forme cylinder 06 together, by means of the conveyor device 80, which is not shown in FIG. 44 for purposes of clarity, wherein said conveyor device 80 engages, for example, with the bent suspension leg 14 on the trailing end 04 of each respective printing forme 01, for example, by means of a sliding element. As a result of the pushing motion exerted during the infeed, the respective suspension leg 13 on the leading end 03 of the respective printing forme 01 is moved to the slit-type opening 129 of a groove 131 located in the forme cylinder 06, wherein said opening 129 has a slit width S ranging from 1 mm to 3 mm, oriented in the circumferential direction of the forme cylinder 06.

Because the printing formes 01 are to be supplied to the forme cylinder 06 true to lateral register, a register device 132 is arranged in the path of these printing formes 01 between the exchangeable magazine or magazines 81 and the forme cylinder 06, extending axially parallel to the forme cylinder 06. This register device 132 has a plurality of lateral stops 134; 136, for example, connected to a swiveling axis 133, on which stops printing formes 01 to be supplied to the forme cylinder 06 can be aligned, each along one of its longitudinal edges 137. In a first arrangement of lateral stops 134, for each of the single-width printing formes 01 arranged side by side one lateral stop 134 is provided, whereas in a second arrangement of lateral stops 136, one lateral stop 136 is provided only for each double-width printing forme 01. Thus with the second arrangement of lateral stops 136, a distance a133 between adjacent lateral stops 136, oriented lengthwise along the axis of rotation 124 of the forme cylinder 06, is greater than in the first arrangement. The two arrangements of lateral stops 134; 136 can be formed alternatively, for example, by rotating the swiveling axis 133 about 180° in the infeed plane 127 of the printing formes 01. The stop surfaces of the lateral stops 134; 136 each extend in an intersecting plane which is orthogonal to the axis of rotation 124 of the forme cylinder 06. In combination with the register device 132, for example, for each single-width printing forme 01, one or more roller elements 138 can be provided, which hold down the printing forme 01 to be supplied to the forme cylinder 06.

FIG. 45 shows, in a simplified sectional illustration, a printing forme magazine 09 disposed in the printing unit 44; 44.1; 44.2, along with a register device 132 assigned to the forme cylinder 06, and a roller strip 139, wherein at least one replaceable magazine 81 having, for example, three compartments 58, is disposed in the printing forme magazine 09, wherein a printing forme 01 to be supplied to the forme cylinder 06 is stored in the uppermost of said compartments 58. The replaceable magazine 81 is positioned by means of at least one connecting element 106 on a magazine support 79 that extends parallel to the rotational axis 124 of the forme cylinder 06. The printing forme 01 is forced out of the compartment 58 of the replaceable magazine 81 by means of the upper conveyor device 80 in FIG. 45. As it is being pushed forward, during which movement the suspension leg 13 on the leading end 03 of said printing forme 01 is fed to the slit-type opening 129 of the groove 131 located in the forme cylinder 06, said printing forme 01 is aligned, true to lateral register, along a lateral stop 134; 136 of the register device 132, adjusted in the infeed plane. A roller strip 139 situated downstream of the register device 132 in the infeed direction of the respective printing forme 01 preferably has a plurality of roller elements 141, particularly wheels, allocated to the printing formes 01 to be supplied side by side to the forme cylinder 06, which rollers can be placed against or moved away from the forme cylinder 06 via remote actuation, and are used to roll the suspension leg 13 on the leading end 03 of the relevant printing forme 01 into the opening 129 of one of the two grooves 131 arranged in the forme cylinder 06 with an offset of 180°, wherein the forme cylinder 06 is preferably embodied as a double circumference cylinder with two printing formes 01 which can be arranged one in front of the other in the circumferential direction of the forme cylinder 06. Naturally, a transfer cylinder 07 which interacts with the forme cylinder 06 and an inking unit 08, along with additional units required for executing the print operation, are also provided in this printing unit 44; 44.1; 44.2.

Figure 46:
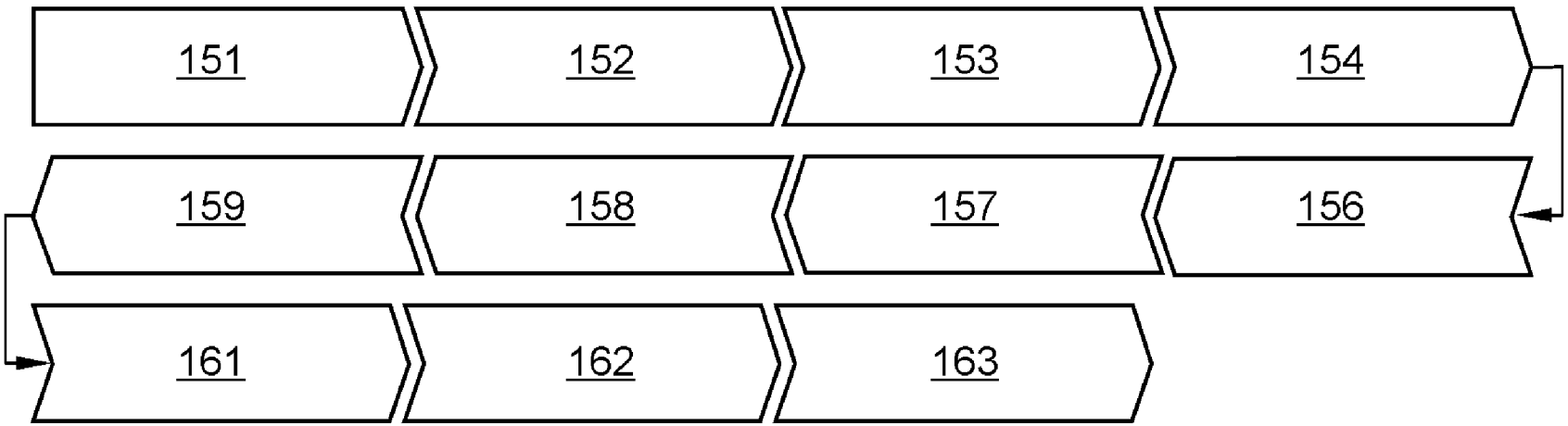
FIG. 46, 47 schematic overviews of a management system for displaying the logistics of the printing formes.
Figure 47:
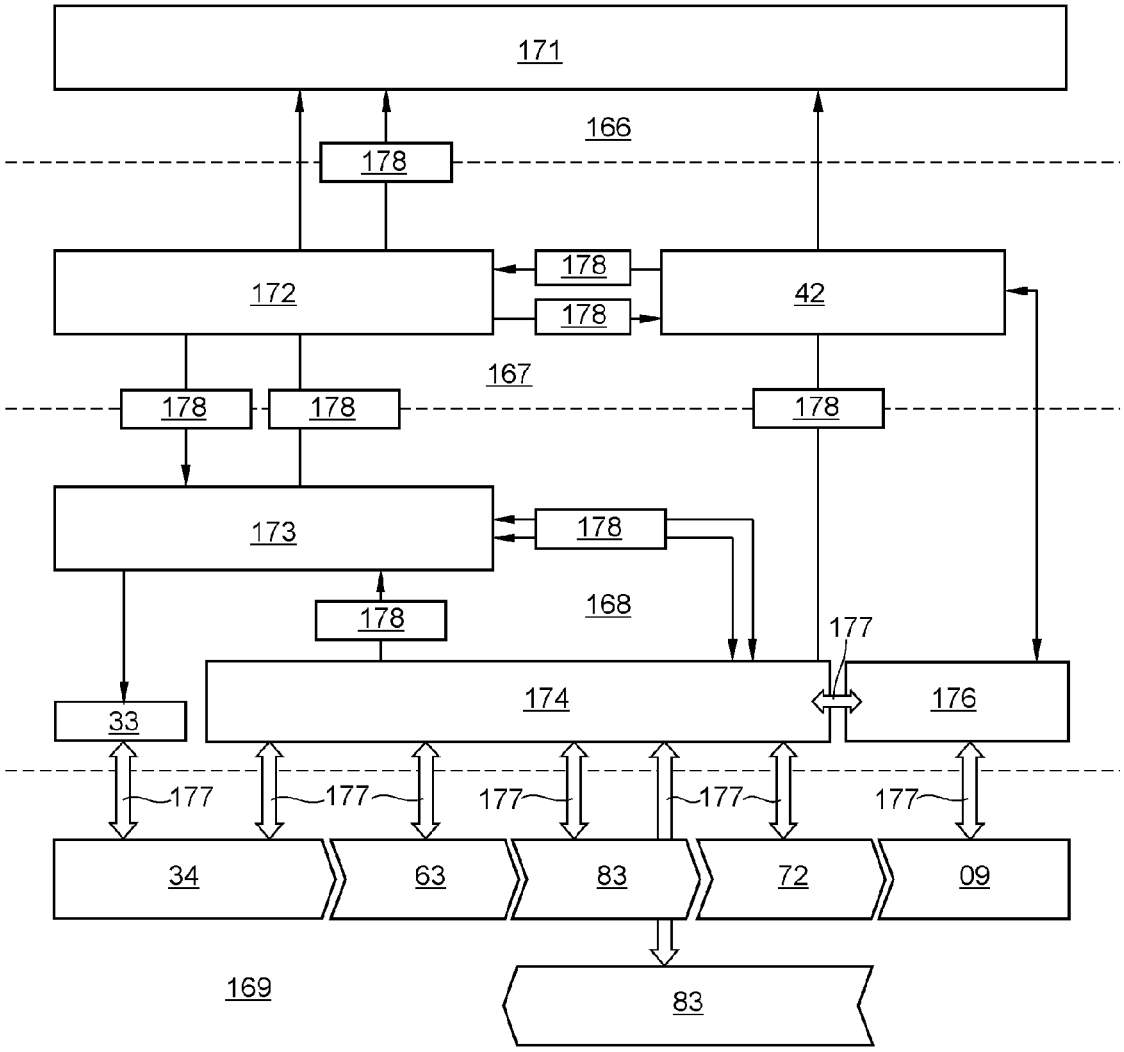

FIGS. 46 and 47 provide a schematic overview of a management system which displays the logistics of the printing formes 01. More particularly, this management system preferably implements the following process steps, illustrated in FIG. 46, in sequence: 151 exposing the printing formes 01 in the plate line, 152 bending the printing formes 01, 153 inspecting the printing formes 01, 154 loading the mobile collecting container 43 or the replaceable magazine 81 with printing formes 01, 156 transporting the mobile collecting container 43 or the replaceable magazine 81 from the plate line to the printing press, 157 temporarily storing the printing formes 01, the mobile collecting container 43 or the replaceable magazine 81, 158 changing the mobile collecting container 43 or the replaceable magazine 81 and/or 159 changing the printing formes 01 at installation positions of the forme cylinder 06, 161 transporting the mobile collecting container 43 or the replaceable magazine 81 back from the printing press to the plate line, 162 disposing of printing formes 01 no longer required on the printing press, 163 returning the mobile collecting container 43 or the replaceable magazine 81 to the plate line.

For controlling, coordinating and monitoring the aforementioned process steps 151 to 163, and optionally overlapping partial processes (not shown in FIG. 46), the management system, which is preferably implemented via software programming, is subdivided into a plurality of modules, for example, program modules, which realize various hierarchical control planes, wherein a specific range of functions is assigned to each module, for example, wherein, for example, a first module implements a tracking plane 166, a second module implements a planning plane 167, a third module implements a coordination plane 168 and a fourth module implements an execution plane 169. More specifically, the tracking plane 166 can relate to a print shop management and tracking system 171, which governs all processes that are run in a print shop and are associated with the production of printed products. The next plane, for example, the planning plane 167, is assigned functions of the production planning system and the at least one control console 42 of the printing press, for example, wherein a program module 172, which is connected to the functions of the production planning system, is preferably executed in the control unit 40 of the production planning system (FIG. 7). The coordination plane 168, which follows the planning plane 167, comprises a program module for sequence control 173 of the production and handling of the printing formes 01, along with a program module 174 for control of the plate logistics management system and a program module 176 for handling of the replaceable magazines 81. The program module 174 for control of the plate logistics management system is executed, for example, in the control unit 39 of the plate logistics management system (FIG. 7). In addition, at least a control of the plate exposure device 33 is also assigned to the coordination plane 168, for example. The lowermost of the aforementioned control planes, the execution plane 169, comprises, for example, at least a) the computer 34 of the prepress stage, wherein said computer 34 prepares and provides the RIP data for the color segments required for multicolor printing by means of a color separation of a print image to be printed, for example, b) the robot 36 positioned at the end of the plate line, with its gripper device 64, with which printing formes 01, produced and ready for use, and provided at an output 66, are allocated to waiting collecting containers 43 (FIG. 18), c) the transport vehicles 83 of the transport system, both in their respective travel up to a printing unit 44; 44.1; 44.2 and in their return from the relevant printing unit 44; 44.1; 44.2 (FIGS. 27 to 35) and/or the vehicle master computer 88 which controls these transport vehicles 83 (FIG. 36), d) the gripper device 72, which is preferably connected to a robot gantry, for changing replaceable magazines 81 on the relevant printing unit 44; 44.1; 44.2

(FIG. 20), and e) the respective printing forme magazine 09, including a control system for the at least one assigned conveyor device 80, register device 132, and roller strip 139 (FIG. 45). The program module 174 for control of the plate logistics management system communicates with the aforementioned devices via a communications connection 177, preferably via bidirectional control lines, as illustrated in FIG. 47. FIG. 47 also indicates by directional lines additional communication paths between the components within the respective control planes and between said control planes, wherein a number of communication paths are guided through various interfaces 178. The subdivision of the four control planes 166; 167; 168; 169 illustrated in FIG. 47 is indicated in each case by a dashed line.

The result is a method for providing printing formes 01 at installation positions on one of a plurality of forme cylinders 06 disposed in a printing press, in which a plurality of printing formes 01 are provided spatially separately from the printing press at the end of at least one plate line, with each such line comprising at least one plate exposure device 33, wherein the printing formes 01 are preferably provided in random sequence with regard to their respective assignment to one of the forme cylinders 06, for example, in a sequence assigned to different locations of use and/or different production runs, wherein printing formes 01 assigned to a specific one of the forme cylinders 06 are distributed among a plurality of mobile collecting containers 43 provided at the plate line, wherein different mobile collecting containers 43, along with the printing formes 01 arranged therein and assigned to the same forme cylinder 06, are conveyed to said forme cylinder 06, wherein at a specific time, on one operating side of the printing press, a plurality of mobile collecting containers 43 are provided side by side in the axial direction of the relevant forme cylinder 06, more particularly, arranged in a row, wherein printing formes 01 assigned to installation positions arranged side by side on the relevant forme cylinder 06, in the axial direction thereof, and transported to the printing press in different mobile collecting containers 43, are preferably removed from these mobile collecting containers 43 simultaneously and then provided to the respective installation positions on the relevant forme cylinder 06.

In the preferred embodiment, each one of this plurality of plate-type printing formes 01, which are flexible at least along their length L and are provided for the same printing process to be carried out by the printing press, is provided at the output of a plate line, which is disposed spatially separately from the printing press and comprises at least one plate exposure device 33, and is temporarily stored in a specific compartment 58 of a mobile collecting container 43 comprising a plurality of compartments 58, wherein the printing formes 01 stored in the same mobile collecting container 43 are provided to installation positions of the same forme cylinder 06, wherein each respective compartment 58 of the mobile collecting container 43 which stores one of the printing formes 01 is selected on the basis of the intended installation position of the relevant printing forme 01 on the relevant forme cylinder 06, using data that are provided by a control unit of a production planning system before said printing formes 01 are placed in storage, wherein printing formes 01 stored in the mobile collecting container 43 and to be provided to the same forme cylinder 06 are conveyed to the printing press in their presorted storage condition.

In the described method, at least one function of the production planning system is preferably executed by a program module of a management system comprising a plurality of program modules, wherein, for example, at least one function of a control plane is executed by various program modules of the management system, wherein a plurality of these control planes implemented by various program modules are hierarchically organized in relation to one another. For instance, at least one function of a tracking plane 166 is executed by a first of the program modules of the management system, at least one function of a planning plane 167 is executed by a second program module, at least one function of a coordination plane 168 is executed by a third program module, and at least one function of an execution plane 169 is executed by a fourth program module. In the tracking plane 166, at least one function of a print shop management and tracking system 171, which governs all processes that are run in a print shop and are connected with the production of printed products, is executed. In the planning plane 167, at least one function of the production planning system and at least one function of at least one of the control consoles 42 assigned to the printing press are executed. In the coordination plane 168, at least one function of a sequence control module 173 for the production of the printing formes 01 is executed and/or at least one control function 174 of a plate logistics and management system and for handling a plurality of mobile collecting containers 43 and/or at least one control function of the plate exposure device 33 is executed. In the execution plane 169, at least one function of a computer 34 of the prepress stage is executed, and/or at least one function of a control of a loading device, disposed at the end of the plate line, for loading the at least one mobile collecting container 43 with printing formes 01, and/or at least one function of a vehicle master computer 88, wherein the vehicle master computer 88 controls the sequence of movements of at least one transport vehicle 83, which transports the at least one mobile collecting container 43, and/or at least one function of a control of a gripper device 72, which executes a change of printing formes 01 on the relevant forme cylinder 06 or executes a replacement of the at least one mobile collecting container 43 on a printing forme magazine 09 assigned to the relevant forme cylinder 06, and/or at least one function of a control of at least one conveyor device 80 assigned to the printing forme magazine 09 and/or at least one function of a control of a register device 132 and/or roller strip 139 assigned to the printing forme magazine 09. A communication between the control module 174 of the plate logistics management system executed in the coordination plane 168 and at least one device disposed in the same control plane and/or at least one device assigned to the execution plane 169 is preferably carried out via a bidirectional communications connection 177.

The described method of plate logistics and the devices required for implementation thereof make it possible to shorten setup times for a printing press in a print shop and optimize production planning, thereby reducing operating costs. Because the plate exposure device 33 is controlled by the sequence control module 173 for the production and handling of the printing formes 01, print orders can be processed "just in time." Transporting the printing formes 01 in replaceable magazines 81 results in a highly secure transport of the produced printing formes 01, ready for use. These printing formes 01 are supplied to their respective locations of use with a high degree of reliability. The danger of confusion with respect to locations of use is practically eliminated. Because the printing forme magazines 09 required for a new production run can be loaded during a running, preceding production run on the printing press, the periods during which the printing press must be taken offline to allow a change in production are decreased to a minimum. The described method of plate logistics allows a visualization of the entire production process. In a simple manner, it allows the processes associated with carrying out a print order to be easily traced, along with simplifying recalculation of the print order that has been carried out. With the described method of plate logistics and the associated devices, processes from plate production up to installation of the printing formes 01 in the printing press can be fully automated.

The device for implementing the method is embodied essentially as a transport system for providing printing formes 01 to a printing unit 44; 44.1; 44.2, wherein a plurality of printing formes 01 can be transported, for example, in the same cartridge 81, wherein a transport vehicle 83 is provided, wherein a plurality of cartridges 81 can preferably be transported simultaneously with the transport vehicle 83. In the printing unit 44; 44.1; 44.2, at least one conveyor device 80 is provided, which conveys printing formes 01 stored in one of the cartridges 81 transported to the printing unit 44; 44.1; 44.2 and disposed in said printing unit 44; 44.1; 44.2 out of said cartridge 81 to a forme cylinder 06 of said printing unit 44; 44.1; 44.2, and as such, is arranged so as to convey these printing formes 01. In the preferred embodiment, a plurality of cartridges 81 can be transported simultaneously with the transport vehicle 83, wherein a plurality of the printing formes 01 to be conveyed to the printing unit 44; 44.1; 44.2 are arranged in each of these cartridges 81. At least one rail 82 is provided, along which the transport vehicle 83 is guided or at least can be guided. The transport vehicle 83 has a support system 84, wherein at least one cartridge 81 can be held by the support system 84 in an at least nearly horizontal alignment, wherein a tolerance of up to +/−20° from horizontal is permissible. On the printing unit 44; 44.1; 44.2, in combination with a parking position for the transport vehicle 83, a holding space 85, provided in addition to the number of forme cylinders 06 disposed on the same operating side of the printing unit 44; 44.1; 44.2, is provided for at least one cartridge 81 to be replaced in the printing unit 44; 44.1; 44.2. A gripper device 82 is provided, which removes cartridges 81 provided by the transport vehicle 83 to the printing unit 44; 44.1; 44.2 from the support system 84 of the transport vehicle 83 individually. On the same operating side of the printing unit 44; 44.1; 44.2, one printing forme magazine 09 is provided at each of different heights, wherein the gripper device 72 inserts each cartridge 81 removed from the support system 84 of the transport vehicle 83 into one of the printing forme magazines 09 arranged one above the other, wherein the gripper device 72 places a cartridge 81 removed from one of the printing forme magazines 09 in the holding space 85 provided in connection with the parking position of the transport vehicle 83, or directly onto the support system 84 of the transport vehicle 83. The gripper device 72 is embodied, for example, as a robot. In connection with the gripper device 72, a positioning device is provided, which can be used to adjust gripper arms 114 of said gripper device 72 in relation to the cartridge 81 to be gripped. A vehicle master computer 88 which controls a sequence of movements of the transport vehicle 83 is provided. The vehicle master computer 88 is connected so as to communicate with a control module 174 of a plate logistics management system. A plurality of transport vehicles 83 are provided, all of which are controlled in terms of their respective sequences of movements by the vehicle master computer 88. Each of the transport vehicles 83 has an identification code. Each of the cartridges 81 transported by one of the transport vehicles 83 has an identification code 104. A loading device 63 is provided, which places printing formes 01, provided at an output 66 of a plate line comprising at least one plate exposure device 33, into cartridges 81 arranged on the transport vehicle 83. In connection with the loading device 63, a control device is provided, which checks to ensure the correct arrangement of the printing formes 01 in the cartridges 81 on the basis of the print order. The control module 174 for the plate logistics management system is also connected so as to communicate with the loading device 63 that loads the cartridges 81 and with the gripper device 72 that handles the cartridges 81 on the printing unit 44; 44.1; 44.2, in addition to its connection with the vehicle master computer 88. A plurality of transport vehicles 83 can be arranged side by side on the same operating side of the printing unit 44; 44.1; 44.2. A plurality of cartridges 81 can be arranged side by side in the printing forme magazines 09 arranged in the printing unit 44; 44.1; 44.2. The cartridges 81 are held on the support system 84 of the transport vehicle 83 and in the respective printing forme magazine 09 by means of connecting elements 106 that are identical in structure. Each of the connecting elements 106 can be detached independently by means of the gripper device 72. Each of the connecting elements 106 is embodied as a latching connector. The cartridges 81 are embodied in a lightweight structure using a multicomponent material. At least one unloading station 98 is provided, where printing formes 01 that have been transported away from the printing unit 44; 44.1; 44.2 can be automatically removed from the cartridges 81 transported by the transport vehicle 83, and additionally, said cartridges 81 arranged on the relevant transport vehicle 83 can be registered on the basis of their respective identification codes 104. One register device 132 and/or one contact pressure device 139 is provided in combination with each printing forme magazine 09 in the printing unit 44; 44.1; 44.2.

While a preferred embodiment of a method for providing printing formes at installation positions on one of a plurality of forme cylinders disposed in a printing press, in accordance with the present invention, has been set forth fully and completely hereinabove, it will be apparent to one of skill in the art that various changes in, for example, the printing forme fabrication devices, the specific structure of the forme cylinders, the drives for the forme cylinders, and the like, could be made without departing from the true spirit and scope of the present invention which is accordingly to be limited only by the appended claims.

What is claimed is:

1. A method for providing printing formes at installation positions on at least one of a plurality of forme cylinders disposed in a printing press including:

providing at least one plate line, and having a plate line end spatially separate from the printing press;

providing at least one plate exposure device in said at least one plate line;

using said at least one plate line for providing a plurality of printing formes at said plate line end;

providing a plurality of mobile collecting containers at said plate line;

distributing printing formes assigned to a specific one of the forme cylinders among a plurality of said mobile collecting containers provided at the plate line;

conveying different ones of said mobile collecting containers, along with the printing formes arranged therein and assigned to the same forme cylinder, from the plate line to said forme cylinder;

providing a mobile collecting container guidance system and transporting the mobile collecting containers to the printing press along said guidance system;

providing a vehicle master computer and determining a current position of at least one of the mobile collecting containers that are moved along the guidance system by use of said vehicle master computer;

providing, at a specific time, a plurality of said mobile collecting containers, that are being conveyed from the plate line to the specific one of the forme cylinders, side by side in an axial direction of the specific one of the forme cylinders on one operating side of the printing press;

assigning said printing formes conveyed to the printing press in said different mobile collecting containers to respective installation positions arranged side by side on the specific one of the forme cylinders, in the axial direction thereof;

removing said printing formes from said different mobile collecting containers, provided side by side at the specific time; and providing said removed printing formes at said respective installation positions on the specific one of the forme cylinders.

2. The method according to claim 1, further including providing each mobile collecting container having a plurality of compartments and holding each of the printing formes provided at the end of the plate line by in a compartment of one of said mobile collecting containers.

3. The method according to claim 2, further including arranging the printing formes assigned to a specific forme cylinder presorted in compartments of the respective collecting containers.

4. The method according to claim 3, further including distributing that these printing formes among the compartments of the respective mobile collecting container on the basis of the respective installation positions of the specific ones of the printing formes on the specific one of the forme cylinders.

5. The method according to claim 2, further including selecting a the respective compartment of the mobile collecting container and with each compartment storing one of the printing formes, on the basis of the intended installation position of the specific one of the printing formes on the specific one of the forme cylinders, using data provided by a control unit of a production planning system and before said printing formes are placed in storage.

6. The method according to claim 5, further including executing at least one function of the production planning system by a program module of a management system that comprises a plurality of program modules.

7. The method according to claim 6, further including executing at least one function of a control plane by each of various program modules of the management system, and further including hierarchically organizing a plurality of these control planes executed by various program modules in relation to one another.

8. The method according to claim 6, further including executing at least one function of a tracking plane by a first of the program modules of the management system.

9. The method according to claim 8, further including executing at least one function of a print shop management and tracking system, which governs all the processes that are run in a print shop and which are connected with the production of printed products, in the tracking plane (166).

10. The method according to claim 6, further including executing at least one function of a planning plane is by a second program module.

11. The method according to claim 9, further including executing at least one function of the production planning system and at least one function of at least one control console assigned to the printing press in the planning plane.

12. The method according to claim 6, further including executing at least one function of a coordination plane by a third program module.

13. The method according to claim 12, further including executing at least one function of a sequence control module for controlling the production of the printing formes in the coordination plane (168).

14. The method according to claim 12, further including executing at least one function of a control module for a plate logistics management system and for handling a plurality of mobile collecting containers is executed in the coordination plane.

15. The method according to claim 14, further including carrying out communication between the control module of the plate logistics management system, executed in the coordination plane, and one of at least one device disposed in the same control plane and at least one device assigned to the execution plane is carried out in each case via a bidirectional communications connection.

16. The method according to claim 12, further including executing at least one function for controlling the plate exposure device in the coordination plane.

17. The method according to claim 6, further including executing at least one function of an execution plane by a fourth program module.

18. The method according to claim 17, further including executing at least one function of a computer of the prepress stage in the execution plane.

19. The method according to claim 17, further including executing at least one function for controlling a loading device, disposed at the end of the plate line, and usable for loading the at least one mobile collecting container with printing formes in the execution plane.

20. The method according to claim 17, further including executing at least one function of a vehicle master computer in the execution plane, and wherein the vehicle master computer is controlling a sequence of movements of at least one transport vehicle which conveys the at least one mobile collecting container.

21. The method according to claim 1, further including distributing the printing formes provided at the end of the plate line, among different mobile collecting containers provided at the end of the plate line, and conveying the different mobile collecting containers to different forme cylinders which are disposed in one of the same and different ones of printing presses and printing units.

22. The method according to claim 1, further including providing a robot and using the robot for distributing the printing formes among the mobile collecting containers provided at the plate line.

23. The method according to claim 1, further including arranging at least two printing formes in the same mobile collecting container and orienting the at least two printing formes differently in terms of their respective contact surfaces.

24. The method according to claim 1, further including positioning each of the individual mobile collecting containers as needed and moving each of the individual mobile collecting containers in a targeted manner by using a control program, on the basis of an identification code provided on said container.

25. The method according to claim 1, further including detaching the mobile collecting containers from their guidance system at their intended positions of assignment to the printing press.

26. The method according to claim 1, further including providing a printing forme magazine for each printing forme and inserting a mobile collecting container, that has been detached from the guidance system is inserted, along with the printing formes arranged therein, into the relevant printing forme magazine for each said printing forme.

27. The method according to claim 1, further including providing a printing forme magazine for each specific forme cylinder and storing the printing formes conveyed to the printing press intermediately in the printing forme magazine that is assigned to the specific one of the forme cylinders, before said printing formes are supplied to the specific one of the forme cylinders.

28. The method according to claim 27 further including inserting, a plurality of mobile collecting containers that have been detached from the guidance system together into the same printing forme magazine.

29. The method according to claim 27 further including removing, a mobile collecting container, that has been detached from the guidance system and inserted into a printing forme magazine from the printing forme magazine and connecting the removed mobile collecting container to the guidance system.

30. The method according to claim 27, further including executing at least one of a function for controlling at least one conveyor device assigned to the printing forme magazine and a function for controlling a register device and a roller strip assigned to the printing forme magazine in the execution plane.

31. The method according to claim 1, further including providing the mobile collecting containers having compartments and providing the mobile collecting containers to the printing press with their compartments in a nearly horizontal alignment.

32. The method according to claim 1, further including providing, at the specific, same time, the same number of mobile collecting containers side by side, in parallel with the operating side of the printing press, as the number of installation positions that are provided side by side in the axial direction of the specific one of the forme cylinders.

33. The method according to claim 1, further including providing the mobile collecting containers at the end of the plate line one of individually and in groups.

34. The method according to claim 1, further including providing a gripper device and removing the printing formes provided in different mobile collecting containers to the same forme cylinder of the printing press using the gripper device.

35. The method according to claim 34, further including executing at least one function for controlling the gripper device in an execution plane executed in the execution plane, and wherein the gripper device one of carries out a change of printing formes on the specific one of the forme cylinders and carries out a replacement of the at least one mobile collecting container on the printing forme magazine assigned to the specific one of the forme cylinders.

36. The method according to claim 1, further including providing a control device at the end of the plate line and using the control device for ensuring that the printing formes are arranged correctly in the plurality of mobile collecting containers, according to a print order.

37. The method according to claim 1, further including an unloading station for unloading at least one printing forme that is transported away from the printing press in the respective mobile collecting containers automatically at the unloading station, and at the same time, registering the mobile collecting container using an identification code provided thereon.

38. The method according to claim 1, further including providing the printing formes in random sequence in terms of their respective assignment to one of the forme cylinders.

39. The method according to claim 1, further including arranging the mobile collecting containers conveyed to the specific forme cylinder side by side in a row in an axial direction of the specific one of the forme cylinders on the one operating side of the printing press.

40. The method according to claim 1, further including removing the printing formes conveyed in different mobile collecting containers to the printing press and assigned to installation positions arranged side by side on the specific one of the forme cylinders, in the axial direction thereof, simultaneously from said mobile collecting containers.

* * * * *